US006122473A

United States Patent [19]

Goseki et al.

[11] Patent Number: 6,122,473

[45] Date of Patent: Sep. 19, 2000

[54] DEVELOPER CARRYING MEMBER FOR CARRYING DEVELOPER, APPARATUS UNIT DETACHABLY MOUNTABLE ON THE MAIN ASSEMBLY OF IMAGE FORMING APPARATUS, AND IMAGE-FORMING APPARATUS

[75] Inventors: Yasuhide Goseki; Masayoshi Shimamura; Kenji Fujishima, all of Yokohama; Michiko Orihara, Tokyo; Kazunori Saiki, Yokohama; Satoshi Otake; Naoki Okamoto, both of Numazu, all of Japan

[73] Assignee: Canon Kabushiki Kaisha, Tokyo, Japan

[21] Appl. No.: 09/050,930

[22] Filed: Mar. 31, 1998

[30] Foreign Application Priority Data

| | | | |
|---|---|---|---|
| Mar. 31, 1997 | [JP] | Japan | 9-079446 |
| Jul. 14, 1997 | [JP] | Japan | 9-202666 |
| Aug. 19, 1997 | [JP] | Japan | 9-222099 |

[51] Int. Cl.[7] ..... G03G 15/08

[52] U.S. Cl. ..... 399/286; 399/265; 399/267; 399/279; 430/105; 430/106.6; 430/107; 430/112; 492/56

[58] Field of Search ..... 399/222, 265, 399/267, 279, 281, 272, 286; 430/120, 107, 106.6, 105, 112, 122; 492/56

[56] References Cited

U.S. PATENT DOCUMENTS

| | | | |
|---|---|---|---|
| 5,175,586 | 12/1992 | Goseki et al. | 399/270 |
| 5,215,845 | 6/1993 | Yusa et al. | 430/106.6 |
| 5,274,426 | 12/1993 | Goseki et al. | 399/276 |
| 5,618,647 | 4/1997 | Sukimoto et al. | 430/106.6 |
| 5,663,022 | 9/1997 | Malhotra | 430/120 X |
| 5,897,477 | 4/1999 | Nakatogawa et al. | 492/56 |

FOREIGN PATENT DOCUMENTS

| | | |
|---|---|---|
| 0810492 | 3/1997 | European Pat. Off. . |
| 54-43038 | 4/1979 | Japan . |
| 56-146167 | 11/1981 | Japan . |
| 58-116559 | 7/1983 | Japan . |
| 1-277265 | 11/1986 | Japan . |
| 1-112253 | 4/1989 | Japan . |
| 2-284158 | 11/1990 | Japan . |

OTHER PUBLICATIONS

Patent Abstracts of Japan, vol. 006, No. 027 (P–102), Feb. 17, 1982.

*Primary Examiner*—Susan S. Y. Lee

*Attorney, Agent, or Firm*—Fitzpatrick, Cella, Harper & Scinto

[57] ABSTRACT

A developer carrying member for carrying a developer is includes a substrate and a resin coat layer which is formed on the surface of the substrate and contains a binder resin and a conductive fine powder. The binder resin is composed of a copolymer having a monomeric unit of a methyl methacrylate monomer (M) and a monomeric unit of a nitrogen-containing vinyl monomer (N). A copolymerization molar ratio of the methyl methacrylate monomer (M) to the nitrogen-containing vinyl monomer (N) in the copolymer fulfills the following condition: M:N=4:1 to 999:1. The binder resin has a weight-average molecular weight (Mw) of from 3,000 to 50,000.

110 Claims, 3 Drawing Sheets

DEVELOPER CARRYING MEMBER FOR CARRYING DEVELOPER, APPARATUS UNIT DETACHABLY MOUNTABLE ON THE MAIN ASSEMBLY OF IMAGE FORMING APPARATUS, AND IMAGE-FORMING APPARATUS

BACKGROUND OF THE INVENTION

1. Field of the Invention

This invention relates to a developer carrying member used in a developing apparatus for carrying out development by the use of a developer, used in electrophotography, electrostatic recording, magnetic recording, etc., and also relates to an apparatus unit and an image forming apparatus which employ such a developer carrying member.

More particularly, this invention relates to a developer carrying member used in a developing apparatus of the system in which a dry-process (powdery) developer is fed to and carried on the surface of a developer carrying member, and the developer thus carried thereon is layer-regulated into a thin layer by means of a layer-thickness regulating member (layer-regulating member) and then transported to a developing zone where the developer carrying member faces the surface of a latent image bearing member, to make the latent image render visible; and also relates to an apparatus unit and an image forming apparatus which employ such a developer carrying ember.

2. Related Background Art

A number of methods are conventionally known as electrophotography. In general, copies are obtained by forming an electrostatic latent image on an electrostatic latent image bearing member (photosensitive member) by utilizing a photoconductive material and by various means, subsequently developing the electrostatic latent image by the use of a toner (developer) to make it visible to form a toner image, transferring the toner image to a transfer medium such as paper as occasion calls, and then fixing the toner image to the transfer medium by heating, pressing or the like.

In recent years, in addition to conventional copying machines, instruments making use of electrophotography are used in various apparatus such as printers and facsimile machines. Especially in printers and facsimile machines, their copying apparatus part must be made smaller, and hence developing apparatus employing one-component developers are often used.

One-component developing systems making use of one-component developers are methods in which electric charges having a polarity reverse to that of electric charges of the electrostatic latent image formed on a photosensitive drum and to the development standard potential are imparted to toner particles by the friction between the toner particles themselves and the friction between a developing sleeve as the developer carrying member and the toner particles, the toner thus charged is very thinly coated on the developing sleeve and then transported to the developing zone where the photosensitive drum faces the developing sleeve, and in the developing zone the toner is caused to adhere to the surface of the photosensitive drum to carry out development to make the electrostatic latent image visible as a toner image.

Such one-component development systems require no carrier particles such as glass beads or iron powder required in two-component development systems, and hence can make developing assemblies themselves small-sized and light-weight. Also, since in the two-component development systems the concentration of toner in developer must be kept constant, a device for detecting toner concentration so as to supply the toner in the desired quantity is required, resulting in an increase in size and weight of the developing assemblies. In the one-component development system, such a device is not required, and hence the developing assemblies can be made small and light-weight as is preferable.

As printers, LED printers or LBP printers are prevailing in the recent market. As a trend of techniques, there is a tendency toward higher resolution. That is, those which hitherto have a resolution of 300 or 400 dpi are being replaced by those having a resolution of 600, 800 or 1,200 dpi. Accordingly, with such a trend, the developing systems are now required to achieve a degree of minuteness.

Copying machines have also made progress to have high functions, and hence the trend is toward digital systems. In this trend, chiefly employed is a method in which electrostatic latent images are formed by using a laser. Hence, the copying machines also trend toward a high resolution and, like the printers, it has been sought to provide a developing system with high resolution and high minuteness. Accordingly, toners having small particle diameters are proposed in Japanese Patent Application Laid-Open Nos. 1-112253 and 2-284158, and toners are being made to have smaller particle diameters.

As the developer carrying member used in the development of the above system, a member is used which is produced by molding, e.g., a metal, an alloy or compound thereof into a cylinder and treating its surface by electrolysis, blasting or filing so as to have a stated surface roughness. In such an instance, however, in the developer layer regulated by the regulating member into a thin layer and formed on the developer carrying member surface, the developer present on the developer carrying member surface and in the vicinity thereof comes to have a very high electric charge, so that it is strongly attracted to the developer carrying member surface by the action of mirror force. This makes the toner particles have no opportunity of their friction with the carrying member, and hence the developer comes to have no preferable electric charges (a phenomenon of what is called "charge-up"). Under such a condition, satisfactory development and transfer cannot be carried out, resulting in images with much uneven image density and many black spots around line images.

In order to prevent the occurrence of such a developer having excessive electric charges and to prevent strong adhesion of the developer, as disclosed in Japanese Patent Application Laid-Open No. 1-277265, a method is proposed in which a coating film of a resin with a conductive material such as carbon black or graphite powder or a solid lubricant dispersed therein is formed on the developer carrying member.

In recent years, it has again become required to save energy consumed in copying machines and LBP (laser beam printer) main bodies. This has brought with it studies energetically made on how to fix at low temperature the developer used, in order to save energy necessary for the fixing. Under the influence of such low-temperature fixing, there is an increase in developers which tend to cause their melt-adhesion to developing sleeves. Thus, giving a preference to the fixing performance may make it difficult to well ensure the developing performance.

In such a trend toward making toner particles finer and fixing temperature lower, it is needed to provide a method by which a sufficient, uniform and high electric charge can be imparted to the toner and also the mirror force can be prevented from acting between the toner and the sleeve.

In the trend toward higher image quality of electrophotography in recent years, there is a tendency that, in order to make image quality much higher, the developer is made to have smaller average particle diameter and also the developer is more strongly regulated in the constitution of developing assemblies so that the developer can be carried on the developer carrying member in a thiner layer. This brings about an increase in physical load against the developer and developer carrying member to more likely cause the above charge-up and also sleeve ghost images.

However, in the developer as stated above, made to have a smaller particle diameter, it is often attempted to increase the content of a magnetic material, to select materials that may collect not too much charge on the toner particle surfaces or to select an external additive having the ability to let charges leak, in order to prevent the developer from being irregularly coated on the developer carrying member. In such instances, the charging of toner strongly tends to rise slowly. In addition, there is a tendency that, as a way of realizing the low-temperature fixing stated above, Tg (glass transition point) of the developer is set a little lower, a low-molecular-weight component is added to binder resin in a little larger quantity, or a low-melting component such as wax is added in a little larger quantity. Use of such materials may make it difficult for the toner to be well charged, often resulting in a decrease in charge quantity to cause a lowering of developing performance. Hence, if only the technique disclosed in the aforesaid Japanese Patent Application Laid-Open No. 1-277265 is relied on, a sufficient charge can not be imparted to the developer, bringing about unsatisfactory results.

Accordingly, it is necessary for the developer carrying member to be more improved in its charge-providing performance to the developer to more likely to prevent the phenomenon of charge-up. Moreover, under the circumstances that the developer layer thickness is more strongly regulated and cartridges are more frequently used or made to have a larger capacity in recent years, it is required for the developer carrying member to have a sufficient wear resistance and a uniformity in its resin coat layer.

Japanese Patent Application Laid-Open No. 56-146167 discloses that, in a one-component developing system, the surface of a member that imparts triboelectricity to toner, i.e., of a toner carrying member contains an organic polymer containing a specific nitrogen-containing group, and its Examples disclose, e.g., a copolymer of dimethylaminoethyl methacrylate with a styrene monomer or a copolymer of p-dimethylaminostyrene monomer with a methyl methacrylate monomer.

However, in the above Japanese Patent Application Laid-open No. 56-146167, the toner carrying member specifically prepared in the Examples are obtained by forming a coating film on the sleeve surface by the use of a solution prepared by adding to a solvent the organic polymer containing a nitrogen-containing group, and hence the coating film has insulating properties. Thus, it is neither disclosed nor suggested how to improve the mechanical strength of coating film, the melt-adhesion resistance of toner against coating film and the dispersibility of conductive fine powder in coating film when the conductive fine powder is added in the coating film of the developer carrying member so as to decrease electrical resistance of the coating film, for the purposes of improving triboelectric charging performance and also making it stable.

In addition, in the above Japanese Patent Application Laid-Open No. 56-146167, the layer thickness of the toner layer formed on the toner carrying member is regulated by the action of a magnetic binding force acting between an iron doctor blade provided in proximity to the toner carrying member surface and a multi-polar permanent magnet provided inside the toner carrying member. Thus, there is room for further improvement in the stability of triboelectric charging performance of toner to environmental variations.

Techniques in which a elastic blade is brought into touch with the toner layer on the toner carrying member in order to make the triboelectric charging performance stable to variations of external environmental conditions are disclosed in Japanese Patent Application Laid-Open Nos. 54-43038 and 58-116559.

SUMMARY OF THE INVENTION

An object of the present invention is to provide a developer carrying member that enables the developer on the developer carrying member to have stable and proper electric charges even in repeated image reproduction and can contribute to the formation of uniform and even high-grade images without causing a decrease in image density or causing ghost images; and an apparatus unit and an image forming apparatus which employ such a developer carrying member.

Another object of the present invention is to provide a developer carrying member that can contribute to the formation of highly minute high-grade images because of a more improved charging performance or developing performance even when toners having a small particle diameter and making use of a low-temperature fixing material are used for the purposes of high image quality and energy saving; and an apparatus unit and an image forming apparatus which employ such a developer carrying member.

Still another object of the present invention is to provide a developer carrying member that can contribute to the long-term formation of stable images by ensuring wear resistance of a resin coat layer and by forming a much more uniform resin layer; and an apparatus unit and an image forming apparatus which employ such a developer carrying member.

A further object of the present invention is to provide a developer carrying member that can contribute to the long-term formation of stable images by making toner adhere less to the resin coat layer; and an apparatus unit and an image forming apparatus which employ such a developer carrying member.

A still further object of the present invention is to provide an apparatus unit and an image forming apparatus which can form stable high-grade images because of the use of a developer carrying member that can have a uniform surface state for a long time.

A still further object of the present invention is to provide a developer carrying member that can impart a sufficiently high charge to the developer on the developer carrying member even in long-term continuous copying, also can impart electric charges proper enough to be stable and not to cause charge-up and can contribute to the formation of high-grade images which are uniform and free of uneven density, without causing a decrease in image density during running; and an apparatus unit and an image forming apparatus which employ such a developer carrying member.

A still further object of the present invention is to provide a developer carrying member that enables the developer on the developer carrying member to have stable and proper electric charges under various environments and can prevent the developer from melt-adhering to the developer carrying member; and an apparatus unit and an image forming apparatus which employ such a developer carrying member.

To achieve the above objects, the present invention provides a developer carrying member for carrying a developer, comprising;

a substrate and a resin coat layer which is formed on the surface of the substrate and contains a binder resin and a conductive fine powder, wherein;

the binder resin comprises a copolymer having a monomeric unit of a methyl methacrylate monomer (M) and a monomeric unit of a nitrogen-containing vinyl monomer (N);

a copolymerization molar ratio of the methyl methacrylate monomer (M) to the nitrogen-containing vinyl monomer (N) in the copolymer fulfills the following condition:

M:N=4:1 to 999:1;

and the binder resin has a weight-average molecular weight (Mw) of from 3,000 to 50,000.

The present invention also provides an apparatus unit detachably mountable on the main assembly of an image forming apparatus, the unit comprising;

a developer container for holding a developer;

a developer carrying member for carrying the developer held in the developer container and transporting the developer to a developing zone; and a developer layer-thickness regulating member which comes into pressure contact with, or abuts on, the surface of the developer carrying member through the developer to regulate the layer thickness of a developer layer formed on the developer carrying member;

the developer carrying member comprising a substrate and a resin coat layer which is formed on the surface of the substrate and contains a binder resin and a conductive fine powder, wherein;

the binder resin comprises a copolymer having a monomeric unit of a methyl methacrylate monomer (M) and a monomeric unit of a nitrogen-containing vinyl monomer (N);

a copolymerization molar ratio of the methyl methacrylate monomer (M) to the nitrogen-containing vinyl monomer (N) in the copolymer fulfills the following condition:

M:N=4:1 to 999:1;

and the binder resin has a weight-average molecular weight (Mw) of from 3,000 to 50,000.

The present invention still also provides an image forming apparatus comprising;

an electrostatic latent image bearing member for bearing thereon an electrostatic latent image; and a developing assembly for developing the electrostatic latent image to form a developed image;

the developing assembly comprising;

a developer container for holding a developer;

a developer carrying member for carrying the developer held in the developer container and transporting the developer to a developing zone; and a developer layer-thickness regulating member which comes into pressure contact with, or abuts on, the surface of the developer carrying member through the developer to regulate the layer thickness of a developer layer formed on the developer carrying member;

the developer carrying member comprising a substrate and a resin coat layer which is formed on the surface of the substrate and contains a binder resin and a conductive fine powder, wherein;

the binder resin comprises a copolymer having a monomeric unit of a methyl methacrylate monomer (M) and a monomeric unit of a nitrogen-containing vinyl monomer (N);

a copolymerization molar ratio of the methyl methacrylate monomer (M) to the nitrogen-containing vinyl monomer (N) in the copolymer fulfills the following condition:

M:N=4:1 to 999:1;

and the binder resin has a weight-average molecular weight (Mw) of from 3,000 to 50,000.

DESCRIPTION OF THE PREFERRED EMBODIMENTS

Figure 1:
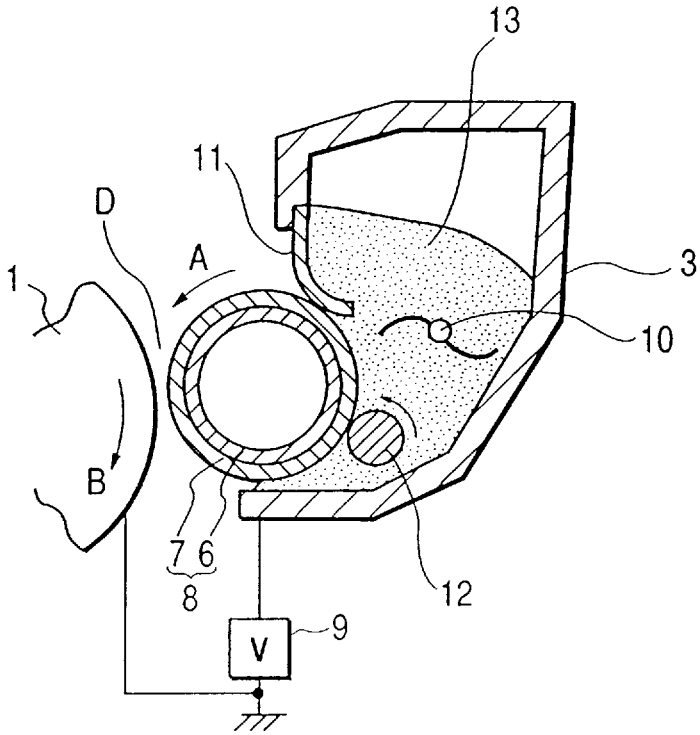
FIG. 1 is a diagrammatic view showing an example of a non-magnetic one-component developing system developing assembly having the developer carrying member of the present invention.

In the developer carrying member of the present invention, a resin coat layer is formed on the surface of a substrate, and contains a binder resin and a conductive fine powder, and the binder resin has a copolymer having a monomeric unit of a methyl methacrylate monomer (M) and a monomeric unit of a nitrogen-containing vinyl monomer (N) in a specific proportion, the former unit having a high mechanical strength and the latter unit having a high negatively triboelectric-charging properties to the developer. Hence, the developer carrying member has a resin coat layer having a high wear resistance and has a good triboelectric charging performance even after many-sheet running operations.

In addition, since this copolymer contains the nitrogen-containing vinyl monomer (N) unit, conductive fine powder such as carbon black or graphite powder can be improved in its dispersibility in the resin coat layer. Hence, the resin coat layer can have a low electrical resistance and the uniformity of triboelectric charging performance on the surface of the resin coat layer can be improved, so that its triboelectric charging performance to the developer can be made higher and the developer can be charged in a sharp charge-quantity distribution. Also, the resin coat layer itself can be improved in its film strength and hence has a much superior many-sheet running performance. It is not clear why the conductive fine powder such as carbon black or graphite powder can be improved in its dispersibility in the resin coat layer when the copolymer contains the nitrogen-containing vinyl monomer (N) unit, but the reason is presumed to be as follows: Since polar groups based on the nitrogen atom in the nitrogen-containing vinyl monomer (N) unit are contained, the solubility of the resin in a solvent, in particular, in a solvent having a polarity is improved, so that the solution in which the resin is dissolved can be improved in its wettability for the conductive fine powder and the conductive fine powder can be improved in its dispersibility in the solution and in addition can be improved in dispersion stability after it has been dispersed. Hence, when such a solution is coated and the resin coat layer is formed, the conductive fine powder can be well dispersed in the resin coat layer. The present invention is more effective especially when the conductive fine powder is a substance having polar groups on the particle surfaces, such as carbon black, because its affinity attributable to polar groups based on the nitrogen atoms in the nitrogen-containing vinyl monomer can be more improved.

Moreover, this copolymer also has a weight-average molecular weight (Mw) of from 3,000 to 50,000, and hence the developer component can be prevented from its melt-adhesion to the surface of the resin coat layer, which may be caused by low-molecular-weight components. Also, the resin coat layer itself can have a high film strength and hence has a much superior many-sheet running performance. In addition, the conductive fine powder such as carbon black or graphite powder can be well dispersed in the binder resin of the resin coat layer, and hence the effect attributable to such dispersibility can be more remarkably attained, which is the above effect that "the resin coat layer can have a low electrical resistance and the uniformity of triboelectric charging performance on the surface of the resin coat layer can be improved, so that its triboelectric charging performance for the developer can be made higher and the developer can be charged in a sharp charge-quantity distribution, and also, the resin coat layer itself can be improved in its film strength and hence has a much superior many-sheet running performance". Especially when the resin coat layer is formed by applying a coating solution prepared by dissolving (and/or dispersing) a binder resin in a solvent, the viscosity of resin in the coating solution greatly affects the dispersibility of the conductive fine powder, and hence the effect of improving the dispersibility of the conductive fine powder in the resin coat layer is particularly noteworthy.

Thus, the developer carrying member of the present invention can stably charge the developer in a high and uniform triboelectric charge quantity in every environment from beginning to end of many-sheet running operations, even when applied in the developing system which employs the developer layer-thickness regulating member which comes into pressure contact with, or abuts on, the surface of the developer carrying member through the developer and tends to cause wear of the resin coat layer. Moreover, the developer carrying member of the present invention can prevent the fine-powder toner from its accumulation, adhesion and melt-adhesion due to maintenance of the resin coat layer surface and charge-up on the developer carrying member, can make image density stable and can form satisfactory line images and thick solid images.

The developer carrying member used in the present invention will be detailed below.

The substrate used in the developer carrying member may be a columnar member, cylindrical member or belt-like member made of metal, resin, rubber or a composite materials thereof, any of which may be used. A cylindrical pipe may particularly preferably be used. Such a cylindrical pipe may be prepared by forming a non-magnetic metal such as aluminum, stainless steel or brass into a cylinder followed by polishing and grinding, which may preferably be used. Such a metal cylindrical pipe is molded or worked in a high precision in order to improve the uniformity of images, and then put into use. For example, it may preferably have a straightness in its longitudinal direction, of 30 $\mu$m or less, and more preferably 20 $\mu$m or less, and may also preferably have a developing sleeve/photosensitive drum gap deflection of 30 $\mu$m or less, and more preferably 20 $\mu$m or less, e.g., a deflection of the gap between a vertical surface and a sleeve when the sleeve is rotated in such a state that it is put against the vertical surface via a uniform spacer.

The binder resin (copolymer) of the resin coat layer of the developer carrying member (sleeve) contains the methyl methacrylate monomer (M) unit as a main component. The methyl methacrylate, when used as a polymer, has a superior mechanical strength. Hence, when used as the binder resin of the resin coat layer on the sleeve surface, the developer can be well triboelectrically charged in many-sheet running operations. If, however, it is used as a homopolymer, the triboelectric charging performance is often weak and insufficient. Accordingly, it is used as a copolymer containing the nitrogen-containing vinyl monomer (N) unit so that the triboelectric charging performance can be improved. In the present invention, the copolymer contains the methyl methacrylate component in a percentage of at least 80% by mole, and hence the mechanical strength, e.g., wear resistance is by no means damaged, compared with the homopolymer of methyl methacrylate. Further, since the nitrogen-containing vinyl monomer component is contained, the dispersibility can be improved as stated above when a pigment component such as the conductive fine powder is dispersed in the resin coat layer. Hence, this improvement in dispersibility also brings about preferable results for the uniformity of triboelectric charging and the wear resistance. For example, the use of styrene as the main component results in a lower triboelectric charging performance than the use of methyl methacrylate, and also results in poor wear resistance. Hence, such a material is not suited for developing assemblies which are required to have a long-term running performance (many-sheet running operations performance) or are so constructed that a stronger force is applied to the sleeve, e.g., a developing assembly in which an elastic layer-regulating member or stripping roller is brought into touch with the sleeve surface.

In the present invention, the copolymerization molar ratio of the methyl methacrylate monomer (M) to the nitrogen-containing vinyl monomer (N) in the copolymer may fulfill the following condition:

$$M:N=4:1 \text{ to } 999:1;$$

and may preferably fulfill the following condition:

$$M:N=4:1 \text{ to } 99:1.$$

If the M is more than 999, the addition of the nitrogen-containing vinyl monomer may be ineffective, i.e., the triboelectric charging performance may only be a very little improved, and the effect expected by copolymerization with it can be little seen. If the M is less than 4, the resin coat layer can not be stable because of, e.g., a lowering of Tg, thus, e.g., the charging performance and wear resistance of the resin coat layer may be damaged as a result of temperature rise of the main body of an electrophotographic apparatus, or the developer (toner) tends to stick. A decrease in the proportion of the methyl methacrylate component brings about a decrease in mechanical strength.

In the present invention, the above copolymer may further contain other vinyl monomer units, provided that the methyl methacrylate monomer (M) may preferably be contained in an amount of from 70 to less than 99.9% by mole, and more preferably from 70 to 99.0% by mole, based on the total monomers constituting the copolymer, and the nitrogen-containing vinyl monomer (N) may preferably be contained in an amount of from 0.1 to less than 20% by mole, and more preferably from 1 to less than 20% by mole, based on the total monomers constituting the copolymer. This is preferable in view of the wear resistance of the resin coat layer and the triboelectric charging performance for the developer.

If the methyl methacrylate monomer (M) is in an amount less than 70% by mole, the resin coat layer tends to have a low mechanical strength and the wear resistance may be damaged. If it is in an amount not less than 99.9% by mole, the ratio M:N can not satisfy the relationship of 4:1 to 999:1, and a sufficient triboelectric charging performance for the developer cannot be achieved.

If the nitrogen-containing vinyl monomer (N) is in an amount less than 0.1% by mole, a sufficient triboelectric charging performance for the developer cannot be achieved. If it is in an amount not less than 20% by mole, the ratio M:N can not satisfy the relationship of 4:1 to 999:1, and the resin coat layer tends to have a low mechanical strength.

The binder resin used in the present invention may have a molecular weight of from 3,000 to 50,0000, and preferably from 4,000 to 30,000, as weight-average molecular weight Mw. If the binder resin has an Mw less than 3,000, the low-molecular-weight component is so large in its quantity that the developer (toner) tends to adhere or stick to the sleeve or the resin coat layer may have a low charging performance. If it has an Mw more than 50,000, the resin has such a high molecular weight and such a high viscosity in the solvent that it may cause faulty coating or, when pigments are added, faulty dispersion, such that the resin coat layer may have non-uniform composition to cause unstable developer (toner) charging and also the resin coat layer may not have a stable surface roughness to cause a decrease in wear resistance.

The binder resin used in the present invention may also preferably have a ratio of a weight-average molecular weight Mw to a number-average molecular weight Mn (Mw/Mn) of not more than 3.5, and more preferably not more than 3.0. If the ratio Mw/Mn is more than 3.5, the low-molecular-weight component increases to frequently cause adhesion or melt-adhesion of the developer or cause a lowering of triboelectric charging performance to the developer.

In the present invention, the molecular-weight distribution of the binder resin is measured by GPC (gel permeation chromatography) in the following way.

Columns are stabilized in a heat chamber of 40° C. To the columns kept at this temperature, THF (tetrahydrofuran) as a solvent is flowed at a flow rate of 1 ml per minute, and about 100 $\mu$l of THF sample solution is injected thereinto and subjected to measurement. In measuring the molecular weight of the sample, the molecular weight distribution of the sample is calculated from the relation between the logarithmic value and count number of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from Showa Denko K.K. or Toso Co., Ltd., and to use at least about 10 standard polystyrene samples. An RI (refractive index) detector is used as a detector. A plurality of commercially available polystyrene gel columns are preferably used in combination. For example, the following may be named: a combination of Shodex GPC KF-801, KF-802, KF-803, KF-804, KF-805, KF-806, KF-807 and KF-800P, available from Showa Denko K.K.; or a combination of TSKgel G1000H($H_{XL}$), G2000H($H_{XL}$), G3000H($H_{XL}$), G4000H($H_{XL}$), G5000H ($H_{XL}$), G6000H($H_{XL}$), G7000H($H_{XL}$) and TSK guard column, available from Toso Co., Ltd.

To prepare the measuring sample, for example, a resin solution prepared by solution polymerization is dried under the conditions of 150° C., 1.5 hours and 15 mmHg to remove the polymerization solvent. The sample thus prepared is further dissolved in tetrahydrofuran (THF), and then measured by GPC.

Typical examples of the nitrogen-containing vinyl monomer include aminoacrylic or aminomethacrylic monomers such as p-dimethylaminostyrene, dimethylaminomethyl acrylate, dimethylaminoethyl acrylate, dimethylaminopropyl acrylate, diethylaminomethyl acrylate, diethylaminoethyl acrylate, dimethylaminomethyl methacrylate, dimethylaminoethyl methacrylate, dimethylaminopropyl methacrylate, diethylaminomethyl methacrylate and diethylaminoethyl methacrylate; and nitrogen-containing, heterocyclic N-vinyl compounds such as N-vinylimidazole, N-vinylbenzimidazole, N-vinylcarbazole, N-vinylpyrrole, N-vinylpiperidine, N-vinylmorpholine and N-vinylindole.

In particular, it is preferable to use nitrogen-containing vinyl monomers represented by the following Formula (1), such as diethylaminoethyl methacrylate and diethylaminoethyl methacrylate, or quaternary ammonium group-containing vinyl monomers.

(1)

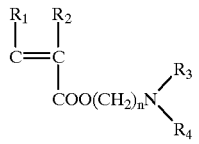

wherein $R_1$, $R_2$, $R_3$ and $R_4$ each represent a hydrogen atom or a saturated hydrocarbon group having 1 to 4 carbon atoms; and n represents an integer of 1 to 4.

As the quaternary ammonium group-containing vinyl monomers usable in the present invention, there are no particular limitations on their structure so long as they are copolymerizable with methyl methacrylate. As a more preferred quaternary ammonium group-containing vinyl monomer named are quaternary ammonium group-containing vinyl monomers represented by the following Formula (2).

(2)

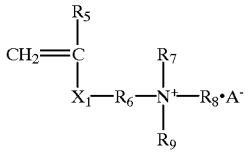

wherein $R_5$ represents a hydrogen atom or a methyl group; $R_6$ represents an alkylene group having 1 to 4 carbon atoms; $R_7$, $R_8$ and $R_9$ each represent a methyl group, an ethyl group or a propyl group; $X_1$ represents —COO or —CONH; and A represents an anion such as $Cl^-$ or $(1/2)SO_4^{2-}$.

The copolymer used for the resin coat layer of the developing carrying member of the present invention, which contains the monomeric units of the methyl methacrylate monomer (M) and nitrogen-containing vinyl monomer (N), may also be a terpolymer having as an additional monomeric unit a monomeric unit of an acid monomer or acid ester monomer (A) having a vinyl group, other than methyl methacrylate. This is one of preferred embodiments.

It is preferable to more improve triboelectric charging performance and triboelectric charging stability by using at least such a terpolymer containing methyl methacrylate as the main component, the nitrogen-containing vinyl monomer and the acid monomer or acid ester monomer having a vinyl group, other than methyl methacrylate.

Since also in the developer carrying member of the present embodiment, the methyl methacrylate component is used as the main component of the terpolymer which is the material forming the resin coat layer on the sleeve surface, the mechanical strength, e.g., wear resistance is by no means inferior, as compared with the instance where the resin coat layer is formed of a homopolymer of methyl methacrylate. In the present embodiment, it is particularly preferred that the methyl methacrylate component is contained in a percentage of 70% or more.

Further, since in the present embodiment, the nitrogen-containing vinyl monomer is contained in the binder resin of the resin coat layer, dispersibility can be improved when a pigment component such as the conductive fine powder is dispersed in the resin coat layer, thus this is also preferable for an improvement in wear resistance.

Compared with these, for example, the use of polystyrene as the main component of the binder resin that forms the resin coat layer on the sleeve surface results in a poor triboelectric charging performance, and also results in poor wear resistance. Hence, those in which polystyrene is used as the main component of the material for forming the resin coat layer are not suited for use in developing assemblies which are required to have a long-term running performance (many-sheet running performance) or are so constructed that a stronger force is applied to the sleeve, e.g., a system in which an elastic layer-regulating member or a stripping roller is brought into contact with the sleeve surface.

Moreover, since in the present embodiment the acid monomer or acid ester monomer having a vinyl group other than methyl methacrylate is contained as a material for forming the resin coat layer, this is effective for also ensuring charge stability of the developer on the developer carrying member.

The acid monomer or acid ester monomer having a vinyl group other than methyl methacrylate, which is one component of the above terpolymer, may include, e.g., monocarboxylic acid monomers having a double bond, and ester compounds thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, butyl methacrylate, octyl methacrylate, acrylonitrile, methacrylonitrile and acrylamide; and dicarboxylic acid monomers having a double bond, and ester compounds thereof, such as maleic acid, butyl maleate, methyl maleate and dimethyl maleate. For the effect on the triboelectric charge quantity being stabilized, the use of the acid ester monomer is a little better than the use of the acid monomer.

The above acid monomer or acid ester monomer (A) having a vinyl group may preferably be contained in an amount of from 0.1 to less than 30% by mole, and more preferably from 1 to 20% by mole, based on the total monomers constituting the terpolymer.

If the acid monomer or acid ester monomer (A) having a vinyl group is in an amount less than 0.1% by mole, the addition of the monomer (A) is not sufficiently effective, so that the effect of controlling triboelectric charging performance and the effect of stabilizing it which are attributable to the addition of the monomer (A) may not be attained. If it is in an amount not less than 20% by mole, the monomer (A) may so act as to inhibit the effect of improving triboelectric charging performance which is attributable to the addition of the nitrogen-containing vinyl monomer (N).

The conductive fine powder which is added in the resin coat layer of the present invention and imparts conductivity to the resin coat layer may include, e.g., powders of metals of copper, nickel, silver and aluminum or alloys thereof; metal oxides such as antimony oxide, indium oxide, tin oxide and titanium oxide; and carbon type conductive agents such as carbon fiber, carbon black and graphite.

The amount of the conductive fine powder added may differ depending on the developing system used. It may be so added that the resin coat layer has a volume resistivity of from $1\times10^{-2}$ Ω.cm to $1\times10^{5}$ Ω.cm. Carbon black, in particular, conductive amorphous carbon may preferably be used because it has especially a superior electrical conductivity, can be added in a smaller quantity than other carbon to impart the conductivity, and can give any desired resistivity to a certain degree by controlling its quantity.

This conductive fine powder may preferably have a number-average particle diameter of from about 0.01 to 30 μm, and more preferably from 0.02 to 25 μm. Such a powder may be used. If the conductive fine powder has a number-average particle diameter smaller than 0.01 μm, it may undesirably be lowly dispersed in the coating solution. If it has a number-average particle diameter larger than 30 μm, the resin coat layer may have an uneven surface roughness, which is undesirable in view of uniform charging of the developer and strength of the resin coat layer.

The number-average particle diameter of the conductive fine powder is measured using an electron microscope. A photograph is taken at 60,000 magnifications power. If it is difficult to do so, a photograph taken at lower magnifications power is enlarged on its print so as to be 60,000 magnifications power. On the photograph, particle diameters of primary particles are measured in respect of particles with particle diameters of 0.005 μm or larger. Here, major axes and minor axes are measured, and a value obtained by averaging the measurements is regarded as particle diameter. This is measured on 100 samples, and an average value of the 100 samples is regarded as the average particle diameter.

In order to control the resin coat layer to have a volume resistivity within the above range, specifically the conductive fine powder may preferably be in a content of from 1 to 400 parts by weight, and more preferably from 10 to 200 parts by weight, based on 100 parts by weight of the binder resin.

It is also preferable to incorporate lubricating powder in the resin coat layer of the present invention. As examples of such lubricating powder, molybdenum disulfide, boron nitride, mica, graphite, graphite fluoride, silver-niobium selenide, calcium chloride-graphite, talc, Teflon, fluoropolymers such as PVDF, and fatty acid metal salts such as zinc stearate, magnesium stearate, aluminum stearate and zinc palmitate. In particular, graphite is preferably used because it has lubricity and also conductivity.

In the present invention, the resin coat layer may be formed by, e.g., dispersing and mixing the respective components in a solvent to prepare a coating material with which the aforementioned substrate is coated. To disperse and mix the respective components, a known dispersion machine that utilizes beads may preferably be used, as exemplified by a sand mill, a paint shaker, a Daino mill or a pearl mill. The coating material may be coated by dipping, spraying or roll coating.

In the present invention, the resin coat layer may preferably have a surface roughness of from 0.3 to 3.5 $\mu$m, and more preferably from 0.4 to 2.5 $\mu$m, as JIS center-line average roughness (Ra). If the resin coat layer has an Ra smaller than 0.3 $\mu$m, the developer may be transported at a low performance, resulting in an insufficient supply of the developer. Moreover, the developer undesirably tends to form an passive layer on the surface of the developer carrying member because of a mirror force, so that the developer may be insufficiently charged to result in an unsatisfactory developing performance, causing faulty images such as uneven images, black spots around line images and in decrease density. If it has an Ra larger than 3.5 $\mu$m, the developer coat layer may be insufficiently regulated on the developer carrying member to result in an unsatisfactory image uniformity, or the developer may be insufficiently charged to result in a decrease in density. A more preferable range may differ depending on how to regulate the developer layer thickness. Whatever form is taken, it is preferred that the Ra is in the above range.

In the present invention, the surface roughness is measured using a surface roughness meter SE-3300H, manufactured by Kosaka Kenkyusho and under conditions of a cut-off of 0.8 mm, a specified distance of 8.0 mm and a feed rate of 0.5 mm/sec, and measurements at 12 spots are averaged.

A developing assembly and an apparatus unit which employ the developer carrying member of the present invention will be illustrated below.

FIG. 1 diagrammatically illustrates an example of a developing assembly in which a nonmagnetic one-component developer is used.

As shown in FIG. 1, a latent image bearing member, e.g., an electrophotographic photosensitive drum 1, which bears an electrostatic latent image formed by a known process is rotated in the direction of an arrow B. A developing sleeve 8 as the developer carrying member is constituted of a cylindrical pipe (substrate) 6 made of metal, and a resin coat layer 7 formed on its surface. Since the nonmagnetic, one-component developer is used, no magnet is provided inside the metal cylindrical pipe 6. In place of the metal cylindrical pipe, a columnar member may be used. Inside a hopper 3 serving as a developer container, an agitating blade 10 for agitating the nonmagnetic one-component developer 4 is provided.

A feeding or stripping member 12 for feeding the developer to the developing sleeve 8 and also stripping off the developer present on the surface of the developing sleeve 8 after development is provided in contact with the developing sleeve 8. As the feeding member feed roller 12 is rotated in the same direction as the developing sleeve 8, the surface of the feed roller 12 moves in the direction counter to the surface movement of the developing sleeve 8, where the nonmagnetic one-component developer having a nonmagnetic toner fed from the hopper 3 is fed onto the developing sleeve 8. The developing sleeve 8 carries the nonmagnetic one-component developer 4 and is rotated in the direction of an arrow A. Thus, the nonmagnetic one-component developer 4 is transported to a developing zone D where the developing sleeve 8 and the photosensitive drum 1 face each other. The layer thickness of the one-component developer carried on the developing sleeve 8 is regulated by a developer layer-thickness regulating member coming into pressure touch with the surface of the developing sleeve through the developer layer.

The nonmagnetic one-component developer 4 gains triboelectric charges enabling the development of the electrostatic latent image on the photosensitive drum 1, as a result of its friction with the resin coat layer 7 on the developing sleeve 8.

The thickness of the thin layer of the nonmagnetic one-component developer 4, thus formed on the developing sleeve 8, may preferably be smaller than the minimum gap D between the developing sleeve 8 and the photosensitive drum 1 in the developing zone. The present invention is especially effective when applied in a non-contact type developing assembly that develops the electrostatic latent image by forming such a developer layer. The present invention, however, may also be applied in a contact type developing assembly in which the thickness of the developer layer is larger than the minimum gap D between the developing sleeve 8 and the photosensitive drum 1 in the developing zone.

To avoid complicating the of description, the non-contact developing assembly is taken as an example in the following description.

In order to fly the one-component developer 4 having a non-magnetic toner, carried on the developing sleeve 8, a development bias voltage is applied to the developing sleeve 8 through a power source 9. When a DC voltage is used as the development bias voltage, a voltage having a value intermediate between the potential at electrostatic latent image areas (the region rendered visible upon attraction of the developer 4) and the potential at back ground areas may preferably be applied to the developing sleeve 8. In order to enhance the density of developed images or improve the gradation thereof, an alternating bias voltage may be applied to the developing sleeve 8 to form in the developing zone a vibrating electric field whose direction alternately reverses. In such an instance, an alternating bias voltage formed by superimposing the above DC voltage component having a value intermediate between the potential at image areas to be developed and the potential at back ground areas may preferably be applied to the developing sleeve 8.

In the case of what is called regular development, where the developer is attracted to high-potential areas of an electrostatic latent image having high-potential areas and low-potential areas, a developer chargeable to a polarity reverse to the polarity of the electrostatic latent image is used. In the case of what is called reverse development, where the developer is attracted to low-potential areas of the electrostatic latent image, a developer chargeable to the same polarity as the polarity of the electrostatic latent image is used. The words "high-potential" and "low-potential" used herein mean absolute values. In either case, the nonmagnetic one-component developer 4 is charged upon its friction with the developing sleeve 8 to have the polarity for developing the electrostatic latent image.

The stripping member 12 may preferably be a roller member made of an elastic material such as rubber or sponge. In place of such an elastic roller, a belt member or a brush member may also be used as the stripping member 12. The developer which is not moved onto the photosensitive drum 1 for development is once stripped off the surface of the developing sleeve by means of the stripping member 12, thus it functions to prevent the passive developer layer from being formed on the sleeve and to make the charging of the developer uniform.

When a feed roller 12 formed out of the elastic roller is used as the stripping member and when the surface is moved in the counter direction, the feed roller may preferably be rotated at a peripheral speed of from 20% to 120%, and more preferably from 30% to 100%, with respect to the peripheral speed of the developing sleeve 8 regarded as 100%.

If the feed roller 12 is rotated at a peripheral speed lower than 20%, the developer may be fed in an insufficient quantity, so that follow-up performance for solid images may lower to cause ghost images. If it is rotated at a peripheral speed higher than 120%, the developer may be fed in a large quantity, so that the developer layer thickness may be poorly regulated or the change quantity may be insufficient to cause fog. Moreover, the toner may be damaged to tend to cause fog or toner-melt adhesion due to deterioration of toner. When the feed roller is rotated in the same direction as the rotation of the developing sleeve, the feed roller may preferably be rotated at a peripheral speed of from 100% to 300%, and more preferably from 101% to 200%, with respect to the peripheral speed of the developing sleeve, in view of the above toner feed quantity.

In view of stripping performance and feed performance, the feed roller may more preferably be rotated in the counter direction of the surface movement of the developing sleeve.

The stripping member 12 may have a penetration (deformation under pressure) into the developing sleeve 8, of from 0.5 to 2.5 mm. This is preferable in view of the feed performance and stripping performance of the developer. If the stripping member 12 has a penetration less than 0.5 mm, ghost images tend to occur because of insufficient stripping. If it has a penetration more than 2.5 mm, the toner may be greatly damaged, so that the toner may deteriorate to tend to cause melt-adhesion or fog.

In the developing assembly shown in FIG. 1, an elastic regulating blade 11 comprised of a material having a rubber elasticity, such as urethane rubber or silicone rubber, or a material having a metal elasticity, such as bronze or stainless steel, is used as the developer layer-thickness regulating member to regulate the layer thickness of the nonmagnetic one-component developer 4 on the developing sleeve 8. In the developing assembly shown in FIG. 1, this elastic regulating blade 11 is brought into pressure contact with the developing sleeve 8 in a posture reverse to the latter's rotational direction, thus a thin developer layer can be formed on the developing sleeve 8.

This elastic regulating blade 11 may preferably have a structure wherein a polyamide elastomer (PAE) is stuck to the surface of a phosphor bronze plate, which can attain a stable pressure. Such a blade may preferably be used especially in order to stably regulate the layer thickness and stably impart triboelectric charges to the toner. The polyamide elastomer (PAE) may include, e.g., copolymers of polyamides with polyethers.

The developer layer-thickness regulating member 11 may come into contact with the developing sleeve 8 at a pressure of from 5 to 50 g/cm as a linear pressure. This is preferable in view of stable regulation of the developer and preferable developer layer thickness. If the developer layer-thickness regulating member 11 comes into contact at a linear pressure lower than 5 g/cm, the developer regulation force may be so weak as to cause fog or toner leak. If it comes into contact at a linear pressure higher than 50 g/cm, the toner may greatly be damaged to tend to cause deterioration of toner or melt-adhesion of toner to the sleeve and the blade.

The developer carrying member of the present invention is especially effective when used in such an apparatus in which the stripping member 12 and developer layer-thickness regulating member 11 come into pressure contact with the developing sleeve 8.

More specifically, when the stripping member 12 and developer layer-thickness regulating member 11 come into pressure contact with the developing sleeve 8, the developing sleeve 8 stands exposed to service environment where its surface tends to wear more or the developer tends to melt-adhere thereto because of these members coming into pressure contact, and hence the developer carrying member of the present invention, having the resin coat layer promising a superior many-sheet running operations performance, can be remarkably effective.

Figure 2:
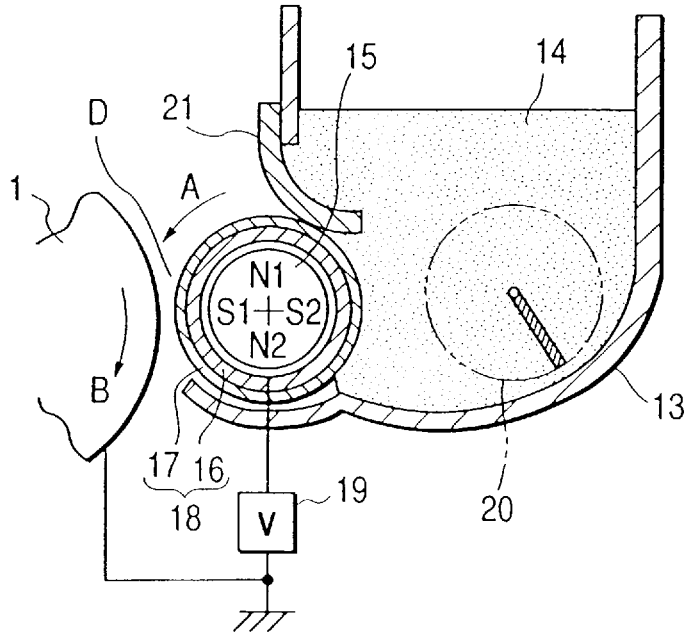
FIG. 2 is a diagrammatic view showing an example of a magnetic one-component developing system developing assembly having the developer carrying member of the present invention.

FIG. 2 diagrammatically illustrates an example of a developing assembly in which a magnetic, one-component developer is used.

As shown in FIG. 2, a latent image bearing member, e.g., an electrophotographic photosensitive drum 1, which bears an electrostatic latent image formed by a known process is rotated in the direction of an arrow B. A developing sleeve 18 as the developer carrying member is constituted of a cylindrical pipe (substrate) 6 made of metal, and a resin coat layer 17 formed on its surface. Inside a hopper 13 serving as a developer container, an agitating blade 20 for agitating the magnetic, one-component developer 14 is provided. The developing sleeve 18 carries a magnetic toner 14 as the magnetic one-component developer, fed from the hopper 13, and is rotated in the direction of an arrow A. Thus, the magnetic, one-component developer 14 is transported to the developing zone where the developing sleeve 18 and the photosensitive drum 1 face each other. Inside the developing sleeve 18, a magnet 15 is provided so that the magnetic, one-component developer 14 is magnetically attracted to and held on the developing sleeve 18. The magnetic, one-component developer 14 gains triboelectric charges capable of developing the electrostatic latent image on the photosensitive drum 1, as a result of its friction with the resin coat layer 17 on the developing sleeve 8.

In the developing assembly shown in FIG. 2, an elastic regulating blade 21 comprised of a material having a rubber elasticity, such as urethane rubber or silicone rubber, or a material having a metal elasticity, such as bronze or stainless steel, is used as the developer layer-thickness regulating member to regulate the layer thickness of the magnetic, one-component developer 14 on the developing sleeve 18. In the developing assembly shown in FIG. 2, this elastic regulating blade 21 is brought into pressure contact with the developing sleeve 8 in a posture reverse to the latter's rotational direction, thus a thin developer layer can be formed on the developing sleeve 18.

Figure 3:
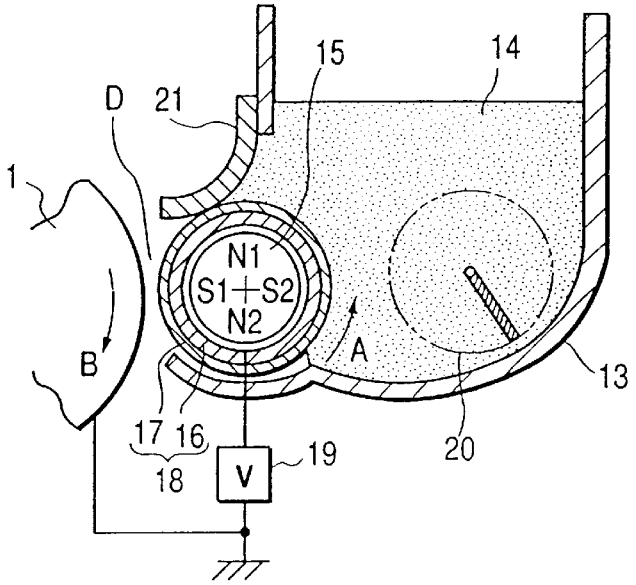
FIG. 3 is a diagrammatic view showing another example of a magnetic one-component developing system developing assembly having the developer carrying member of the present invention.

In a developing assembly shown in FIG. 3, as a different feature, the elastic regulating blade 21 is brought into pressure contact with the developing sleeve 18 in a posture of the same direction as the latter's rotational direction, thus a thin developer layer can be formed on the developing sleeve 18.

The thickness of the thin layer of the magnetic, one-component developer 14, thus formed on the developing sleeve 18, may preferably be smaller than the minimum gap D between the developing sleeve 18 and the photosensitive drum 1 in the developing zone. The present invention is especially effective when applied in a non-contact type developing assembly that develops the electrostatic latent image by forming such a developer layer. The present invention, however, may also be applied in a contact type developing assembly in which the thickness of the developer layer is larger than the minimum gap D between the developing sleeve 18 and the photosensitive drum 1 in the developing zone.

To avoid complicating the of description, the non-contact developing assembly is taken as an example in the following description.

In order to fly the one-component developer 14 having a magnetic toner, carried on the developing sleeve 18, a development bias voltage is applied to the developing sleeve 18 through a power source 19. When a DC voltage is used as the development bias voltage, a voltage having a value intermediate between the potential at electrostatic latent image areas (the region rendered visible upon attraction of the one-component developer 14) and the potential at back ground areas may preferably be applied to the developing sleeve 18. In order to enhance the density of developed images or improve the gradation thereof, an alternating bias voltage may be applied to the developing sleeve 18 to form in the developing zone a vibrating electric field whose direction alternately reverses. In such an instance, an alternating bias voltage formed by superimposing the above DC voltage component having a value intermediate between the potential at image areas to be developed and the potential at back ground areas may preferably be applied to the developing sleeve 18.

In the case of what is called regular development, where the developer is attracted to high-potential areas of an electrostatic latent image having high-potential areas and low-potential areas, a developer chargeable to a polarity reverse to the polarity of the electrostatic latent image is used. In the case of what is called reverse development, where the developer is attracted to low-potential areas of the electrostatic latent image, a developer chargeable to the same polarity as the polarity of the electrostatic latent image is used. The words "high-potential" and "low-potential" used herein mean absolute values. In either case, the magnetic, one-component developer 14 is charged upon its friction with the developing sleeve 18 to have the polarity for developing the electrostatic latent image.

The developing assembly described above may be used as an apparatus unit detachably mountable on the main body of an image forming apparatus.

Figure 4:
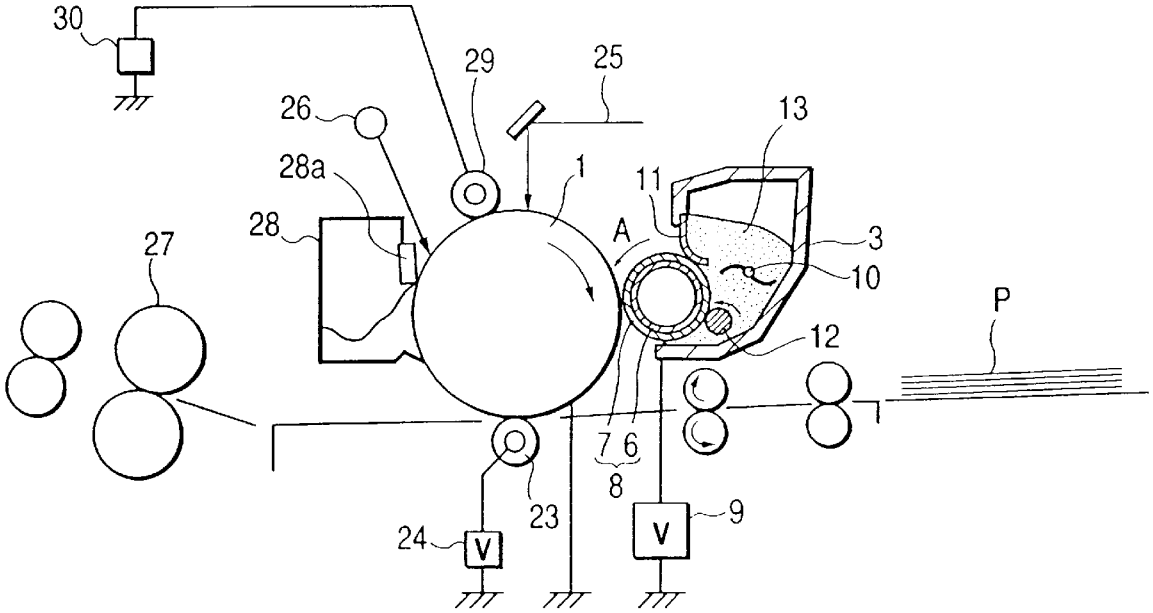
FIG. 4 is a diagrammatic view showing an image forming apparatus incorporated with an apparatus unit having the developer carrying member of the present invention.

An example of the image forming apparatus of the present invention which employs the developing assembly exemplified in FIG. 1, having the developer carrying member of the present invention, will be described below with reference to FIG. 4.

First, the surface of the photosensitive drum 1 as the electrostatic latent image bearing member is negatively charged by a contact (roller) charging means 29 as a primary charging means, and exposed to laser light 25 to form on the photosensitive drum 1 a digital latent image by image scanning. The digital latent image thus formed is developed by reversal development using the negatively-chargeable, one-component developer 4 having a non-magnetic toner, held in the hopper 3, and by means of the developing assembly having an elastic regulating blade 11 as the developer layer-thickness regulating member and equipped with the developing sleeve 8 as the developer carrying member. As shown in FIG. 4, in the developing zone, the conductive substrate of the photosensitive drum 1 is earthed, and an alternating bias, a pulse bias and/or a DC bias is/are applied to the developing sleeve 8 through a bias applying means 9. Then a recording medium P is fed and delivered to the transfer zone, where the recording medium P is electrostatically charged by a contact (roller) transfer means 23 serving as a transfer means on its back surface (the surface opposite to the photosensitive drum side) through a voltage applying means 24, so that the developed image formed on the surface of the photosensitive drum 1 is transferred to the recording medium P through the contact transfer means 23. Next, the recording medium P separated from the photosensitive drum 1 is subjected to fixing by using a heat-pressure roller fixing assembly 27 serving as a fixing means, in order to fix the developed image on the recording medium P by means of the fixing assembly 27.

The one-component developer 4 remaining on the photosensitive drum 1 after the step of transfer is removed by a cleaning means 28 having a cleaning blade 28*a*. When the remaining one-component developer 4 is in a small quantity, the cleaning step may be omitted. After the cleaning, the residual charge on the surface of the photosensitive drum 1 is optionally eliminated by erase exposure 26, and thus the procedure again starting from the charging step using the primary charging assembly 29 is repeated.

In a series of the above steps, the photosensitive drum (i.e., the electrostatic latent image bearing member) 1 comprises a photosensitive layer and a conductive substrate, and is rotated in the direction of an arrow. In the developing zone, the developing sleeve 8 formed of a non-magnetic cylinder, which is the developer carrying member, is so rotated as to move forward in the same direction as the surface movement of the photosensitive drum 1. A feed roller 12 comes into contact with the surface of the developing sleeve 8, and is so rotated that its surface moves in the direction reverse to the direction of surface movement of the developing sleeve 8. With the rotation of this feed roller 12, the one-component developer 4 held in the hopper 3 is applied and carried on the surface of the developing sleeve 8, and, e.g., negative triboelectric charges are imparted to the magnetic toner as a result of the friction between its toner particles and the surface of the developing sleeve 8 and/or between particles of the magnetic toner. An elastic regulating blade 11 is also disposed so as to elastically press the developing sleeve 8. Thus, the thickness of developer layer is regulated to be small (30 $\mu$m to 300 $\mu$m) and uniform so that a developer layer with a thickness smaller than the gap D between the photosensitive drum 1 and the developing sleeve 8 in the developing zone is formed. The rotational speed of this developing sleeve 8 is adjusted so that the peripheral speed of the developing sleeve 8 can be substantially equal or close to the peripheral speed of the photosensitive drum 1. In the developing zone, an AC bias or a pulse bias may be applied as development bias voltage, to the developing sleeve 8 through a bias-applying means 9. This AC bias may have a frequency (f) of 200 to 4,000 Hz and a peak-to-peak voltage (Vpp) of 500 to 3,000 V.

When the developer is moved in the developing zone, the developer moves to the side of the electrostatic latent image by the electrostatic force of the surface of the photosensitive drum 1 and the action of the development bias voltage such as AC bias or pulse bias.

As the primary charging means, the charging roller 29 is used as the contact charging means in the above description.

It may also be a contact charging means such as a charging blade or a charging brush. It may still also be a non-contact, corona charging means. However, the contact charging means is preferred in view of less ozone caused by charging.

As the transfer means, a contact charging means such as the transfer roller 23 is used in the above description. It may also be a non-contact, corona transfer means. However, also in this means, the contact transfer means is preferred in view of less ozone caused by charging.

In the present invention, the apparatus unit is set detachably on the main body of the image forming apparatus (e.g., a copying machine, a laser beam printer and a facsimile machine). The apparatus unit may also have as one unit, in addition to any of the developing assembles shown in FIGS. 1 to 3, at least one constituent members selected from the group consisting of the drum type electrostatic latent image bearing member 1, the cleaning means 28 having a cleaning blade 28*a* and the contact (roller) charging means 29 as a primary charging means.

Figure 5:
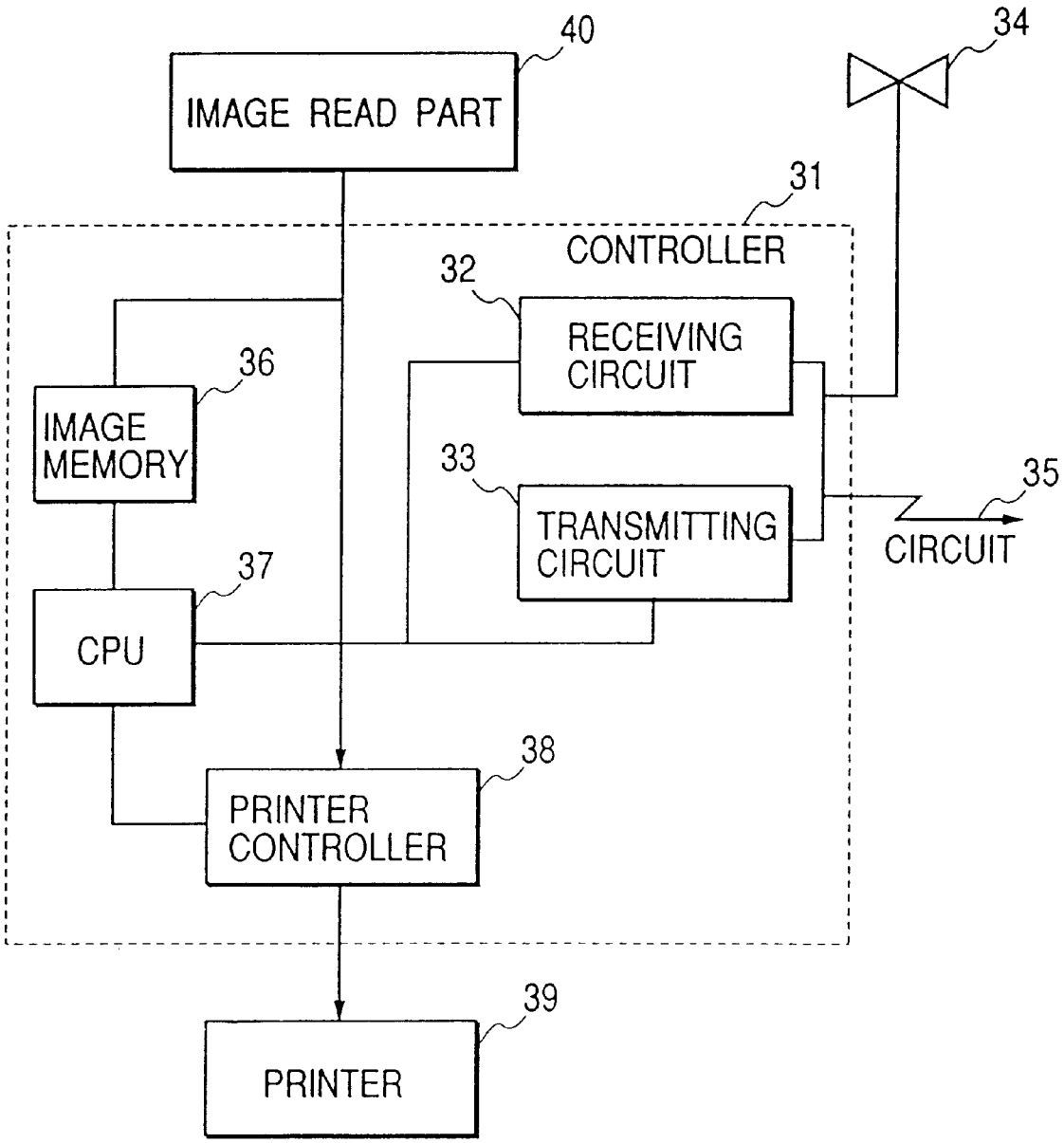
FIG. 5 is a block diagram of an instance where the image forming apparatus of the present invention is used in a printer of a facsimile transmission system.

When the image forming apparatus of the present invention is used as a printer of a facsimile machine, the photoimagewise exposing light L serves as exposing light used for the printing of received data. FIG. 5 illustrates an example thereof in the form of a block diagram.

A controller 31 controls an image reading part 40 and a printer 39. The whole of the controller 31 is controlled by CPU 37. Image data outputted from the image reading part are sent to the other facsimile station through a transmitting circuit 33. Data received from the other station is sent to a printer 39 through a receiving circuit 32. Stated image data are stored in an image memory 36. A printer controller 38 controls the printer 39. The numeral 34 denotes a telephone.

Images received from a circuit 35 (image information from a remote terminal connected through the circuit) are demodulated in the receiving circuit 32, and then successively stored in an image memory 36 after the image information is decoded by the CPU 37. Then, when images for at least one page have been stored in the memory 36, the image recording for that page is performed. The CPU 37 reads out the image information for one page from the memory 36 and sends the coded image information for one page to the printer controller 38. The printer controller 38, having received the image information for one page from the CPU 37, controls the printer 39 so that the image information for one page is recorded.

The CPU 37 receives image information for the next page in the course of the recording by the printer 39.

Images are received and recorded in the manner as described above.

The developer having a toner, used in the present invention will be described below.

The toner is a fine powder obtained by melt-kneading materials such as chiefly a binder resin, a release agent, a charge control agent and a colorant, and cooling the kneaded product to solidify, followed by pulverization and further followed by classification to make particle size distribution uniform.

As the binder resin used in the toner, commonly known resins may be used. They may include, e.g., homopolymers of styrene or styrene derivatives such as polystyrene, poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. Preferred binder resins are styrene copolymers or polyester resins.

As comonomers copolymerizable with styrene monomers in the styrene copolymers, any of vinyl monomers may be used alone or in combination. The vinyl monomers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; ethylenic olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether.

The styrene polymers or styrene copolymers may be cross-linked or may be in the form of mixed resins. As a cross-linking agent of the binder resin, compounds having at least two polymerizable double bonds may be chiefly used. For example, they include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups; any of which may be used alone or in the form of a mixture.

In the toner, a pigment may be contained as a colorant. Such a pigment may include, e.g., carbon black, Nigrosine dyes, lamp black, Sudan Black SM, Fast Yellow G, Benzidine Yellow, Pigment Yellow, Indian First Orange, Irgazine Red, Para Nitraniline Red, Toluidine Red, Carmine 6B, Permanent Bordeaux F3R, Pigment Orange R, Lithol Red 2G, Lake Red C, Rhodamine FB, Rhodamine B Lake, Methyl Violet B lake, Phthalocyanine Blue, Pigment Blue, Brilliant Green B, Phthalocyanine Green, Oil Yellow GG, Zapon First Yellow CGG, Kayaset Y963, Kayaset YG, Zapon First Orange RR, Oil Scarlet, Aurazole Brown B, Zapon First Scarlet CG, and Oil Pink OP, any of which may be used.

When the toner is used as a magnetic toner, the toner is incorporated with a magnetic powder. As the magnetic powder, materials capable of being magnetized when placed in a magnetic field are used, which include, e.g., powders of ferromagnetic metals, such as iron, cobalt and nickel; alloys or mixtures of any of these ferromagnetic metals with other metal, such as aluminum, cobalt, copper, lead, magnesium, tin, zinc, antimony, beryllium, bismuth, calcium, manganese, selenium, titanium, tungsten or vanadium; iron oxides such as magnetite, hematite and ferrite; and magnetic iron oxides the particle surfaces or insides of which contain oxides of metal ions, such as silicon ions, aluminum ions or magnesium ions, hydrated oxides of such metal ions or hydroxides of such metal ions. This magnetic powder may be contained in an amount of from 15 to 70% by weight based on the weight of the toner.

For the purposes of improving releasability and fixing performance at the time of fixing, the toner may be incorporated with a wax. Such a wax may include paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives include oxides, block copolymers with vinyl monomers, and graft modified products. Besides, alcohols, fatty acids, acid amides, esters, ketones, hardened caster oil and derivatives thereof, vegetable waxes, animal waxes, mineral waxes or petrolatum may be used.

In the toner of the present invention, a charge control agent may optionally be used. The charge control agent includes negative charge control agents and positive charge control agents. For example, as those capable of controlling the toner to be negatively chargeable, organic metal complexes or chelate compounds are effective. For example, they may include monoazo metal complexes, acetylacetone metal complexes, metal complexes of aromatic hydroxycarboxylic acids, and metal complexes of aromatic dicarboxylic acids. Besides, they may include aromatic hydroxycarboxylic acids, aromatic mono- or polycarboxylic acids and metal salts, anhydrides or esters thereof, and phenol derivatives such as bisphenol.

The toner used in the present invention may be not only a toner produced by the pulverization process previously described but also a toner part or the whole of which is produced by a polymerization process described below. Either may be used.

When polymerization is used to produce the toner, the toner can be specifically produced in the following way. To polymerizable monomers, a release agent of a low-softening substance, a colorant, a charge control agent, a polymerization initiator and other additives are added to prepare a monomer composition which is uniformly dissolved or dispersed by means of a homogenizer, an ultrasonic dispersion machine or the like, and dispersed in an aqueous phase containing a dispersion stabilizer by means of a conventional stirrer, homomixer or homogenizer. Then, granulation is carried out preferably while controlling the agitation speed and time so that droplets comprised of the monomer composition can have the desired toner particle size. After the granulation, agitation may be carried out to such an extent that the state of particles is maintained and the particles can be prevented from settling by the action of the dispersion stabilizer, where the polymerization may be carried out at a polymerization temperature set at 40° C. or above, usually from 50 to 90° C. At the latter half of the polymerization, the temperature may be raised, and also the aqueous medium may be removed in part from the reaction system at the latter half of the reaction or after the reaction has been completed, in order to remove unreacted polymerizable monomers, by-products and so forth so that the running performance can be improved in the image formation. After the reaction has been completed, the toner particles formed are collected by washing and filtration, followed by drying. In such suspension polymerization, water may usually be used as the dispersion medium preferably in an amount of from 300 to 3,000 parts by weight based on 100 parts by weight of the monomer composition.

The release agent may preferably be contained in the toner in an amount of from 0.1 to 50% by weight, and more preferably from 0.5 to 30% by weight.

If the release agent is in a content less than 0.1% by weight, the addition of the release agent can be less effective for imparting the releasability from fixing members. If it is in a content more than 50% by weight, the release agent may be present on the toner particle surfaces in a large quantity to undesirably tend to contaminate the surface of the developer carrying member.

In the present invention, the toner produced by polymerization may contain an additional resin in addition to the resin synthesized by polymerizing the above polymerizable monomers.

The toner further containing such an additional resin can be produced by adding this additional resin together with at least a polymerizable monomer and a colorant in the course of the production of toner particles by polymerization to prepare a polymerizable monomer composition, and polymerizing the polymerizable monomer composition thus prepared.

For example, when introducing into toner particles a polymerizable monomer component containing a hydrophilic functional group such as an amino group, a carboxylic acid group, a hydroxyl group, a sulfonic acid group, a glycidyl group or a nitrile group that cannot be used because it is water-soluble and hence dissolves in an aqueous suspension to cause emulsion polymerization, such a monomer can be made usable by bringing it into a copolymer such as a random copolymer, block copolymer or graft copolymer of any of these with a vinyl compound such as styrene or ethylene, a polycondensation product such as polyester or polyamide, or a polyaddition product such as polyether or polyimine. Making such a polar-group-containing high polymer coexist in the toner is a preferred embodiment because wax as the above release agent can be phase-separated at the time of the polymerization of the polymerizable monomer composition in an aqueous medium and can be more firmly encapsulated into toner particles to bring about an improvement in the performances of toner.

This polar-group-containing high polymer may preferably be contained in an amount of from 1 to 20% by weight, and more preferably from 2 to 16% by weight, based on the weight of the toner.

If this polar-group-containing high polymer is in a content less than 1% by weight, the wax as the release agent thus encapsulated is too small in quantity to come out to the toner particle surfaces and to exhibit the release effect. If it is in a content more than 20% by weight, the wax as the release agent is difficult to encapsulate into toner particles, resulting in early contamination of the developer carrying member surface.

The developer carrying member of the present invention is preferred especially when the toner produced by the above polymerization process is used.

More specifically, the toner produced by polymerization has spherical particles, and hence has a superior transfer performance. Also, the wax or the like can be encapsulated in the toner particles, and hence the toner can have superior fixing performance and anti-offset properties. Moreover, the toner particles have a uniform shape, and hence the toner can be uniformly triboelectrically charged, compared with toner particles produced by pulverization. Since, however, they are spherical, they tend to slip. Also, since they have a smaller surface area than those particles produced by pulverization, the rise of triboelectric charging may be so slow that toner may be difficult to carry and transport on the sleeve. In this regard, the use of the developer carrying member of the present invention can make the rise of triboelectric charging quick and also uniform, so that the developer carrying member can be improved in carrying performance and a satisfactory developing performance can be achieved. Also, for the reason concerning the shape of particles, the pulverization toner tends to have a broader triboelectric charge distribution, and hence the polymerization toner can achieve a higher halftone uniformity.

For the purpose of improving fluidity, powder such as a fine powder may optionally be added to the toner to be used. As the fine powder, an inorganic fine powder may preferably be used. Such an inorganic fine powder may include, e.g., fine silica powder, and powders of metal oxides such as alumina, titania, germanium oxide and zirconium oxide; carbides, such as silicon carbide and titanium carbide; and nitrides, such as silicon nitride and germanium nitride.

These inorganic fine powders may be used after their organic treatment with an organic treating agent such as an organic silicone compound or a titanium coupling agent. For example, the organic silicone compound may include silane coupling agents such as hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triornanosilyl mercaptan, trimethylsilyl mercaptan, triornanosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals.

The inorganic fine powder may be treated with the above silane coupling agent by a method including, e.g., spraying, organic solvent treatment and aqueous solution treatment. The treatment by spraying is commonly carried out by a method in which a pigment (the inorganic fine powder) is agitated and an aqueous solution or solvent solution of the coupling agent is sprayed on the pigment being agitated, followed by drying at about 120 to 130° C. to remove the water or solvent. The organic solvent treatment is a method in which the coupling agent is dissolved in an organic solvent (e.g., alcohol, benzene, halogenated hydrocarbons) containing a hydrolysis catalyst together with a small quantity of water, and the pigment is immersed in the resultant solution, followed by filtration or pressing to effect solid-liquid separation and then drying at about 120 to 130° C. The aqueous solution treatment is carried out by a method in which about 0.5% of the coupling agent is hydrolyzed in water or in a water-solvent mixture with a stated pH and the pigment is immersed in the resultant hydrolyzate, followed by solid-liquid separation and then drying.

As other organic treatment, it is also possible to use a fine powder treated with silicone oil. The silicone oil may include those represented by the following Formula (3):

(3)

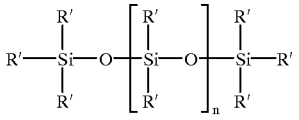

wherein R's each represent an alkyl group (e.g., a methyl group) or an aryl group, and n represents an integer.

As a preferred silicone oil, a silicone oil having a viscosity at 25° C. of from about 0.5 to 10,000 $mm^2/s$, and preferably from 1 to 1,000 $mm^2/s$, may be used, which may include, e.g., methylhydrogensilicone oil, dimethylsilicone oil, phenylmethylsilicone oil, chlorophenylmethylsilicone oil, alkyl-modified silicone oil, fatty-acid-modified silicone oil, polyoxyalkylene-modified silicone oil and fluorine-modified silicone oil.

The treatment with silicone oil may be carried out, e.g., in the following way. The pigment is vigorously kept agitated optionally with heating, and the above silicone oil or its solution is vaporized and sprayed, or the pigment is made into a slurry and the above silicone oil or its solution is dropwise added while stirring the slurry, whereby the treatment can be made with ease.

Any of these silicone oils may be used alone or in combination, or for multiple treatment. The silicone oil may also be used in combination with the silane coupling agent.

In the present invention, the toner particles may preferably have a weight-average particle diameter (D4) of from 3 to 12 μm, and more preferably from 3 to 8 μm, in view of achievement of both the high image density and the image quality.

If the toner particles have a weight-average particle diameter smaller than 3 μm, problems such as toner scatter and fog may arise, and if larger than 12 μm, the reproducibility of minute dots may lower or the toner may scatter at the time of transfer to hinder the achievement of high image quality.

As particle size distribution of the toner particles, toner particles with diameters of 4 μm or smaller may be in a content of 30% by number or less, and preferably from 5 to 20% by number; and toner particles with diameters of 10.1 μm or larger in a content of 15% by volume or less, and preferably from 0.1 to 10% by volume. This is preferable because the toner can be uniformly charged.

If the toner particles with diameters of 4 μm or smaller are in a content more than 30% by number, fog tends to occur. If the toner particles with diameters of 10.1 μm or larger is in a content more than 10% by volume, toner scatter tends to occur.

In the present invention, the weight-average particle diameter (D4) of toner particles, the percent by number of toner particles with diameters of 4 μm or smaller and the percent by volume of toner particles with diameters of 10.1 μm or larger are measured in the following way.

The average particle diameter and particle size distribution of the toner particles may be measured with Coulter Counter TA-II or Coulter Multisizer II (manufactured by Coulter Electronics, Inc.). In the present invention, they are measured using Coulter Counter Multisizer II (manufactured by Coulter Electronics, Inc.). An interface (manufactured by Nikkaki K.K.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used. Measurement is made by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with particle diameters of 2 μm or larger by means of the above Coulter Multisizer, using an aperture of 100 μm as its aperture. Then the weight-based (the middle value of each channel is used as the representative value for each channel), weight average particle diameter (D4) according to the present invention, determined from volume distribution, the percent by number of toner particles with diameters of 4 μm or smaller determined from number distribution and the percent by volume of toner particles with diameters of 10.1 μm or larger determined from volume distribution are determined.

According to the present invention, the developer on the developer carrying member can have stable and proper electric charges even in repeated image reproduction and can form uniform and even high-grade images without causing a decrease in image density or causing ghost. In particular, highly minute high-grade images can be formed because of an improved charging performance or developing performance even when toners having a small particle diameter and making use of a low-temperature fixing material are used for the purposes of high image quality and energy saving. Moreover, stable images can be formed for a long term by ensuring wear resistance of the resin coat layer and forming a much more uniform resin layer.

The present invention is described below in more detail with reference to examples. The term "parts" is based on weight in Examples and Comparative Examples unless otherwise specified.

EXAMPLE 1

A coating liquid was prepared by mixing the materials in the mixing ratio below.

| | |
|---|---|
| Methyl methacrylate-dimethylaminoethyl methacrylate copolymer A (molar ratio 90:10, Mw = 10,200, Mn = 4,500, Mw/Mn = 2.3) | 100 parts |
| Crystalline graphite (number-average particle diameter: 3 μm) | 25 parts |
| Toluene | 375 parts |

In mixing the materials, the methyl methacrylate-dimethylaminoethyl methacrylate copolymer A was preliminarily dissolved in a part of the toluene, and the crystalline graphite was dispersed therein together with glass beads by means of a sand mill. Thereto the rest of the toluene was added to adjust the solid matter content to 25%. After the dispersion, the glass beads were separated from the liquid mixture. The mixture without the glass beads had a viscosity of 55 mPa.s at room temperature. This coating liquid was applied on a sleeve. In the coating operation, an aluminum cylindrical bar of 16 mm outside diameter flanged at both ends was erected and rotated on a turntable, and the coating liquid was applied onto the surface of the bar by a spray gun descending at a constant speed with both ends of the sleeve masked, coating the sleeve in a uniform coating thickness. The coated layer was dried and solidified at 160° C. for 30 minutes in a drying furnace. The resulting coated article is referred to as Sleeve A. The amount of the coating after the drying was 9000 mg/$M^2$. The center-line average roughness Ra was 0.48 μm.

Separately, another cylindrical bar was wound around with an OHP sheet and with an aluminum sheet, and was coated in the same manner as above. These sheets were used for measurement of the specific volume resistance: the OHP sheet for resistance measurement, and the aluminum sheet for thickness measurement, of the coating film. The specific volume resistance was 56.8 Ω.cm by measurement with Low-Rester AP (manufactured by Mitsubishi Petrochemical Co.) with a four-terminal probe. Higher volume resistance was measured by High-Rester (manufactured by the same company).

This Sleeve A was employed for printing with a modification of an image forming machine LBP-2030 (manufactured by CANON INC.) as shown in FIG. 3. This Sleeve A was mounted on an EP-H cartridge modified for fitting of this sleeve. A 3000-sheet running test was conducted in a single color with a cyan toner with this machine. FIG. 1 shows schematically the periphery of the sleeve of the EP-H cartridge.

In the cartridge, the elastic control blade was made of phosphor bronze laminated with PAE. This elastic blade was brought into pressure contact with the development sleeve at a contact pressure of 20 g/cm. The feed roller employed was a cylindrical polyurethane foam having a metal core, and was brought into pressure contact with the development sleeve at a squeezing distance (or penetration) of 1.5 mm. The feed roller was rotated at a peripheral speed of 60% relative to that of the development sleeve taken as 100% in a direction counter to the movement of the development sleeve to feed a developer to the surface of the development sleeve and to strip the developer therefrom. The thickness of the developer layer formed on the development sleeve was about 150 μm. The minimum gap D between the photosensitive drum surface and the development sleeve surface was 300 μm with the developer layer being in no contact with the photosensitive drum. In the development, a development bias voltage of $V_{p-p}$=2000 (V), frequency f=2000 (Hz), and $V_{DC}$=−300 (V) was applied to the development sleeve. The drum potential was $V_D$=600 (V) and $V_L$=150 (V).

In the evaluation test, the toner used was composed of the materials below:

| | |
|---|---|
| Polyester resin | 100 parts |
| Phthalocyanine pigment | 6 parts |
| Negative charge controller | 1 part |
| Ester type wax | 3 parts |

A master batch was prepared from the phthalocyanine pigment and part of the polyester resin. The master batch and the rest of the above materials were mixed by a Henschel mixer, and blended by a twin-screw extruder. The mixture, after cooling, was crushed by a hammer mill, and pulverized by a turbo-mill to give a fine pulverized matter. The pulverized matter was classified by an elbow jet classifying machine to give a classified matter (toner particles) having a weight-average particle diameter $D_4$ of 6.58 μm, containing particles of not larger than 4.0 μm in a content of 17.5% by number and particle of not smaller than 10.1 μm in a content of 1.2% by weight. To 100 parts of this classified matter, 1.5 parts by weight of colloidal silica was externally added, obtaining a toner. This toner is referred to as "One-Component Developer 1".

The image printing test was conducted in a low-humidity environment of 23° C./5% RH, and a high-humidity environment of 30° C./80% RH. Table 2 shows the evaluation results.

Evaluation Method

Evaluations were made on such test items as below.

(1) Image Density (5 mm Square Density, and Solid Density)

Reflection density is measured for 5 mm square black-prints and black solid-printed areas at 10 positions using a reflectodensitiometer RD918 (manufactured by MacBeth Co.), and the measured densities at the 10 points are averaged.

(2) Electric Charge Quantity of Toner (Q/M)

The toner carried on the development sleeve is collected by sucking it through a metallic cylindrical tube and a cylindrical filter. The electric charge per unit weight Q/M (mC/kg) is calculated from the electric charge quantity Q accumulated in a condenser from the metallic cylindrical tube and the toner weight M.

(3) Fogging (Paper Fogging)

Reflectance of solid white image is measured. Separately, reflectance of an unprinted transfer paper sheet was measured. The fogging density is represented by the difference between "the minimum reflectance of a white solid image" and "the maximum reflectance of an unprinted transfer paper sheet", each of the reflectance values being measured at randomly selected 10 spots. The reflectance is measured by TC-6DS (manufactured by Tokyo Denshoku K.K.). The evaluation standards are as below. 1.5 or less: little fogging, 1.5 to 2.5: fogging detectable only with careful examination, 2.5 to 3.5: fogging detectable more readily, 4.0: fogging recognized at a glance and being at a lower limit for practical use, and 5.0 or more: fogging remarkable.

(4) Fogging on Drum (Drum Fogging)

In the white solid image printing, the toner carried on the drum before the printing is recovered by a Mylar adhesion tape. The Mylar adhesion tape is allowed to stick onto a white paper sheet, and reflection density of the tape is measured. The fogging density is represented by the difference of the above reflection density from that of the Mylar adhesion tape without the toner stuck on the white paper sheet. The same TC-6DS as above is employed for the measurement.

(5) Solid White Stripe and White Band (White Band)

Occurrence of a white stripe-like or a white band-like low density portion in the recording paper sheet delivery direction is examined. They are caused by insufficient toner charging resulting in nonuniform development, or by sticking or fusion of the toner. The evaluation standards are as below.

A: Not detected at all,

B: Detectable with transmitted light,

C: Slightly observed in a usual solid-printed image, but little difference in density present in an image, D: Observed, but hardly observed in a photographic image, E: Clearly observed in a usual solid-printed image, and even in a halftone portion of a photograph, F: Remarkable difference in density present in an image.

(6) Toner Scattering (Scattering)

The state of toner scattering is evaluated according to the evaluation standards below.

A: Little toner scattered around cartridge sleeve,

B: A small amount of toner adhering to stage portion under cartridge sleeve,

C: The above toner adhesion (soiling) observed slightly, but not observed in the main body, D: The above soiling observed, and slight soiling also observed slightly in the main body, E: Toner scattering observed in the main body, but no scaling-off of toner from sleeve observed, F: Non-coated portion found on sleeve, and toner accumulating on stage under sleeve and falling out therefrom, G: Scaling-off of toner from sleeve being remarkable.

(7) Scraping of Coating Layer (Film Scraping)

The outside diameters of the sleeve (cylindrical aluminum bar) before and after the coating treatment (including the resin layer) are measured with a laser length-measuring machine (average diameter at 10 positions). The outside diameter (including the resin layer) after the printing running test is measured in the same manner. The difference between "the outside diameter (including resin layer) before the running test" and "the outside diameter (including resin layer) after the running test is regarded as the scraping of the coating layer, and represented by a unit of $\mu$m.

EXAMPLES 2 TO 6

Sleeves B, C, D, E, and F were produced and evaluated respectively in the same manner as in Example 1 except that Copolymer B, C, D, E, or F constituted of methyl methacrylate and dimethylaminomethyl methacrylate in a different molar ratio was used in place of Copolymer A. Table 1 shows the properties. Table 2 shows the evaluation results.

COMPARATIVE EXAMPLES 1 AND 2

Sleeve G was produced, in Comparative Example 1, by use of Homopolymer G of methyl methacrylate, and Sleeve H was produced, in Comparative Example 2, by use of Copolymer H constituted of a higher molar ratio of dimethylaminoethyl methacrylate as shown in Table 1. Table 4 shows the evaluation results. In Comparative Example 1, defects were caused by the insufficient toner charge, and slightly poorer dispersion of the fine particulate graphite. In Comparative Example 2, toner sticking on the sleeve was remarkable, and the film strength was slightly lower.

EXAMPLES 7 TO 10

Sleeves I, J, K, and L were produced and evaluated respectively in the same manner as in Example 1 except that Copolymer I, J, K, or L having different molecular weight was used in place of Copolymer A used in Example 1. Table 1 shows the properties. Table 2 shows the evaluation results.

COMPARATIVE EXAMPLES 3 AND 4

Sleeves M and N were produced and evaluated in the same manner as in Example 1 except that Copolymer M having a lower weight-average molecular weight was used in Comparative Example 3 and Copolymer N having a higher weight-average molecular weight was used in Comparative Example 4 in place of Copolymer A in comparison with Copolymer A in Example 1. Table 1 shows the properties. Table 4 shows the evaluation results.

EXAMPLE 11

Sleeve O was produced and evaluated in the same manner as in Example 1 except that carbon black only was added and the crystalline graphite was not used. Table 1 shows the properties. Table 3 shows the evaluation results.

EXAMPLE 12

Sleeve P was produced and evaluated in the same manner as in Example 1 except that Copolymer O of Mw/Mn of 3.8 containing a larger amount of low molecular weight component was used in place of Copolymer A used in Example 1. Table 1 shows the properties. Table 3 shows the evaluation results.

EXAMPLE 13

Sleeve Q was produced and evaluated in the same manner as in Example 1 by use of Copolymer A except that carbon black was used in addition to the crystalline graphite. Table 1 shows the properties. Table 3 shows the evaluation results.

EXAMPLES 14 TO 17

Sleeves R, S, T, and U were produced and evaluated in the same manner as in Example 1 except that the amount of addition of the crystalline graphite was changed. Table 1 shows the properties, and Table 3 shows the evaluation results.

EXAMPLES 18 TO 20

Copolymers P, Q, and R were prepared respectively in the same manner as Copolymer A by copolymerizing methyl methacrylate with diethylaminoethyl methacrylate, dibutylaminoethyl methacrylate, and dimethyl styrene in place of dimethylaminoethyl methacrylate used in Example 1. Sleeves V, W, and X were produced and evaluated in the same manner as in Example 1 except that Copolymer P, Q, and R were used, respectively, in place of Copolymer A. Table 1 shows the properties. Table 3 shows the evaluation results.

COMPARATIVE EXAMPLE 5

Copolymer S was prepared in the same manner as in Copolymer A except that styrene was used in place of methyl methacrylate as the main monomer. Sleeve Y was produced in the same manner as in Example 1 except that Copolymer S was used in place of Copolymer A used in Example 1. Table 1 shows the properties. Table 4 shows the evaluation results. The film scraping was remarkable, which lowered the picture image quality.

COMPARATIVE EXAMPLE 6

A coating liquid was prepared by mixing the materials in the mixing ratio below.

| | |
|---|---|
| Phenol resin intermediate | 100 parts |
| Crystalline graphite (number-average particle diameter: 3 $\mu$m) | 25 parts |
| Methanol | 250 parts |

Sleeve Z was produced and evaluated in the same manner as in Example 1 except that the above phenol resin type coating liquid was used, and the drying and solidification were conducted at 150° C. for 30 minutes. Table 1 shows the properties. Table 4 shows the evaluation results.

COMPARATIVE EXAMPLE 7

The same cylindrical aluminum bar as that used in Example 1 was subjected to sand-blast treatment of the surface with glass beads (FGB#300). Sleeve ZZ was produced and evaluated in the same manner as in Example 1 by use of this aluminum bar. Table 1 shows the properties. Table 4 shows the evaluation results.

EXAMPLE 21

To 400 parts by weight of deionized water, was added 225 parts by weight of aqueous 0.1M $Na_3PO_4$ solution. The mixture was heated to 60° C., and stirred at a rate of 12,000 rpm by a TK Homomixer (manufactured by Tokushu Kika Kogyo K.K.). Thereto, 35 parts by weight of aqueous 1.0M $CaCl_2$ solution was added gradually to obtain an aqueous medium containing $Ca_3(PO_4)_2$.

The composition shown below was heated to 60° C., and was stirred at a rate of 12,000 rpm by a TK Homomixer (manufactured by Tokushu Kika Kogyo K.K.) for dissolution and uniform dispersion. Thereto, 5 parts by weight of 2,2'-azobis(2,4-dimethylvaleronitrile) as the polymerization initiator to prepare a polymerizable monomer composition.

| | | |
|---|---|---|
| (Monomers) | Styrene | 85 parts |
| | n-Butyl acrylate | 15 parts |
| (Colorant) | Carbon black | 7.5 parts |
| (Charge controller) | Salicylic acid-metal compound | 2.5 parts |
| (Polar resin) | Saturated polyester resin (acid value: 14, peak molecular weight: 8,000) | 5 parts |
| (Releasing agent) | Paraffin wax (mp: 60° C.) | 15 parts |

This polymerizable monomer composition was added to the above aqueous medium, and the mixture was stirred at 60° C. under a nitrogen atmosphere for 20 minutes at a rate of 10,000 rpm by a TK Homomixer to form a particle dispersion of the polymerizable monomer composition. This dispersion was heated to 80° C. with stirring by means of a paddle mixer, and was allowed to polymerize at this temperature with stirring for 10 hours to give a colored particle suspension. After the polymerization, the remaining monomer was distilled off under reduced pressure. After cooling, hydrochloric acid was added to dissolve the calcium phosphate. The polymerization product was collected by filtration, washed with water, and dried to obtain colored particles (toner) having sharp particle size distribution (weight-average particle diameter: 7.1 $\mu$m, 4.0 $\mu$m or smaller particle content: 15.3% in number, 10.1 $\mu$m or larger particle content: 2.0% by volume). To 100 parts of the obtained colored particles, 1.3 parts by weight of hydrophobic silica having a BET specific surface area of 200 $m^2/g$ was added externally, obtaining a toner. This toner is referred to as One-Component Developer 2".

The evaluation was made in the same manner as in Example 1 by use of the above one-component developer in place of the one-component developer used in Example 1. In comparison with Example 1, the fogging on the drum and on the paper sheet was less, and the halftone image was uniform. The reason is considered to be that the spherical toner particles are uniformly charged due to their uniformity, as compared with the pulverized toner.

COMPARATIVE EXAMPLE 8

With the above toner and the sleeve used in Comparative Example 1, evaluation was made in the same manner as in Comparative Example 1. As the results, the initial image density was as low as 1.0 or less, and with progress of the continuous printing test, the uncontrolled toner came to overflow onto the sleeve. This shows that the toner was not sufficiently charged.

EXAMPLE 22

A coating liquid was prepared by mixing the materials in the mixing ratio as given below.

| | |
|---|---|
| Methyl methacrylate-dimethylaminoethyl methacrylate copolymer a (molar ratio = 90:10, Mw = 11,300, Mn = 4,900, Mw/Mn = 2.3) | 100 parts |
| Crystalline graphite (number-average particle diameter: 10 μm) | 36 parts |
| Carbon black (number-average particle diameter: 0.08 μm) | 4 parts |
| Toluene | 360 parts |

In mixing the materials, Methyl Methacrylate-Dimethylaminoethyl Methacrylate Copolymer a was preliminarily dissolved in a part of the toluene, and the crystalline graphite and the carbon black were dispersed therein with glass beads by means of a sand mill. The rest of the toluene was added thereto to adjust the solid matter content to 25%. After the dispersion, the glass beads were separated from the liquid mixture. The mixture without the glass beads had a viscosity of 70 mPa.s at room temperature. This coating liquid was applied on a sleeve. In the coating operation, an aluminum cylindrical tube of 12 mm outside diameter was erected and rotated on a turntable, and the coating liquid was applied on the surface of the cylindrical tube by a spray gun descending at a constant rate with the both ends of the sleeve masked to coat the sleeve in a uniform coating thickness. The coated layer was dried and solidified at 160° C. for 30 minutes in a drying furnace to obtain a sleeve. The resulting coated sleeve is referred to as Sleeve a. The amount of the coating after the drying was 8500 mg/$M^2$. The center-line average surface roughness Ra was 0.98 μm.

Separately, another cylindrical tube was wound with an OHP sheet and an aluminum sheet, and was coated in the same manner as above. These sheets were used for measurement of specific volume resistance. The specific volume resistance was 25.6 Ω.cm.

This Sleeve a was employed for image printing with a modification of an image forming machine LBP-404GII (manufactured by CANON INC.) as shown in FIG. 3. This Sleeve a was mounted on an EP-P cartridge modified for fitting of this sleeve. A 4000-sheet running test was conducted with a low-temperature fixation toner (capable of fixation at a process speed of 24 mm/second at 110° C.) with this machine. FIG. 2 shows schematically the periphery of the sleeve of the EP-P cartridge.

In the cartridge, a urethane rubber blade as the elastic control blade was brought into pressure contact with the development sleeve at a line pressure of 22 g/cm. The thickness of the developer layer formed on the development sleeve was about 150 μm. The minimum gap D between the photosensitive drum surface and the development sleeve surface was kept at 250 μm without contact of the developer layer with the photosensitive drum. In the development, a development bias voltage of $V_{p-p}$=1200 (V), frequency f=1800 (Hz), and $V_{DC}$=−400 (V) was applied to the development sleeve. The drum potential was set at $V_D$=620 (V) and $V_L$=180 (V).

The toner employed in the evaluation test was composed of the materials below:

| | |
|---|---|
| Styrene-n-butyl acrylate | 100 parts |
| Magnetite | 100 parts |
| Negative charge controller | 1 part |
| Low molecular polystyrene | 8 parts |

The above materials were mixed by a Henschel mixer, and blended by a twin-screw extruder. The mixture, after cooling, was crushed by a hammer mill, and pulverized by a jet mill to obtain a pulverized matter. The pulverized matter was classified by an elbow jet classifying machine to obtain a classified matter (toner particles) having a weight-average particle diameter $D_4$ of 6.19 μm, containing particles of not larger than 4.0 μm at a content of 19.5% in number and particle of not smaller than 10.1 μm at a content of 0.2% by weight. To 100 parts of this classified matter, was added externally 1.2% by weight of colloidal silica to obtain a toner. This toner is referred to as "One-Component Developer 3".

A printing test was conducted in a low-humidity environment of 23° C./5% RH, and a high-humidity environment of 30° C./80% RH. Table 6 shows the evaluation results.

Evaluation Method

Evaluation was conducted about the test items as given below.

(1) Ghost

An image having a solid white portion and a solid black portion adjoining to each other is developed at the top portion of the image (first one rotation of the sleeve). The portions of the halftone area corresponding to the above solid white and the above solid black are examined at the second and later rotations of the sleeve for the density difference mainly visually with reference to the image density measurement data. The evaluation standards are as below. (In Tables, the symbol "N" means a ghost image in which the solid black portion appears to have lower density than the solid white portion, and absence of N means the reverse.)

A: No density difference observed,

B: Slight density difference observed in dependence upon a viewing angle,

C: Density difference observed, but measured density difference being not more than 0.01, D: Density difference observed with obscure edge, E: Larger density difference observed, F: Density difference remarkable, and detectable by density measurement, G: Density difference significant with measured density difference of 0.05 or more.

(2) Non-uniformity

Various images such as solid black images, halftone images, and line images are examined. The uniformity is evaluated according to the evaluation standards below in consideration of image irregularity (waves, blotches, etc.) caused by irregular coating of the sleeve with the developer such as wavy nonuniform and blotches.

A: Entirely uniform,

B: Nonuniform found in one sheet out of several to tens of printed sheets by examination with light transmitted through the sheet at a solid print area or a halftone area, C: Wavy or spotty irregularity found at one rotation of a sleeve in halftone or solid image printing, but no problem in photographic images or the like, D: Nonuniform image found in one sheet out of several printed sheets, not practically useful, E: Non-uniformity observed even in a solid white portion.

(3) Sleeve Soiling

After the running test, or when the image density becomes significantly lower, the toner on the sleeve surface is removed with a vacuum cleaner and by air blow (with an air gun). The sleeve surface is examined by an electron microscope (FE-SEM). The evaluation is made according to the evaluation standards below.

A: No toner remaining,

B: A few fine toner particles found in hollow portions of sleeve surface,

C: Toner particles remaining in some hollow portions with toner particle shapes kept unchanged, D: More toner particles remaining in some hollow portions than at level C with the toner particle shapes kept unchanged, E: Toner particles adhering to some portions on the sleeve with the toner particle shapes deformed as fused slightly, F: Toner particles adhering to about 20% of the area of the sleeve surface; intermediate level between E and G, G: Soiling observed, no fusion in stripes, SEM observation showing the existence of toner particles having smoothened surfaces by fusion in considerable portions of the sleeve, H: Toner particles having smoothened surfaces by fusion, adhering to the considerable area of the sleeve, clear toner fusion stripes observed in the circumference of the sleeve.

EXAMPLE 23

Sleeve b was produced and evaluated in the same manner as in Example 22 except that Copolymer a was replaced by Copolymer b constituted of the same monomers in the monomer molar ratio changed to 95:5. Table 5 shows the properties. Table 6 shows the evaluation results.

COMPARATIVE EXAMPLE 9

Sleeve c was produced and evaluated in the same manner as in Example 22 except that Copolymer a was replaced by Homopolymer c of methyl methacrylate. Table 5 shows the properties. Table 7 shows the evaluation results.

EXAMPLES 24 AND 25

Sleeves d and e were produced and evaluated in the same manner as in Example 22 except that Copolymer a was replaced by Copolymer d or e having a different molecular weight from that of Copolymer a used in Example 22. Table 5 shows the properties. Table 6 shows the evaluation results.

COMPARATIVE EXAMPLE 10

Sleeve f was produced and evaluated in the same manner as in Example 22 except that Copolymer a was replaced by Copolymer f having a molecular weight lower than that of Copolymer a used in Example 22. Table 5 shows the properties. Table 7 shows the evaluation results.

EXAMPLE 26

Surface-Coated Sleeve g was produced and evaluated in the same manner as in Example 22 except that the crystalline graphite was replaced by that having a number-average particle diameter of 3 $\mu$m, the aluminum cylindrical tube was sand-blasted to roughen irregularly the surface to have a surface roughness Ra=2.12 $\mu$m, and the coating liquid was applied thereon. The resulting Sleeve g had a surface roughness Ra=1.74 $\mu$m. Table 5 shows the properties. Table 6 shows the evaluation results.

EXAMPLE 27

Sleeve h was produced and evaluated in the same manner as in Example 22 except that the crystalline graphite was replaced by that having a number-average particle diameter of 3 $\mu$m. Table 5 shows the properties. Table 6 shows the evaluation results.

EXAMPLE 28

Sleeve i was produced and evaluated in the same manner as in Example 22 except that Copolymer a was replaced by Copolymer g constituted of methyl methacrylate and diethylaminoethyl methacrylate in a molar ratio of 90:10. Table 5 shows the properties. Table 7 shows the evaluation results.

EXAMPLES 29 AND 30

Sleeves j and k were produced and evaluated respectively in the same manner as in Example 22 except that the amounts of the carbon black and the crystalline graphite were changed as shown in Table 5. Table 5 shows the properties. Table 6 shows the evaluation results.

COMPARATIVE EXAMPLE 11

Sleeve 1 was produced and evaluated in the same manner as in Example 22 except that an aluminum tube employed in Example 26 was used, a phenol resin intermediate is used as the coating resin, and the coating resin was dried and solidified at 150° C. for 30 minutes. Table 5 shows the properties. Table 7 shows the evaluation results.

COMPARATIVE EXAMPLE 12

Sleeve m was produced in the same manner as in Comparative Example 10 except that the aluminum cylindrical tube was not sand-blasted. Sleeve m was evaluated in the same manner as in Example 22. Table 5 shows the properties. Table 7 shows the evaluation results.

COMPARATIVE EXAMPLE 13

The surface of the same aluminum cylindrical tube as that employed in Example 21 was sand-blasted with glass beads (FGB#150). Sleeve n was prepared and evaluated in the same manner as Example 22 except that the aluminum cylindrical tube was replaced by the above sand-blasted one. Table 5 shows the properties. Table 7 shows the evaluation results.

EXAMPLE 31

Copolymer 1 was used which was constituted of a quaternary ammonium group-containing vinyl monomer of the chemical structure shown below and methyl methacrylate.

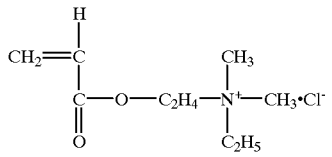

A coating liquid was prepared by mixing the materials in the mixing ratio below.

| | |
|---|---|
| Copolymer 1 above (molar ratio 90:10, Mw = 10,300, Mn = 4,500) | 100 parts |
| Crystalline graphite (number-average particle diameter: 3 $\mu$m) | 40 parts |
| Methyl ethyl ketone | 375 parts |

In mixing the materials, the above Copolymer 1 was preliminarily dissolved in a part of the MEK, and the crystalline graphite was dispersed therein together with glass beads by means of a sand mill. Thereto, the rest of the MEK was added to adjust the solid matter content to 28%. After the dispersion, the glass beads were separated from the liquid mixture. The mixture without the glass beads had a viscosity of 65 mPa.s at room temperature. This coating liquid was applied on a sleeve. In the coating operation, an aluminum cylindrical tube of 16 mm outside diameter flanged at the both ends was erected and rotated on a turntable, and the coating liquid was applied onto the surface of the tube by a spray gun descending at a constant speed with both ends of the sleeve masked to coat the sleeve in a uniform coating thickness. The coated layer was dried and solidified at 160° C. for 30 minutes in a drying furnace. The resulting coated article is referred to as Sleeve 1. The amount of the coating after the drying was 8900 mg/m$^2$. The center-line average roughness Ra was 1.35 $\mu$m.

Separately, another cylindrical tube was wound with an OHP sheet and with an aluminum sheet, and was coated in the same manner as above. These sheets were used for measurement of the specific volume resistance: the OHP sheet for resistance measurement, and the aluminum sheet for coating thickness measurement. The specific volume resistance was 12.8 Ω.cm by measurement with Low-Rester AP (manufactured by Mitsubishi Petrochemical Co.) with a four-terminal probe. Higher resistance was measured by High-Rester (manufactured by the same company).

Sleeve 1 was used for printing with a modification of an image forming machine LBP-2030 employed in Example 1. Sleeve 1 was mounted on an EP-H cartridge modified for fitting of this sleeve. A 5000-sheet running test was conducted in a single color with this machine.

The toner used in the evaluation test was composed of the materials below:

| | |
|---|---|
| Polyester resin | 100 parts |
| Phthalocyanine pigment | 4 parts |
| Negative charge controller | 1 part |
| Ester type wax | 8 parts |

A master batch was prepared from the phthalocyanine pigment and a part of the polyester resin. The master batch and the rest of the above materials are mixed by a Henschel mixer, and blended by a twin-screw extruder. The mixture, after cooled, was crushed by a hammer mill, and pulverized by a turbo-mill to obtain a fine pulverized matter. The pulverized matter was classified by an elbow jet classifying machine to obtain a classified matter (toner particles) having a weight-average particle diameter $D_4$ of 6.43 $\mu$m, containing particles of not larger than 4.0 $\mu$m at a content of 15.5% in number and particle of not smaller than 10.1 $\mu$m at a content of 1.3% by weight. To 100 parts of this classified matter, was added externally 2 parts by weight of colloidal silica to obtain a toner. This toner is referred to as One-Component Developer 4.

Image printing test was conducted under low-humidity conditions of 23° C./5% RH, and high-humidity conditions of 30° C./80% RH. The evaluations were made for reflection density of 5-mm square black print and solid black area as image density, solid white stripe and white band (white band), and scraping of the coating layer (film scraping) out of the tests conducted in Example 1. Table 9 shows the evaluation results.

EXAMPLE 32

Sleeve 2 was produced in the same manner as in Example 31 except that Copolymer 1 for the coating liquid was replaced by Copolymer 2 which has the comonomer unit shown by the chemical formula below as the quaternary ammonium group-containing vinyl monomer. The evaluations were conducted in the same manner as in Example 31. Table 8 shows the properties. Table 9 shows the evaluation results.

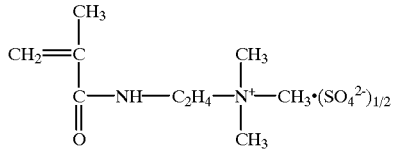

COMPARATIVE EXAMPLE 14

Sleeve 3 was produced and evaluated in the same manner as in Example 31 except that Copolymer 1 in Example 31 was replaced by a homopolymer of methyl methacrylate (Homopolymer 3). In this Comparative Example 13, the toner charge could not be raised sufficiently, fine graphite particles were dispersed slightly less, whereby some defects appeared. Table 8 shows the properties. Table 9 shows the evaluation results.

EXAMPLES 33 TO 35

Coating liquids were prepared in the same manner as in Example 31 by using Copolymer 4, 5, or 6 which was constituted of the comonomer units in the ratio as shown in FIG. 8 in place of Copolymer 1 used in Example 31. Sleeves 4, 5, and 6 were produced and evaluated respectively in the similar manner as in Example 31 by use of Copolymer 4, 5, or 6. Table 8 shows the properties. Table 9 shows the evaluation results.

EXAMPLES 36 TO 39

Sleeves 7 to 10 were produced and evaluated in the same manner as in Example 31 except that the copolymer used in Example 31 was replaced by Copolymer 7, 8, 9, or 10 which has a molecular weight different from that of Example 31 as shown in Table 8. Table 8 shows the properties. Table 9 shows the evaluation results.

COMPARATIVE EXAMPLES 15 AND 16

Sleeves 11 and 12 were produced in the same manner as in Example 31 except that the copolymer used in Example 31 was replaced by Copolymer 11 having a lower weight-average molecular weight (in Comparative Example 14) or Copolymer 12 having a higher weight-average molecular weight (in Comparative Example 15). Table 8 shows the properties. Table 9 shows the evaluation results.

EXAMPLE 40

Sleeve 13 was produced and evaluated in the same manner as in Example 31 except that carbon black only was used without using crystalline graphite. Table 8 shows the properties. Table 9 shows the evaluation results.

EXAMPLE 41

Sleeve 14 was produced and evaluated in the same manner as in Example 31 except that Copolymer 1 used in Example 31 was replaced by Copolymer 13 of Mw/Mn of 3.8 having more lower molecular weight copolymer component. Table 8 shows the properties. Table 9 shows the evaluation results.

EXAMPLE 42

Sleeve 15 was produced and evaluated in the same manner as in Example 31 except that carbon black and crystalline graphite were combinedly used. Table 8 shows the properties. Table 9 shows the evaluation results.

EXAMPLES 43 TO 45

Sleeves 16 to 18 were produced and evaluated in the same manner as in Example 31 except that the amount of addition of crystalline graphite was changed. Table 8 shows the properties. Table 9 shows the evaluation results.

COMPARATIVE EXAMPLE 17

| | |
|---|---|
| Phenol resin intermediate | 100 parts |
| Crystalline graphite (number-average particle diameter: 3 μm) | 40 parts |
| Methanol | 250 parts |

A phenol resin type coating liquid was prepared from the above materials. Sleeve 19 was produced and prepared in the same manner as in Example 31 except that the coating liquid was replaced by the above one and the drying and solidification was conducted at 150° C. for 30 minutes. Table 8 shows the properties. Table 9 shows the evaluation results.

COMPARATIVE EXAMPLE 18

Sleeve 20 was produced and evaluated in the same manner as in Example 31 except that the surface of the aluminum cylindrical tube was sand-blasted with glass beads (FGB#300). Table 8 shows the properties. Table 9 shows the evaluation results.

EXAMPLE 46

A coating liquid for coating layer formation on a sleeve base was prepared by mixing the materials in the mixing ratio as shown below. Table 10 shows the constituting materials of the terpolymer and the properties of the terpolymer used in this Example.

| | |
|---|---|
| Methyl methacrylate-dimethylaminoethyl methacrylate acrylic acid copolymer 14 (molar ratio = 90:5:5, Mw = 10,200, Mn = 4,400) | 100 parts |
| Crystalline graphite (number-average particle diameter: 3 μm) | 25 parts |
| Toluene | 375 parts |

In mixing the materials, the methyl methacrylate-dimethylaminoethyl methacrylate-acrylic acid copolymer 14 was preliminarily dissolved in a part of the toluene, and the crystalline graphite was added thereto and dispersed together with glass beads by means of a sand mill. Thereto, the rest of the toluene was added to adjust the solid matter content to 25%. After the dispersion, the glass beads were separated from the liquid mixture. The mixture without the glass beads had a viscosity of 60 mPa.s at room temperature. This coating liquid was applied on a sleeve. The sleeve base was an aluminum cylindrical bar of 16 mm outside diameter flanged at the both ends. This aluminum cylindrical bar was erected and rotated on a turntable, and the coating liquid was applied onto the surface of the bar by a spray gun descending at a constant speed with the both ends of the sleeve masked to coat the sleeve in a uniform coating thickness. The coated layer was dried and solidified at 160° C. for 30 minutes in a drying furnace. The resulting coated article is referred to as Sleeve 21.

The amount of the coating (resin layer) of Sleeve 21 after the drying was 8,900 mg/m$^2$. The center-line average roughness Ra was 0.48 μm.

Separately, another cylindrical bar was wound with an OHP sheet and with an aluminum sheet, and was coated in the same manner as above. These sheets were used for measurement of the specific volume resistance: the OHP sheet for resistance measurement, and the aluminum sheet for coating layer thickness measurement. The specific volume resistance was 58.7 Ω.cm by measurement with Low-Rester AP (manufactured by Mitsubishi Petrochemical Co.) with a four-terminal probe. (Higher resistance was measured by High-Rester (manufactured by the same company)).

Sleeve 21 was used for printing with a modification of an image forming machine LBP-2030 (manufactured by CANON INC.) employed in Example 1. This sleeve was mounted on an EP-H cartridge modified for fitting of this sleeve. A 3000-sheet running test was conducted in a single color with this machine. The developer in this printing test was One-Component Developer 2 comprising a polymerization toner used in Example.

The image printing test was conducted under room-temperature low-humidity conditions (N/L) of 23° C./5% RH, and high-temperature high-humidity conditions (H/H) of 30° C./80% RH. The evaluations were made for reflection density of 5-mm square black print and solid print area as image density, toner charge quantity, solid white stripe and white band (white band), and scraping of the coating layer (film scraping) out of the tests conducted in Example 1. Table 12 shows the evaluation results.

EXAMPLES 47 TO 51 AND COMPARATIVE EXAMPLE 19 AND 20

Sleeves 22 to 28 were produced and evaluated in the same manner as in Example 46 except that, in the preparation of the coating liquid, the Terpolymer 14 used in Example 46 was replaced by one of Terpolymers 15 to 21 of the constituting monomer ratio of methyl methacrylate (first component), dimethylaminomethyl methacrylate (second component), and acrylic acid (third component) different from that of Terpolymer 14. Table 10 shows the constituting materials of Terpolymers 15 to 21. Table 11 shows the properties of the terpolymers. Table 12 shows the evaluation results.

COMPARATIVE EXAMPLE 21

Sleeve 29 was produced and evaluated in the same manner as in Example 46 except that, in the preparation of the coating liquid, the Terpolymer 14 used in Example 46 was replaced by Homopolymer 22 of methyl methacrylate.

In this Comparative Example, the toner was not sufficiently charged owing to the absence of a nitrogen-containing monomer and of an acid or its ester having a vinyl group other than methacrylate, and the coverage of the developer-carrying member with the developer is a little insufficient, which causes defects. Table 10 shows the resin binder used in this Example. Table 12 shows the evaluation results.

COMPARATIVE EXAMPLES 22, 23 AND EXAMPLES 52 TO 55

Sleeves 30 to 35 were produced and evaluated in the same manner as in Example 46 except that, in the preparation of the coating liquid, the Terpolymer 14 used in Example 46 was replaced by one of Terpolymers 23 to 28 which has a molecular weight different from that of Example 46 as shown in Table 10. Table 10 shows the source materials for Terpolymers 23 to 28. Table 11 shows the properties of the terpolymers. Table 12 shows the evaluation results.

COMPARATIVE EXAMPLE 24

Sleeve 36 was produced and evaluated in the same manner as in Example 46 except that Terpolymer 14 used in the coating liquid preparation was replaced by Terpolymer 29 mainly constituted of styrene. In the test, the printed image quality deteriorated owing to occurrence of scraping of the coating layer. Table 10 shows the resin binder used in this Example. Table 11 shows the properties of the resin coating layer. Table 12 shows the evaluation results.

COMPARATIVE EXAMPLE 25

Sleeve 37 was produced and evaluated in the same manner as in Example 46 except that Terpolymer 14 used in the coating liquid preparation in Example 46 was replaced by a phenol type coating liquid having a composition shown below. The drying and solidification of the coating was conducted at 150° C. for 30 minutes.

| | |
|---|---|
| Phenol resin intermediate | 100 parts |
| Crystalline graphite (average particle diameter: 3 $\mu$m) | 25 parts |
| Methanol | 250 parts |

Table 10 shows the resin binder used in this Comparative Example. Table 11 shows the properties of the resin coating layer. Table 12 shows the evaluation results.

COMPARATIVE EXAMPLE 26

Sleeve 38 was produced by sand-blasting the surface of the aluminum cylindrical bar employed in Example 46 with glass bead (FGB#300). The obtained Sleeve 38 was evaluated in the same manner as in Example 46. Table 11 shows the properties of Sleeve 38. Table 12 shows the evaluation results.

EXAMPLE 56

Sleeve 39 was produced and evaluated in the same manner as in Example 46 except that, in the preparation of the coating liquid, 16 parts of carbon black was used without using the crystalline graphite. Table 10 shows the constituting materials of the terpolymer used in this Example. Table 11 shows the properties of the terpolymer. Table 12 shows the evaluation results.

EXAMPLE 57

Sleeve 40 was produced and evaluated in the same manner as in Example 46 except that the terpolymer for the resin coating layer was replaced to Terpolymer 30 of Mw/Mn of 3.7 containing a larger amount of low molecular components. Table 10 shows the constituting materials of the terpolymer used in this Example. Table 11 shows the properties of the terpolymer. Table 12 shows the evaluation results.

EXAMPLE 58

Sleeve 41 was produced and evaluated in the same manner as in Example 46 except that, in the preparation of the coating liquid, carbon black was used in addition to the crystalline graphite. Table 10 shows the constituting materials of the terpolymer used in this Example. Table 11 shows the properties of the terpolymer. Table 12 shows the evaluation results.

EXAMPLES 59 TO 62

Sleeves 42 to 45 were produced and evaluated in the same manner as in Example 46 except that, in the preparation of the coating liquid, the amount of the crystalline graphite was changed. Table 10 shows the constituting materials of the terpolymer used in these Examples. Table 11 shows the properties of the terpolymers. Table 12 shows the evaluation results.

EXAMPLES 63 TO 70

Sleeves 46 to 53 were produced and evaluated in the same manner as in Example 46 except that Terpolymer 14 in Example 46 was replaced by one of Terpolymers 31 to 38 in which dimethylaminoethyl methacrylate (second component monomer) was changed to diethylaminoethyl methacrylate, dibutylaminoethyl methacrylate, or dimethylaminostyrene; the third component monomer was acrylic acid, methacrylic acid, or butyl maleate; and the first component monomer was methyl methacrylate. Table 10 shows the constituting materials of Terpolymers 31 to 38. Table 11 shows the properties of the terpolymers. Table 12 shows the evaluation results.

In Table 10, the abbreviated words means respectively the materials as below.

MMA: Methyl methacrylate

DM: Dimethylaminoethyl methacrylate

DE: Diethylaminoethyl methacrylate

DB: Dibutylaminoethyl methacrylate

DS: Dimethylaminostyrene

AA: Acrylic acid

MA: Methacrylic acid

MB: Butyl maleate

EXAMPLE 71

A coating liquid for formation of a coating layer on a sleeve base was prepared by mixing the materials in the mixing ratio below. Table 13 shows the constituting materials of the terpolymer used in this Example and the properties of the terpolymer.

| | |
|---|---|
| Methyl methacrylate-dimethylaminoethyl methacrylate-acrylic acid copolymer 39 (molar ratio 85:10:5, Mw = 11,500, Mn = 4,800) | 100 parts |
| Crystalline graphite (number-average particle diameter: 5 $\mu$m) | 36 parts |
| Carbon black | 4 parts |
| Toluene | 360 parts |

In mixing the materials, Methyl Methacrylate-Dimethylaminoethyl Methacrylate Copolymer 39 was preliminarily dissolved in a part of the toluene, and the crystalline graphite and the carbon black were dispersed therein with glass beads by means of a sand mill. Thereto, the rest of the toluene was added to adjust the solid matter content to 25%. After the dispersion, the glass beads were separated from the liquid mixture. The mixture without the glass beads had a viscosity of 75 mPa.s at room temperature. This coating liquid was applied on a sleeve surface as below.

The base of the sleeve was an aluminum cylindrical tube of 16 mm outside diameter. This aluminum cylindrical tube was erected and rotated on a turntable, and the coating liquid was applied on the surface of the cylindrical tube by a spray gun descending at a constant rate with the both ends of the sleeve masked to coat the sleeve in a uniform coating thickness. The coated layer was dried and solidified at 160° C. for 30 minutes in a drying furnace. The resulting coated article is referred to as Sleeve 54.

The amount of the coating (resin layer) after the drying was 8,600 mg/m$^2$. The center-line average surface roughness Ra was 0.96 $\mu$m.

Separately, another cylindrical tube was wound with an OHP sheet and with an aluminum sheet, and was coated in the same manner as above. These sheets were used for measurement of the specific volume resistance: the OHP sheet for resistance measurement, and the aluminum sheet for thickness measurement, of the coating film. The measured specific volume resistance was 29.3 Ω.cm.

Sleeve 54 was used for printing with a modification of an image forming machine LBP-450 (manufactured by CANON INC.). Sleeve 54 was mounted on an EP-P cartridge modified for fitting of the sleeve. A 6000-sheet running test was conducted with this machine with a low-temperature fixing toner shown below (capable of fixation at 110° C. at a process speed of 24 mm/sec). FIG. 2 shows schematically the periphery of the sleeve of the EP-P cartridge.

In the cartridge, the elastic control blade was a urethane rubber blade fusion-bonded to a base metal plate, and was hung therefrom. The urethane rubber blade was brought into pressure contact with the development sleeve at a contact pressure of 25 g/cm. The thickness of the developer layer formed on the development sleeve was about 160 $\mu$m. The minimum gap D between the photosensitive drum surface and the development sleeve surface was 270 $\mu$m without contact of the developer layer with the photosensitive drum. In the development, a development bias voltage of $V_{p-p}$= 1600 (V), frequency f=1800 (Hz), and $V_{DC}$=−500 (V) was applied to the development sleeve. The drum potential was set at $V_D$=−650 (V) and $V_L$=−150 (V).

In the evaluation test, the one-component developer employed was a pulverized toner prepared as below:

The materials below were mixed by a Henschel mixer, and blended by a twin-screw extruder. The mixture, after cooled, was crushed by a hammer mill, and pulverized by a jet mill to obtain a fine pulverized matter.

| | |
|---|---|
| Styrene-n-butyl acrylate | 100 parts |
| Magnetite | 95 parts |
| Negative charge controller | 2 parts |
| Low molecular polyethylene | 7 parts |

The fine pulverized matter was classified by an elbow jet classifying machine to obtain a classified matter (toner particles) having a weight-average particle diameter $D_4$ of 6.19 $\mu$m, containing particles of not larger than 4.0 $\mu$m at a content of 18.5% in number and particle of not smaller than 10.1 $\mu$m at a content of 0.3% by weight. To 100 parts of this classified matter, was added externally 1.4 parts by weight of colloidal silica to obtain a magnetic toner. This toner is referred to as "One-Component Developer".

An image printing test was conducted under an ordinary temperature low-humidity conditions (N/H) of 23° C./5% RH, and high-temperature high-humidity conditions (H/H) of 30° C./80% RH.

The evaluations were made for reflection density of 5-mm square black print and solid print area as image density, toner charge quantity, and soiling of the sleeve out of the tests conducted in Example 22. Table 15 shows the evaluation results.

EXAMPLES 72 TO 75

Terpolymers 40 to 43 were prepared by changing the combination of the second component monomer, dimethylaminoethyl methacrylate, and the third component monomer, acrylic acid, to the component monomers shown in Table 13 with the ratio of the first, second, and third component monomers kept unchanged.

Sleeves 55 to 58 were produced and evaluated in the same manner as in Example 71 except that Terpolymer 39 used in Example 71 was replaced by one of the above Terpolymers 40 to 43. Table 13 shows the constituting materials of Terpolymers 40 to 43. Table 14 shows the properties of the terpolymers. Table 15 shows the evaluation results.

EXAMPLE 76

Sleeve 59 was produced and evaluated in the same manner as in Example 71 except that Terpolymer 39 used in Example 71 was replaced by Copolymer 44 constituted of methyl methacrylate and dimethylaminoethyl methacrylate 85:15. Table 13 shows the constituting materials of Copolymer 44. Table 14 shows the properties of the copolymers. Table 15 shows the evaluation results.

COMPARATIVE EXAMPLE 27

A phenol type coating liquid was prepared in the same manner as in Example 71 by using a phenol resin intermediate in place of Terpolymer 39 used in Example 71. Sleeve 60 was produced by applying the coating liquid onto an aluminum cylindrical tube and drying and solidifying the coating liquid at 150° C. for 30 minutes, otherwise in the same manner as in Example 71. The sleeve was evaluated in the same manner as in Example 71. Table 15 shows the evaluation results.

TABLE 1

| sample | sleeve | binder resin | | | | | | |
|---|---|---|---|---|---|---|---|---|
| | | | monomer 1 *0 | monomer 2 *1 | molar ratio *2 | Mw | Mn | Mw/Mn |
| Example: | | | | | | | | |
| 1 | A | copolymer A | MMA | DM | 90:10 | 10200 | 4500 | 2.3 |
| 2 | B | copolymer B | MMA | DM | 95:5 | 10400 | 5100 | 2.0 |
| 3 | C | copolymer C | MMA | DM | 98:2 | 12100 | 5600 | 2.2 |
| 4 | D | copolymer D | MMA | DM | 997:3 | 19000 | 9800 | 1.9 |
| 5 | E | copolymer E | MMA | DM | 85:15 | 9800 | 4500 | 2.2 |
| 6 | F | copolymer F | MMA | DM | 82:18 | 10000 | 4600 | 2.2 |
| 7 | I | copolymer I | MMA | DM | 90:10 | 3500 | 2200 | 1.6 |
| 8 | J | copolymer J | MMA | DM | 90:10 | 7000 | 3600 | 1.9 |
| 9 | K | copolymer K | MMA | DM | 90:10 | 21000 | 9500 | 2.2 |
| 10 | L | copolymer L | MMA | DM | 90:10 | 42000 | 18000 | 2.3 |
| 11 | O | copolymer A | MMA | DM | 90:10 | 10200 | 4500 | 2.3 |
| 12 | P | copolymer O | MMA | DM | 90:10 | 12300 | 3200 | 3.8 |
| 13 | Q | copolymer A | MMA | DM | 90:10 | 10200 | 4500 | 2.3 |
| 14 | R | copolymer A | MMA | DM | 90:10 | 10200 | 4500 | 2.3 |
| 15 | S | copolymer A | MMA | DM | 90:10 | 10200 | 4500 | 2.3 |
| 16 | T | copolymer A | MMA | DM | 90:10 | 10200 | 4500 | 2.3 |
| 17 | U | copolymer A | MMA | DM | 90:10 | 10200 | 4500 | 2.3 |
| 18 | V | copolymer P | MMA | DE | 90:10 | 9600 | 4800 | 2.0 |
| 19 | W | copolymer Q | MMA | DB | 90:10 | 13200 | 5500 | 2.4 |
| 20 | X | copolymer R | MMA | DS | 90:10 | 11500 | 5200 | 2.2 |
| Comparative Example: | | | | | | | | |
| 1 | G | single polymer G | MMA | — | 100:0 | 11100 | 4800 | 2.3 |
| 2 | H | copolymer H | MMA | DM | 70:30 | 9800 | 2700 | 3.5 |
| 3 | M | copolymer M | MMA | DM | 90:10 | 2600 | 1400 | 1.9 |
| 4 | N | copolymer N | MMA | DM | 90:10 | 58000 | 22000 | 2.6 |
| 5 | Y | copolymer S | styrene | DM | 90:10 | 19000 | 9500 | 2.0 |
| 6 | Z | — | — | — | — | — | — | — |
| 7 | ZZ | — | — | — | — | — | — | — |

| sample | conductive fine powder | | notes *5 | volume resistivity (Ω · cm) | surface roughness Ra(μm) |
|---|---|---|---|---|---|
| | carbon (parts)*3 | graphite (parts)*4 | | | |
| Example: | | | | | |
| 1 | | 25 | | 56.8 | 0.48 |
| 2 | | 25 | | 58.5 | 0.53 |
| 3 | | 25 | | 60.3 | 0.55 |
| 4 | | 25 | | 72.5 | 0.79 |
| 5 | | 25 | | 47.3 | 0.46 |
| 6 | | 25 | | 45.1 | 0.48 |
| 7 | | 25 | | 53.2 | 0.45 |
| 8 | | 25 | | 54.5 | 0.48 |
| 9 | | 25 | | 62.7 | 0.72 |
| 10 | | 25 | | 71.4 | 1.02 |
| 11 | 18 | | | 27.8 | 0.62 |
| 12 | | 25 | | 49.8 | 0.50 |
| 13 | 3 | 20 | | 48.6 | 0.52 |
| 14 | | 50 | | 5.7 | 0.72 |
| 15 | | 17 | | 37.5 | 0.46 |
| 16 | | 12.5 | | $1.1 \times 10^3$ | 0.42 |
| 17 | | 5 | | $5.5 \times 10^5$ | 0.38 |
| 18 | | 25 | | 58.3 | 0.48 |
| 19 | | 25 | | 60.1 | 0.56 |
| 20 | | 25 | | 67.1 | 0.82 |
| Comparative Example: | | | | | |
| 1 | | 25 | | 72.5 | 0.63 |
| 2 | | 25 | | 50.6 | 0.51 |
| 3 | | 25 | | 52.1 | 0.46 |
| 4 | | 25 | | 102.3 | 1.75 |
| 5 | | 25 | | 59.3 | 0.50 |

TABLE 1-continued

| | | | | |
|---|---|---|---|---|
| 6 | 25 | phenol | 44.6 | 0.62 |
| 7 | | sand blast | — | 0.53 |

*0 MMA: methyl methacrylate monomer
*1 DM: methylaminoethyl methacrylate monomer
DE: ethylaminoethyl methacrylate monomer
DB: dibutylaminobutyl methacrylate monomer
DS: dimethylaminostyrene monomer
*2 molar ratio of monomer 1 to monomer 2
*3 and *4 parts by weight based on 100 parts by weight of resin
*5 other resin or production process

TABLE 2

| sample Example: | environ-ment | 5 mm square density | solid density | toner charge quantity | paper fogging | drum fogging | white band | scattering | film scraping |
|---|---|---|---|---|---|---|---|---|---|
| | | | | initial stage | | | | | |
| 1 | N/L | 1.45 | 1.45 | 45.0 | 1.0 | 2.2 | A | A | |
| | H/H | 1.43 | 1.43 | 36.9 | 0.8 | 1.5 | A | A | |
| 2 | N/L | 1.45 | 1.45 | 42.5 | 1.1 | 2.3 | A | A | |
| | H/H | 1.43 | 1.43 | 35.0 | 0.7 | 1.6 | A | A | |
| 3 | N/L | 1.45 | 1.45 | 39.8 | 1.2 | 2.5 | A | A | |
| | H/H | 1.42 | 1.42 | 32.7 | 0.7 | 1.8 | A | A | |
| 4 | N/L | 1.44 | 1.44 | 33.7 | 2.7 | 5.3 | A | A | |
| | H/H | 1.38 | 1.38 | 27.0 | 2.0 | 4.0 | A | B | |
| 5 | N/L | 1.45 | 1.45 | 46.0 | 1.0 | 2.1 | A | A | |
| | H/H | 1.43 | 1.43 | 37.1 | 0.8 | 1.6 | A | A | |
| 6 | N/L | 1.45 | 1.45 | 46.2 | 1.1 | 2.2 | A | A | |
| | H/H | 1.43 | 1.43 | 36.5 | 0.7 | 1.7 | A | A | |
| 7 | N/L | 1.45 | 1.45 | 43.8 | 1.8 | 3.9 | A | A | |
| | H/H | 1.43 | 1.43 | 36.5 | 1.0 | 2.5 | A | A | |
| 8 | N/L | 1.45 | 1.45 | 44.2 | 1.0 | 2.4 | A | A | |
| | H/H | 1.43 | 1.43 | 36.8 | 0.8 | 2.0 | A | A | |
| 9 | N/L | 1.45 | 1.45 | 45.8 | 1.3 | 2.8 | A | A | |
| | H/H | 1.43 | 1.43 | 37.3 | 1.0 | 2.2 | A | A | |
| 10 | N/L | 1.43 | 1.42 | 40.9 | 2.0 | 3.9 | A | A | |
| | H/H | 1.40 | 1.39 | 35.0 | 1.3 | 2.6 | A | A | |
| | | | | after 1,500-sheet copying | | | | | |
| 1 | N/L | 1.45 | 1.45 | 47.2 | 1.8 | 3.6 | A | A | |
| | H/H | 1.43 | 1.43 | 38.0 | 1.3 | 2.7 | A | A | |
| 2 | N/L | 1.45 | 1.45 | 43.2 | 1.8 | 3.7 | A | A | |
| | H/H | 1.43 | 1.43 | 36.1 | 1.2 | 2.6 | A | A | |
| 3 | N/L | 1.45 | 1.44 | 39.5 | 2.0 | 4.0 | A | A | |
| | H/H | 1.42 | 1.41 | 32.5 | 1.2 | 2.6 | A | B | |
| 4 | N/L | 1.42 | 1.38 | 31.8 | 3.1 | 6.0 | B | B | |
| | H/H | 1.35 | 1.31 | 27.8 | 2.0 | 4.0 | D | B | |
| 5 | N/L | 1.45 | 1.45 | 45.5 | 1.8 | 3.6 | A | A | |
| | H/H | 1.43 | 1.43 | 37.6 | 1.2 | 2.6 | A | A | |
| 6 | N/L | 1.45 | 1.45 | 45.3 | 1.9 | 4.1 | A | A | |
| | H/H | 1.43 | 1.43 | 38.3 | 1.3 | 2.8 | A | A | |
| 7 | N/L | 1.44 | 1.44 | 40.5 | 2.5 | 4.4 | A | A | |
| | H/H | 1.40 | 1.35 | 33.8 | 1.4 | 2.6 | B | B | |
| 8 | N/L | 1.45 | 1.45 | 45.3 | 1.8 | 3.9 | A | A | |
| | H/H | 1.43 | 1.43 | 37.2 | 1.4 | 2.8 | A | A | |
| 9 | N/L | 1.45 | 1.45 | 47.1 | 1.6 | 3.9 | A | A | |
| | H/H | 1.43 | 1.43 | 37.5 | 1.6 | 3.5 | A | A | |
| 10 | N/L | 1.43 | 1.42 | 40.5 | 2.2 | 4.1 | A | A | |
| | H/H | 1.39 | 1.36 | 34.0 | 1.5 | 3.2 | B | B | |
| | | | | after 3,000-sheet copying | | | | | |
| 1 | N/L | 1.44 | 1.43 | 46.3 | 2.2 | 4.5 | A | A | 0.8 |
| | H/H | 1.39 | 1.36 | 34.8 | 1.5 | 2.7 | A | B | 1.3 |
| 2 | N/L | 1.44 | 1.43 | 42.0 | 2.2 | 4.4 | A | A | 0.7 |
| | H/H | 1.39 | 1.36 | 33.2 | 1.5 | 2.8 | A | B | 1.3 |
| 3 | N/L | 1.43 | 1.41 | 37.2 | 2.4 | 5.0 | A | B | 1.7 |
| | H/H | 1.35 | 1.30 | 31.8 | 1.6 | 3.0 | B | B | 1.2 |
| 4 | N/L | 1.40 | 1.35 | 31.0 | 3.5 | 7.1 | C | C | 1.6 |
| | H/H | 1.31 | 1.22 | 24.5 | 2.5 | 5.0 | D | D | 1.1 |
| 5 | N/L | 1.43 | 1.42 | 45.9 | 2.3 | 4.7 | B | A | 1.9 |
| | H/H | 1.39 | 1.36 | 34.5 | 1.6 | 3.0 | A | B | 1.3 |
| 6 | N/L | 1.43 | 1.42 | 44.8 | 2.4 | 4.7 | B | A | 1.0 |
| | H/H | 1.39 | 1.35 | 35.1 | 1.6 | 3.0 | A | B | 1.4 |
| 7 | N/L | 1.42 | 1.40 | 34.6 | 3.0 | 6.7 | A | A | 0.8 |
| | H/H | 1.30 | 1.25 | 27.3 | 1.6 | 3.8 | C | C | 1.3 |

TABLE 2-continued

| sample Example: | environ-ment | 5 mm square density | solid density | toner charge quantity | paper fogging | drum fogging | white band | scattering | film scraping |
|---|---|---|---|---|---|---|---|---|---|
| 8 | N/L | 1.44 | 1.43 | 46.0 | 2.1 | 4.5 | A | A | 1.8 |
| | H/H | 1.39 | 1.36 | 35.1 | 1.6 | 3.1 | A | B | 1.3 |
| 9 | N/L | 1.44 | 1.43 | 43.7 | 2.7 | 5.3 | A | A | 0.6 |
| | H/H | 1.37 | 1.33 | 35.2 | 2.2 | 4.0 | A | B | 1.2 |
| 10 | N/L | 1.42 | 1.38 | 33.7 | 2.9 | 6.2 | B | B | 0.9 |
| | H/H | 1.35 | 1.29 | 26.5 | 2.0 | 4.5 | B | C | 1.5 |

TABLE 3

| sample Example: | environ-ment | 5 mm square density | solid density | toner charge quantity | paper fogging | drum fogging | white band | scattering | film scraping |
|---|---|---|---|---|---|---|---|---|---|
| | | | | initial stage | | | | | |
| 11 | N/L | 1.45 | 1.45 | 43.0 | 1.4 | 2.8 | A | A | |
| | H/H | 1.43 | 1.43 | 33.0 | 1.0 | 2.0 | A | A | |
| 12 | N/L | 1.45 | 1.45 | 43.7 | 1.1 | 2.3 | A | A | |
| | H/H | 1.43 | 1.43 | 36.8 | 1.0 | 1.9 | A | A | |
| 13 | N/L | 1.45 | 1.45 | 45.1 | 1.0 | 2.2 | A | A | |
| | H/H | 1.43 | 1.43 | 37.0 | 0.8 | 1.5 | A | A | |
| 14 | N/L | 1.43 | 1.43 | 38.9 | 1.1 | 2.9 | A | A | |
| | H/H | 1.40 | 1.39 | 32.7 | 0.8 | 2.3 | A | A | |
| 15 | N/L | 1.45 | 1.45 | 47.3 | 1.1 | 2.4 | A | A | |
| | H/H | 1.43 | 1.43 | 39.8 | 0.7 | 1.5 | A | A | |
| 16 | N/L | 1.45 | 1.44 | 47.9 | 1.8 | 3.5 | A | A | |
| | H/H | 1.43 | 1.43 | 39.8 | 1.3 | 2.6 | A | A | |
| 17 | N/L | 1.44 | 1.43 | 41.5 | 2.3 | 5.2 | A | A | |
| | H/H | 1.43 | 1.42 | 37.2 | 1.5 | 2.8 | B | A | |
| 18 | N/L | 1.45 | 1.45 | 44.8 | 1.0 | 2.2 | A | A | |
| | H/H | 1.43 | 1.43 | 36.9 | 0.8 | 1.6 | A | A | |
| 19 | N/L | 1.44 | 1.44 | 42.1 | 1.2 | 2.5 | A | A | |
| | H/H | 1.42 | 1.42 | 34.3 | 0.8 | 1.6 | A | A | |
| 20 | N/L | 1.43 | 1.43 | 39.5 | 1.7 | 4.5 | A | A | |
| | H/H | 1.42 | 1.42 | 32.1 | 1.2 | 2.5 | A | A | |
| | | | | after 1,500-sheet copying | | | | | |
| 11 | N/L | 1.44 | 1.44 | 41.9 | 2.4 | 5.0 | A | A | |
| | H/H | 1.42 | 1.41 | 31.5 | 1.0 | 2.2 | B | B | |
| 12 | N/L | 1.45 | 1.45 | 37.5 | 2.2 | 4.8 | A | B | |
| | H/H | 1.41 | 1.38 | 31.3 | 1.4 | 3.2 | B | B | |
| 13 | N/L | 1.45 | 1.45 | 46.2 | 1.8 | 3.6 | A | A | |
| | H/H | 1.43 | 1.43 | 38.1 | 1.1 | 2.3 | A | A | |
| 14 | N/L | 1.43 | 1.42 | 41.2 | 1.8 | 4.0 | A | A | |
| | H/H | 1.40 | 1.39 | 33.0 | 1.0 | 2.4 | B | B | |
| 15 | N/L | 1.45 | 1.45 | 42.5 | 1.7 | 3.9 | A | A | |
| | H/H | 1.43 | 1.43 | 38.5 | 1.3 | 2.8 | A | A | |
| 16 | N/L | 1.45 | 1.45 | 40.7 | 2.4 | 5.2 | A | A | |
| | H/H | 1.43 | 1.43 | 37.6 | 1.5 | 3.3 | A | A | |
| 17 | N/L | 1.40 | 1.35 | 36.8 | 3.5 | 7.6 | C | B | |
| | H/H | 1.42 | 1.40 | 33.5 | 1.8 | 3.9 | B | B | |
| 18 | N/L | 1.45 | 1.45 | 45.9 | 1.9 | 3.8 | A | A | |
| | H/H | 1.43 | 1.43 | 37.0 | 1.4 | 2.7 | A | A | |
| 19 | N/L | 1.45 | 1.45 | 42.3 | 1.9 | 4.1 | A | A | |
| | H/H | 1.42 | 1.42 | 34.1 | 1.4 | 3.0 | A | A | |
| 20 | N/L | 1.43 | 1.40 | 37.5 | 2.2 | 4.7 | A | A | |
| | H/H | 1.40 | 1.36 | 30.3 | 1.3 | 2.6 | B | B | |
| | | | | after 3,000-sheet copying | | | | | |
| 11 | N/L | 1.42 | 1.40 | 41.0 | 3.1 | 6.8 | A | A | 0.8 |
| | H/H | 1.36 | 1.30 | 30.3 | 1.5 | 3.2 | B | C | 1.5 |
| 12 | N/L | 1.42 | 1.39 | 31.7 | 3.0 | 7.4 | B | B | 0.7 |
| | H/H | 1.34 | 1.27 | 25.3 | 2.6 | 5.0 | B | D | 1.1 |
| 13 | N/L | 1.44 | 1.43 | 45.7 | 2.2 | 4.5 | A | A | 0.7 |
| | H/H | 1.39 | 1.36 | 34.7 | 1.3 | 2.6 | A | B | 1.3 |
| 14 | N/L | 1.42 | 1.40 | 39.5 | 2.7 | 5.9 | A | A | 1.2 |
| | H/H | 1.36 | 1.32 | 30.0 | 1.5 | 3.2 | B | C | 1.8 |
| 15 | N/L | 1.44 | 1.42 | 41.6 | 2.3 | 4.9 | A | A | 0.7 |
| | H/H | 1.39 | 1.37 | 36.7 | 1.7 | 3.3 | A | B | 1.0 |
| 16 | N/L | 1.44 | 1.42 | 37.8 | 3.4 | 7.0 | B | B | 0.7 |
| | H/H | 1.39 | 1.37 | 37.2 | 2.7 | 5.2 | A | B | 1.0 |

TABLE 3-continued

| sample Example: | environ-ment | 5 mm square density | solid density | toner charge quantity | paper fogging | drum fogging | white band | scattering | film scraping |
|---|---|---|---|---|---|---|---|---|---|
| 17 | N/L | 1.39 | 1.34 | 33.0 | 3.8 | 8.2 | D | D | 0.6 |
| | H/H | 1.36 | 1.32 | 31.5 | 3.0 | 6.0 | C | C | 1.0 |
| 18 | N/L | 1.44 | 1.42 | 44.5 | 2.3 | 4.6 | A | A | 0.8 |
| | H/H | 1.39 | 1.36 | 34.5 | 1.7 | 3.2 | A | B | 1.2 |
| 19 | N/L | 1.42 | 1.40 | 40.0 | 2.5 | 5.1 | A | A | 0.9 |
| | H/H | 1.37 | 1.33 | 32.8 | 1.8 | 3.6 | A | B | 1.4 |
| 20 | N/L | 1.40 | 1.33 | 31.2 | 3.0 | 7.1 | B | C | 1.2 |
| | H/H | 1.35 | 1.27 | 24.6 | 2.1 | 4.0 | D | D | 1.5 |

TABLE 4

| sample Comparative Example: | environ-ment | 5 mm square density | solid density | toner charge quantity | paper fogging | drum fogging | white band | scattering | film scraping |
|---|---|---|---|---|---|---|---|---|---|
| | | | | initial stage | | | | | |
| 1 | N/L | 1.43 | 1.40 | 27.8 | 3.1 | 6.3 | A | B | |
| | H/H | 1.30 | 1.20 | 19.5 | 2.1 | 4.5 | B | D | |
| 2 | N/L | 1.45 | 1.45 | 44.8 | 1.3 | 2.7 | A | A | |
| | H/H | 1.42 | 1.42 | 33.8 | 1.0 | 2.2 | A | A | |
| 3 | N/L | 1.43 | 1.42 | 42.5 | 1.9 | 4.7 | A | A | |
| | H/H | 1.39 | 1.38 | 34.2 | 1.2 | 2.6 | A | A | |
| 4 | N/L | 1.35 | 1.31 | 37.8 | 3.0 | 5.8 | A | A | |
| | H/H | 1.32 | 1.29 | 30.3 | 1.8 | 4.0 | A | B | |
| 5 | N/L | 1.43 | 1.42 | 35.5 | 1.2 | 2.7 | A | A | |
| | H/H | 1.37 | 1.34 | 26.1 | 0.9 | 1.9 | A | B | |
| 6 | N/L | 1.30 | 1.19 | 22.7 | 3.7 | 7.5 | B | C | |
| | H/H | 1.17 | 1.08 | 15.4 | 2.9 | 4.6 | F | F | |
| 7 | N/L | 1.35 | 1.17 | 27.8 | 4.5 | 10.1 | B | C | |
| | H/H | 1.15 | 1.07 | 22.1 | 3.0 | 7.2 | C | D | |
| | | | | after 1,500-sheet copying | | | | | |
| 1 | N/L | 0.98 | 0.45 | 27.1 | 3.9 | 10.1 | E | E | |
| | H/H | 0.41 | — | 15.1 | 2.7 | 5.8 | F | G | |
| 2 | N/L | 1.39 | 1.36 | 37.2 | 2.2 | 4.8 | A | B | |
| | H/H | 1.35 | 1.27 | 30.1 | 1.8 | 3.9 | C | D | |
| 3 | N/L | 1.40 | 1.38 | 34.2 | 2.7 | 6.8 | A | A | |
| | H/H | 1.25 | 0.99 | 20.3 | 1.3 | 3.0 | F | F | |
| 4 | N/L | 1.33 | 1.29 | 39.1 | 3.8 | 7.4 | B | C | |
| | H/H | 0.88 | 0.57 | 21.5 | 3.3 | 5.4 | F | F | |
| 5 | N/L | 1.32 | 1.22 | 30.0 | 3.9 | 9.8 | C | C | |
| | H/H | 0.49 | — | 17.3 | 2.1 | 4.3 | F | F | |
| 6 | N/L | 0.62 | — | 22.7 | 4.0 | 13.7 | E | E | |
| | H/H | 0.43 | — | 7.3 | — | — | F | G | |
| 7 | N/L | 0.78 | — | 23.1 | 5.2 | 20.1 | E | F | |
| | H/H | 0.47 | — | 8.4 | — | — | F | G | |
| | | | | after 3,000-sheet copying | | | | | |
| 1 | N/L | 0.53 | — | 24.3 | — | — | F | F | 0.7 |
| | H/H | 0.43 | — | 9.8 | — | — | F | G | 1.2 |
| 2 | N/L | 1.25 | 1.05 | 27.3 | 4.1 | 9.8 | D | C | 0.7 |
| | H/H | 0.42 | — | 11.3 | — | — | F | G | 1.3 |
| 3 | N/L | 1.27 | 1.18 | 26.2 | 4.5 | 10.2 | D | C | 1.1 |
| | H/H | 0.51 | — | 9.5 | — | — | F | G | 1.7 |
| 4 | N/L | 1.05 | 0.78 | 25.8 | 4.7 | 12.9 | D | D | 1.5 |
| | H/H | 0.78 | 0.54 | 15.4 | 3.5 | 5.5 | F | F | 2.2 |
| 5 | N/L | 0.87 | 0.52 | 25.3 | 5.2 | 13.4 | E | E | 2.6 |
| | H/H | 0.44 | — | 8.4 | — | — | F | G | 3.8 |
| 6 | N/L | 0.42 | — | 15.3 | — | — | F | F | 0.6 |
| | H/H | 0.45 | — | 4.0 | — | — | F | G | 1.0 |
| 7 | N/L | 0.42 | — | 16.8 | — | — | F | F | — |
| | H/H | 0.47 | — | 3.5 | — | — | F | G | — |

TABLE 5

| sample | sleeve | binder resin | monomer 1 *0 | monomer 2 *1 | molar ratio *2 | Mw | Mn | Mw/Mn |
|---|---|---|---|---|---|---|---|---|
| Example: | | | | | | | | |
| 22 | a | copolymer a | MMA | DM | 90:10 | 11300 | 4900 | 2.3 |
| 23 | b | copolymer b | MMA | DM | 95:5 | 13500 | 6100 | 2.2 |
| 24 | d | copolymer d | MMA | DM | 90:10 | 4500 | 2600 | 1.7 |
| 25 | e | copolymer e | MMA | DM | 90:10 | 23400 | 9400 | 2.5 |
| 26 | g | copolymer a | MMA | DM | 90:10 | 11300 | 4900 | 2.3 |
| 27 | h | copolymer a | MMA | DM | 90:10 | 11300 | 4900 | 2.3 |
| 28 | l | copolymer g | MMA | DE | 90:10 | 12000 | 5600 | 2.1 |
| 29 | j | copolymer a | MMA | DM | 90:10 | 11300 | 4900 | 2.3 |
| 30 | k | copolymer a | MMA | DM | 90:10 | 11300 | 4900 | 2.3 |
| Comparative Example: | | | | | | | | |
| 9 | c | single polymer C | MMA | — | 100:0 | 11100 | 4800 | 2.3 |
| 10 | f | copolymer f | MMA | DM | 90:10 | 2600 | 1500 | 1.7 |
| 11 | l | — | — | — | — | — | — | — |
| 12 | m | — | — | — | — | — | — | — |
| 13 | n | — | — | — | — | — | — | — |

| sample | conductive fine powder carbon (parts)*3 | graphite (parts)*4 | notes *5 | volume resistivity (Ω · cm) | surface roughness Ra(μm) |
|---|---|---|---|---|---|
| Example: | | | | | |
| 22 | 3 | 30 | | 25.6 | 0.98 |
| 23 | 3 | 30 | | 27.8 | 1.05 |
| 24 | 3 | 30 | | 22.1 | 0.82 |
| 25 | 3 | 30 | | 30.1 | 1.44 |
| 26 | 3 | 30 | | 16.7 | 1.76 |
| 27 | 3 | 30 | | 15.8 | 0.69 |
| 28 | 3 | 30 | | 19.7 | 0.89 |
| 29 | 5 | 45 | | 5.3 | 0.81 |
| 30 | 6 | 60 | | 0.45 | 0.87 |
| Comparative Example: | | | | | |
| 9 | 3 | 30 | | 29.2 | 0.23 |
| 10 | 3 | 30 | | 21.9 | 0.79 |
| 11 | 3 | 30 | phenol | 9.8 | 1.75 |
| 12 | 3 | 30 | phenol | 9.2 | 0.69 |
| 13 | | | sand blast | | 1.01 |

*0 MMA: methyl methacrylate monomer
*1 DM: methylaminoethyl methacrylate monomer
DE: ethylaminoethyl methacrylate monomer
*2 molar ratio of monomer 1 to monomer 2
*3 and *4 parts by weight based on 100 parts by weight of resin
*5 other resin or production process

TABLE 6

| sample Example: | environ-ment | 5 mm square density | solid density | toner charge quantity | ghost | fogging | unevenness | soiling |
|---|---|---|---|---|---|---|---|---|
| | | | | initial stage | | | | |
| 21 | N/L | 1.50 | 1.49 | −18.0 | B | 1.8 | A | |
| | H/H | 1.46 | 1.45 | −14.9 | A | 1.0 | A | |
| 22 | N/L | 1.50 | 1.48 | −15.5 | B | 1.9 | A | |
| | H/H | 1.46 | 1.45 | −12.6 | A | 1.2 | A | |
| 23 | N/L | 1.49 | 1.48 | −18.2 | B | 1.8 | A | |
| | H/H | 1.45 | 1.44 | −15.2 | A | 0.9 | A | |
| 24 | N/L | 1.48 | 1.47 | −13.9 | A | 1.7 | A | |
| | H/H | 1.45 | 1.43 | −11.0 | A | 1.0 | A | |
| 25 | N/L | 1.45 | 1.43 | −12.5 | A | 2.0 | A | |
| | H/H | 1.42 | 1.40 | −9.8 | ND | 2.1 | A | |
| 26 | N/L | 1.50 | 1.49 | −18.5 | B | 1.8 | A | |
| | H/H | 1.46 | 1.45 | −15.0 | A | 0.9 | A | |
| 27 | N/L | 1.50 | 1.49 | −17.5 | B | 2.0 | A | |
| | H/H | 1.46 | 1.44 | −14.1 | A | 1.0 | A | |

TABLE 6-continued

| sample Example: | environ-ment | 5 mm square density | solid density | toner charge quantity | ghost | fogging | unevenness | soiling |
|---|---|---|---|---|---|---|---|---|
| 28 | N/L | 1.50 | 1.49 | −15.0 | A | 1.9 | A | |
| | H/H | 1.45 | 1.43 | −11.9 | A | 1.3 | A | |
| 29 | N/L | 1.48 | 1.46 | −13.2 | A | 2.2 | A | |
| | H/H | 1.45 | 1.40 | −10.1 | NB | 1.8 | A | |
| | | | after 2,000-sheet copying | | | | | |
| 21 | N/L | 1.49 | 1.48 | −17.5 | B | 1.9 | A | |
| | H/H | 1.45 | 1.44 | −14.3 | A | 1.2 | A | |
| 22 | N/L | 1.48 | 1.47 | −14.3 | B | 2.1 | A | |
| | H/H | 1.45 | 1.43 | −11.2 | A | 1.4 | A | |
| 23 | N/L | 1.49 | 1.48 | −15.9 | B | 1.8 | A | |
| | H/H | 1.42 | 1.39 | −13.0 | A | 0.9 | A | |
| 24 | N/L | 1.47 | 1.45 | −13.2 | A | 1.7 | A | |
| | H/H | 1.43 | 1.40 | −11.2 | A | 1.0 | A | |
| 25 | N/L | 1.45 | 1.43 | −12.5 | A | 2.3 | A | |
| | H/H | 1.40 | 1.37 | −9.7 | NB | 1.8 | A | |
| 26 | N/L | 1.49 | 1.48 | −17.1 | B | 1.8 | A | |
| | H/H | 1.45 | 1.44 | −14.4 | A | 1.2 | A | |
| 27 | N/L | 1.50 | 1.48 | −17.2 | B | 2.0 | A | |
| | H/H | 1.46 | 1.44 | −14.0 | A | 1.2 | A | |
| 28 | N/L | 1.48 | 1.46 | −14.1 | A | 2.0 | A | |
| | H/H | 1.42 | 1.39 | −11.2 | A | 1.5 | A | |
| 29 | N/L | 1.47 | 1.45 | −12.3 | A | 2.5 | A | |
| | H/H | 1.45 | 1.42 | −9.9 | A | 1.7 | A | |
| | | | after 4,000-sheet copying | | | | | |
| 21 | N/L | 1.49 | 1.48 | −16.7 | B | 2.1 | A | B |
| | H/H | 1.44 | 1.43 | −13.2 | A | 1.5 | A | A |
| 22 | N/L | 1.49 | 1.48 | −13.9 | B | 2.3 | A | B |
| | H/H | 1.44 | 1.43 | −11.0 | B | 1.6 | A | A |
| 23 | N/L | 1.47 | 4.45 | −15.9 | B | 2.3 | A | B |
| | H/H | 1.40 | 1.37 | −12.8 | B | 1.5 | A | C |
| 24 | N/L | 1.45 | 1.42 | −12.5 | B | 2.0 | A | B |
| | H/H | 1.39 | 1.35 | −9.8 | A | 1.3 | A | A |
| 25 | N/L | 1.44 | 1.42 | −12.1 | A | 2.7 | A | C |
| | H/H | 1.35 | 1.30 | −9.2 | NB | 2.5 | A | C |
| 26 | N/L | 1.48 | 1.46 | −16.7 | B | 2.2 | A | B |
| | H/H | 1.43 | 1.42 | −13.6 | B | 1.3 | A | A |
| 27 | N/L | 1.48 | 1.46 | −16.0 | B | 2.3 | A | B |
| | H/H | 1.44 | 1.42 | −12.9 | A | 1.4 | A | A |
| 28 | N/L | 1.48 | 1.46 | −13.5 | A | 2.1 | A | A |
| | H/H | 1.40 | 1.37 | −10.6 | A | 1.9 | A | A |
| 29 | N/L | 1.46 | 1.43 | −11.0 | A | 2.8 | A | A |
| | H/H | 1.39 | 1.35 | −8.2 | NB | 2.7 | A | B |

TABLE 7

| sample Comparative Example: | environ-ment | 5 mm sguare density | solid density | toner charge quantity | ghost | fogging | unevenness | soiling |
|---|---|---|---|---|---|---|---|---|
| | | | | initial stage | | | | |
| 9 | N/L | 1.37 | 1.33 | −6.2 | NE | 2.2 | C | |
| | H/H | 1.27 | 1.23 | −5.0 | NE | 1.2 | A | |
| 10 | N/L | 1.50 | 1.48 | −16.5 | B | 1.8 | A | |
| | H/H | 1.46 | 1.45 | −13.3 | A | 0.9 | A | |
| 11 | N/L | 1.40 | 1.35 | −5.5 | NC | 3.0 | A | |
| | H/H | 1.28 | 1.20 | −3.9 | NF | 1.9 | A | |
| 12 | N/L | 1.37 | 1.33 | −6.0 | NE | 2.3 | C | |
| | H/H | 1.28 | 1.25 | −5.1 | NE | 1.3 | A | |
| 13 | N/L | 1.33 | 1.28 | −15.5 | F | 3.5 | D | |
| | H/H | 1.40 | 1.29 | −10.1 | D | 1.8 | C | |
| | | | after 2,000-sheet copying | | | | | |
| 9 | N/L | 1.39 | 1.34 | −6.9 | NC | 2.5 | D | |
| | H/H | 1.27 | 1.21 | −6.0 | NE | 1.4 | A | |
| 10 | N/L | 1.48 | 1.45 | −13.8 | B | 1.9 | A | |
| | H/H | 1.44 | 1.40 | −10.1 | A | 1.5 | A | |
| 11 | N/L | 1.30 | 1.17 | −6.5 | NC | 2.3 | A | |
| | H/H | 1.11 | 0.97 | −4.8 | NF | 1.9 | A | |
| 12 | N/L | 1.24 | 1.11 | −6.8 | NC | 2.3 | D | |
| | H/H | 1.17 | 0.97 | −4.9 | NE | 1.5 | A | |

TABLE 7-continued

| sample Comparative Example: | environ-ment | 5 mm sguare density | solid density | toner charge quantity | ghost | fogging | unevenness | soiling |
|---|---|---|---|---|---|---|---|---|
| 13 | N/L | 1.01 | 0.92 | −10.1 | G | 3.9 | E | |
| | H/H | 1.21 | 1.03 | −9.2 | E | 2.0 | D | |
| | | | after 4,000-sheet copying | | | | | |
| 9 | N/L | 1.30 | 1.20 | −5.0 | NE | 4.1 | E | E |
| | H/H | 1.01 | 0.87 | −3.4 | NF | 2.5 | C | H |
| 10 | N/L | 1.40 | 1.32 | −11.9 | B | 2.5 | C | D |
| | H/H | 1.21 | 1.07 | −6.3 | NF | 2.7 | B | F |
| 11 | N/L | 1.17 | 1.00 | −4.2 | NE | 4.1 | A | C |
| | H/H | 1.01 | 0.80 | −3.2 | NF | 1.9 | A | E |
| 12 | N/L | 1.29 | 1.20 | −4.1 | NF | 3.8 | E | E |
| | H/H | 0.98 | 0.54 | −2.9 | NF | 2.8 | C | F |
| 13 | N/L | 0.89 | 0.55 | −5.6 | NC | 4.2 | E | D |
| | H/H | 1.10 | 0.89 | −5.3 | NC | 2.1 | B | C |

TABLE 8

| sample | sleeve | binder resin | molar ratio *1 | Mw | Mn | Mw/Mn |
|---|---|---|---|---|---|---|
| Example: | | | | | | |
| 31 | 1 | copolymer 1 | 90:10 | 10300 | 4500 | 2.3 |
| 32 | 2 | copolymer 2 | 90:10 | 10500 | 4300 | 2.4 |
| 33 | 4 | copolymer 4 | 95:5 | 10400 | 4500 | 2.3 |
| 34 | 5 | copolymer 5 | 85:15 | 10600 | 4600 | 2.3 |
| 35 | 6 | copolymer 6 | 80:20 | 10700 | 4200 | 2.5 |
| 36 | 7 | copolymer 7 | 90:10 | 20500 | 6000 | 3.4 |
| 37 | 8 | copolymer 8 | 90:10 | 48500 | 15000 | 3.2 |
| 38 | 9 | copolymer 9 | 90:10 | 6000 | 1900 | 3.2 |
| 39 | 10 | copolymer 10 | 90:10 | 3500 | 1300 | 2.7 |
| 40 | 13 | copolymer 1 | 90:10 | 10300 | 4500 | 2.3 |
| 41 | 14 | copolymer 13 | 90:10 | 11000 | 3000 | 3.7 |
| 42 | 15 | copolymer 1 | 90:10 | 10300 | 4500 | 2.3 |
| 43 | 16 | copolymer 1 | 90:10 | 10300 | 4500 | 2.3 |
| 44 | 17 | copolymer 1 | 90:10 | 10300 | 4500 | 2.3 |
| 45 | 18 | copolymer 1 | 90:10 | 10300 | 4500 | 2.3 |
| Comparative Example: | | | | | | |
| 14 | 3 | single polymer 3 | 100 | 11600 | 4700 | 2.5 |
| 15 | 11 | copolymer 11 | 90:10 | 2500 | 800 | 3.1 |
| 16 | 12 | copolymer 12 | 90:10 | 60000 | 16000 | 3.8 |
| 17 | 19 | — | — | — | | |
| 18 | 20 | | no resin layer | | | |

| sample | carbon *2 | graphite *3 | volume resistivity (Ω · cm) | center line average roughness Ra(μm) |
|---|---|---|---|---|
| Example: | | | | |
| 31 | — | 40 | 12.8 | 1.35 |
| 32 | — | 40 | 10.5 | 1.31 |
| 33 | — | 40 | 13.4 | 1.29 |
| 34 | — | 40 | 11.9 | 1.39 |
| 35 | — | 40 | 10.8 | 1.28 |
| 36 | — | 40 | 15.4 | 1.42 |
| 37 | — | 40 | 18.3 | 1.53 |
| 38 | — | 40 | 12.1 | 1.20 |
| 39 | — | 40 | 13.5 | 1.23 |
| 40 | 20 | — | 5.7 | 1.05 |
| 41 | — | 40 | 12.4 | 1.38 |
| 42 | 5 | 35 | 7.5 | 1.26 |
| 43 | — | 33 | 25.1 | 1.27 |
| 44 | — | 25 | 92.3 | 1.10 |
| 45 | — | 70 | 0.6 | 1.56 |

TABLE 8-continued

| Comparative Example: | | | | |
|---|---|---|---|---|
| 14 | — | 40 | 14.6 | 1.37 |
| 15 | — | 40 | 12.1 | 1.33 |
| 16 | — | 40 | 17.3 | 1.43 |
| 17 | — | 40 | 13.8 | 1.20 |
| 18 | | no resin layer | | 1.35 |

*1: molar ratio of quaternary ammonium group containing vinyl monomer to methyl methacrylate

*2 and *3: parts by weight based on 100 parts by weight of resin

TABLE 9

| sample | environ-ment | 5 mm square density | solid density | toner charge quantity | white band | film scraping |
|---|---|---|---|---|---|---|
| | | | initial stage | | | |
| Example: | | | | | | |
| 31 | N/L | 1.45 | 1.45 | 48.3 | A | |
| | H/H | 1.43 | 1.42 | 38.2 | A | |
| 32 | N/L | 1.45 | 1.45 | 45.8 | A | |
| | H/H | 1.43 | 1.44 | 36.7 | A | |
| 33 | N/L | 1.42 | 1.42 | 42.3 | A | |
| | H/H | 1.42 | 1.43 | 35.8 | A | |
| 34 | N/L | 1.45 | 1.44 | 45.3 | A | |
| | H/H | 1.39 | 1.38 | 31.2 | A | |
| 35 | N/L | 1.45 | 1.44 | 44.3 | A | |
| | H/H | 1.43 | 1.43 | 33.6 | A | |
| 36 | N/L | 1.44 | 1.44 | 46.3 | A | |
| | H/H | 1.42 | 1.41 | 34.2 | A | |
| 37 | N/L | 1.44 | 1.44 | 44.6 | A | |
| | H/H | 1.42 | 1.40 | 36.2 | A | |
| 38 | N/L | 1.45 | 1.44 | 43.8 | A | |
| | H/H | 1.43 | 1.43 | 30.1 | A | |
| 39 | N/L | 1.45 | 1.44 | 45.8 | A | |
| | H/H | 1.43 | 1.42 | 31.3 | A | |
| 40 | N/L | 1.45 | 1.45 | 40.8 | A | |
| | H/H | 1.44 | 1.43 | 36.4 | A | |
| 41 | N/L | 1.45 | 1.44 | 42.4 | A | |
| | H/H | 1.43 | 1.42 | 34.9 | A | |
| 42 | N/L | 1.45 | 1.45 | 43.2 | A | |
| | H/H | 1.44 | 1.44 | 35.9 | A | |

TABLE 9-continued

| sample | environ-ment | 5 mm square density | solid density | toner charge quantity | white band | film scraping |
|---|---|---|---|---|---|---|
| 43 | N/L | 1.45 | 1.45 | 41.1 | A | |
| | H/H | 1.44 | 1.43 | 34.0 | A | |
| 44 | N/L | 1.42 | 1.40 | 44.6 | A | |
| | H/H | 1.40 | 1.38 | 38.2 | A | |
| 45 | N/L | 1.45 | 1.45 | 39.4 | B | |
| | H/H | 1.43 | 1.43 | 31.3 | A | |
| Comparative Example: | | | | | | |
| 14 | N/L | 1.43 | 1.41 | 44.3 | A | |
| | H/H | 1.44 | 1.42 | 41.5 | B | |
| 15 | N/L | 1.32 | 1.29 | 23.9 | B | |
| | H/H | 1.25 | 1.21 | 17.2 | C | |
| 16 | N/L | 1.43 | 1.40 | 42.5 | A | |
| | H/H | 1.39 | 1.38 | 35.1 | B | |
| 17 | N/L | 1.20 | 1.12 | 25.2 | B | |
| | H/H | 1.13 | 1.05 | 23.9 | C | |
| 18 | N/L | 1.10 | 1.05 | 28.4 | C | |
| | H/H | 1.05 | 0.80 | 24.6 | D | |
| | | after 1,500-sheet copying | | | | |
| Example: | | | | | | |
| 31 | N/L | 1.45 | 1.45 | 48.1 | A | |
| | H/H | 1.44 | 1.43 | 38.3 | A | |
| 32 | N/L | 1.45 | 1.46 | 41.9 | A | |
| | H/H | 1.43 | 1.42 | 38.2 | A | |
| 33 | N/L | 1.45 | 1.44 | 39.8 | A | |
| | H/H | 1.43 | 1.43 | 37.1 | A | |
| 34 | N/L | 1.44 | 1.42 | 42.4 | B | |
| | H/H | 1.39 | 1.37 | 30.7 | D | |
| 35 | N/L | 1.45 | 1.45 | 43.2 | B | |
| | H/H | 1.44 | 1.42 | 35.1 | B | |
| 36 | N/L | 1.45 | 1.43 | 45.1 | A | |
| | H/H | 1.43 | 1.42 | 35.4 | B | |
| 37 | N/L | 1.44 | 1.43 | 42.3 | A | |
| | H/H | 1.40 | 1.39 | 32.6 | B | |
| 38 | N/L | 1.43 | 1.42 | 38.1 | B | |
| | H/H | 1.37 | 1.35 | 28.4 | B | |
| 39 | N/L | 1.42 | 1.40 | 34.5 | B | |
| | H/H | 1.38 | 1.36 | 26.5 | B | |
| 40 | N/L | 1.44 | 1.40 | 39.3 | A | |
| | H/H | 1.43 | 1.42 | 35.7 | A | |
| 41 | N/L | 1.45 | 1.43 | 47.3 | B | |
| | H/H | 1.44 | 1.44 | 36.2 | B | |
| 42 | N/L | 1.45 | 1.42 | 42.1 | A | |
| | H/H | 1.43 | 1.43 | 34.6 | A | |
| 43 | N/L | 1.44 | 1.44 | 38.0 | B | |
| | H/H | 1.43 | 1.42 | 32.7 | B | |
| 44 | N/L | 1.42 | 1.37 | 40.1 | B | |
| | H/H | 1.38 | 1.38 | 39.4 | B | |
| 45 | N/L | 1.43 | 1.44 | 36.8 | C | |
| | H/H | 1.41 | 1.42 | 30.6 | C | |
| Comparative Example: | | | | | | |
| 14 | N/L | 1.42 | 1.41 | 40.8 | B | |
| | H/H | 1.42 | 1.42 | 33.9 | B | |
| 15 | N/L | 1.18 | 1.10 | 19.8 | E | |
| | H/H | 1.00 | 0.80 | 11.5 | F | |
| 16 | N/L | 1.37 | 1.37 | 40.2 | D | |
| | H/H | 1.36 | 1.34 | 34.7 | C | |
| 17 | N/L | 0.80 | 0.65 | 10.6 | E | |
| | H/H | 0.59 | — | 11.3 | E | |
| 18 | N/L | 0.58 | — | 6.7 | E | |
| | H/H | 0.60 | — | 5.2 | F | |

TABLE 9-continued

| sample | environ-ment | 5 mm square density | solid density | toner charge quantity | white band | film scraping |
|---|---|---|---|---|---|---|
| | | after 5,000-sheet copying | | | | |
| Example: | | | | | | |
| 31 | N/L | 1.44 | 1.43 | 46.8 | A | 0.8 |
| | H/H | 1.38 | 1.37 | 34.8 | A | 1.3 |
| 32 | N/L | 1.43 | 1.44 | 45.1 | A | 0.9 |
| | H/H | 1.41 | 1.39 | 34.8 | A | 1.4 |
| 33 | N/L | 1.43 | 1.43 | 44.1 | A | 0.8 |
| | H/H | 1.42 | 1.39 | 31.8 | B | 1.2 |
| 34 | N/L | 1.40 | 1.39 | 46.1 | B | 1.4 |
| | H/H | 1.40 | 1.37 | 31.2 | C | 1.4 |
| 35 | N/L | 1.41 | 1.40 | 40.5 | B | 1.6 |
| | H/H | 1.39 | 1.35 | 30.1 | B | 1.8 |
| 36 | N/L | 1.42 | 1.40 | 42.8 | A | 0.8 |
| | H/H | 1.38 | 1.34 | 31.9 | B | 1.0 |
| 37 | N/L | 1.40 | 1.38 | 35.2 | B | 0.7 |
| | H/H | 1.38 | 1.38 | 30.7 | B | 1.0 |
| 38 | N/L | 1.40 | 1.37 | 32.6 | C | 1.8 |
| | H/H | 1.33 | 1.30 | 27.3 | C | 1.8 |
| 39 | N/L | 1.38 | 1.35 | 31.0 | C | 2.1 |
| | H/H | 1.31 | 1.28 | 25.1 | C | 1.9 |
| 40 | N/L | 1.43 | 1.41 | 37.6 | B | 0.8 |
| | H/H | 1.40 | 1.38 | 35.1 | B | 1.0 |
| 41 | N/L | 1.41 | 1.40 | 41.5 | C | 1.7 |
| | H/H | 1.38 | 1.35 | 31.6 | C | 1.8 |
| 42 | N/L | 1.43 | 1.41 | 44.1 | A | 1.1 |
| | H/H | 1.40 | 1.39 | 33.3 | A | 1.0 |
| 43 | N/L | 1.43 | 1.40 | 37.9 | B | 1.2 |
| | H/H | 1.37 | 1.35 | 28.3 | B | 1.5 |
| 44 | N/L | 1.37 | 1.31 | 46.8 | B | 0.6 |
| | H/H | 1.35 | 1.32 | 38.9 | C | 0.6 |
| 45 | N/L | 1.44 | 1.43 | 37.2 | D | 2.9 |
| | H/H | 1.39 | 1.37 | 25.1 | D | 2.5 |
| Comparative Example: | | | | | | |
| 14 | N/L | 1.41 | 1.40 | 39.2 | B | 1.4 |
| | H/H | 1.39 | 1.39 | 35.3 | C | 1.3 |
| 15 | N/L | 0.60 | — | 15.3 | F | 5.7 |
| | H/H | 0.40 | — | 4.3 | F | 7.3 |
| 16 | N/L | 1.37 | 1.35 | 37.1 | E | 1.3 |
| | H/H | 1.30 | 1.28 | 30.4 | E | 1.5 |
| 17 | N/L | 0.65 | — | 2.8 | F | 1.2 |
| | H/H | 0.50 | — | — | F | 1.6 |
| 18 | N/L | 0.52 | — | 3.8 | F | — |
| | H/H | 0.40 | — | — | F | — |

TABLE 10

| sample | sleeve | copolymer | terpolymer component monomer (1) | monomer (2) | monomer (3) | monomer ratio (1):(2):(3) (molar ratio) | Mw *1 | Mn *2 | Mw/Mn |
|---|---|---|---|---|---|---|---|---|---|
| Example: | | | | | | | | | |
| 46 | 21 | 14 | MMA | DM | AA | 90:5:5 | 10,200 | 4,400 | 2.3 |
| 47 | 22 | 15 | MMA | DM | AA | 85:8:7 | 10,300 | 4,500 | 2.3 |
| 48 | 23 | 16 | MMA | DM | AA | 95:3:2 | 10,200 | 4,500 | 2.3 |
| 49 | 24 | 17 | MMA | DM | AA | 80:10:10 | 19,000 | 9,800 | 1.9 |
| 50 | 25 | 18 | MMA | DM | AA | 80:15:5 | 9,800 | 4,500 | 2.2 |
| 51 | 26 | 19 | MMA | DM | AA | 90:7:3 | 10,000 | 4,600 | 2.2 |
| 52 | 31 | 24 | MMA | DM | AA | 90:5:5 | 3,200 | 2,200 | 1.5 |
| 53 | 32 | 25 | MMA | DM | AA | 90:5:5 | 7,100 | 3,500 | 2.0 |
| 54 | 33 | 26 | MMA | DM | AA | 90:5:5 | 22,000 | 9,800 | 2.2 |
| 55 | 34 | 27 | MMA | DM | AA | 90:5:5 | 44,000 | 19,000 | 2.3 |
| 56 | 39 | 14 | MMA | DM | AA | 90:5:5 | 10,200 | 4,400 | 2.3 |
| 57 | 40 | 30 | MMA | DM | AA | 90:5:5 | 13,600 | 3,700 | 3.7 |
| 58 | 41 | 14 | MMA | DM | AA | 90:5:5 | 10,200 | 4,400 | 2.3 |
| 59 | 42 | 14 | MMA | DM | AA | 90:5:5 | 10,200 | 4,400 | 2.3 |
| 60 | 43 | 14 | MMA | DM | AA | 90:5:5 | 10,200 | 4,400 | 2.3 |
| 61 | 44 | 14 | MMA | DM | AA | 90:5:5 | 10,200 | 4,400 | 2.3 |
| 62 | 45 | 14 | MMA | DM | AA | 90:5:5 | 10,200 | 4,400 | 2.3 |
| 63 | 46 | 31 | MMA | DE | AA | 90:5:5 | 10,500 | 4,200 | 2.5 |
| 64 | 47 | 32 | MMA | DE | MA | 90:5:5 | 10,300 | 4,300 | 2.4 |
| 65 | 48 | 33 | MMA | DB | AA | 90:5:5 | 12,700 | 5,600 | 2.3 |
| 66 | 49 | 34 | MMA | DB | MB | 90:5:5 | 12,300 | 5,300 | 2.3 |
| 67 | 50 | 35 | MMA | DS | AA | 90:5:5 | 10,800 | 4,500 | 2.4 |
| 68 | 51 | 36 | MMA | DS | MB | 90:5:5 | 11,200 | 4,300 | 2.6 |
| 69 | 52 | 37 | MMA | DM | MA | 90:5:5 | 10,600 | 4,200 | 2.5 |
| 70 | 53 | 38 | MMA | DM | MB | 90:5:5 | 10,800 | 4,300 | 2.5 |
| Comparative Example: | | | | | | | | | |
| 19 | 27 | 20 | MMA | DM | AA | 70:20:10 | 10,100 | 3,200 | 3.2 |
| 20 | 28 | 21 | MMA | DM | AA | 60:30:10 | 10,300 | 3,500 | 2.9 |
| 21 | 29 | 22 | MMA | — | — | 100:0:0 | 12,000 | 4,900 | 2.4 |
| 22 | 30 | 23 | MMA | DM | AA | 90:5:5 | 2,700 | 1,300 | 2.1 |
| 23 | 35 | 28 | MMA | DM | AA | 90:5:5 | 61,000 | 24,000 | 2.5 |
| 24 | 36 | 29 | styrene | DM | AA | 90:5:5 | 21,000 | 9,700 | 2.2 |
| 25 | 37 | | | | phenol resin intermediate | | | | |
| 26 | 38 | | | | no resin layer | | | | |

*1 Mw: weight average molecular weight
*2 Mn: number average molecular weight

TABLE 11

| sample | sleeve | carbon *1 | graphite *2 | volume resistivity of resin layer (Ω · cm) | center line average roughness (Ra) (μm) |
|---|---|---|---|---|---|
| Example: | | | | | |
| 46 | 21 | — | 25 | 58.7 | 0.48 |
| 47 | 22 | — | 25 | 56.3 | 0.55 |
| 48 | 23 | — | 25 | 61.5 | 0.56 |
| 49 | 24 | — | 25 | 63.3 | 0.82 |
| 50 | 25 | — | 25 | 49.8 | 0.49 |
| 51 | 26 | — | 25 | 46.8 | 0.51 |
| 52 | 31 | — | 25 | 52.1 | 0.51 |
| 53 | 32 | — | 25 | 53.4 | 0.54 |
| 54 | 33 | — | 25 | 65.7 | 0.86 |
| 55 | 34 | — | 25 | 68.2 | 1.03 |
| 56 | 39 | 16 | — | 25.2 | 0.72 |
| 57 | 40 | — | 25 | 52.8 | 0.62 |
| 58 | 41 | 4 | 16 | 46.3 | 0.57 |
| 59 | 42 | — | 50 | 5.7 | 0.75 |
| 60 | 43 | — | 20 | 375 | 0.45 |
| 61 | 44 | — | 12.5 | $1.2 \times 10^3$ | 0.43 |
| 62 | 45 | — | 5 | $6.3 \times 10^5$ | 0.41 |
| 63 | 46 | — | 25 | 56.9 | 0.52 |
| 64 | 47 | — | 25 | 53.4 | 0.55 |
| 65 | 48 | — | 25 | 58.4 | 0.57 |

TABLE 11-continued

| sample | sleeve | carbon *1 | graphite *2 | volume resistivity of resin layer (Ω · cm) | center line average roughness (Ra) (μm) |
|---|---|---|---|---|---|
| 66 | 49 | — | 25 | 56.3 | 0.61 |
| 67 | 50 | — | 25 | 69.2 | 0.85 |
| 68 | 51 | — | 25 | 65.3 | 0.87 |
| 69 | 52 | — | 25 | 52.6 | 0.56 |
| 70 | 53 | — | 25 | 53.4 | 0.53 |
| Comparative Example: | | | | | |
| 19 | 27 | — | 25 | 51.8 | 0.59 |
| 20 | 28 | — | 25 | 53.4 | 0.53 |
| 21 | 29 | — | 25 | 68.3 | 0.68 |
| 22 | 30 | — | 25 | 55.3 | 0.44 |
| 23 | 35 | — | 25 | 89.6 | 1.21 |
| 24 | 36 | — | 25 | 61.3 | 0.52 |
| 25 | 37 | — | 25 | 48.7 | 0.67 |
| 26 | 38 | prepared using sand blast | | | 0.57 |

*1 and *2: parts by weight based on 100 parts by weight of resin

TABLE 12-1

| sample Example: | sleeve | environment | 5 mm square density | solid density | toner charge quantity | white band | film scraping |
|---|---|---|---|---|---|---|---|
| | | | initial stage | | | | |
| 46 | 21 | N/L | 1.61 | 1.60 | 43.2 | A | |
| | | H/H | 1.57 | 1.56 | 37.2 | A | |
| 47 | 22 | N/L | 1.60 | 1.60 | 44.3 | A | |
| | | H/H | 1.57 | 1.57 | 34.8 | A | |
| 48 | 23 | N/L | 1.60 | 1.60 | 39.8 | A | |
| | | H/H | 1.56 | 1.56 | 35.3 | A | |
| 49 | 24 | N/L | 1.60 | 1.58 | 38.7 | A | |
| | | H/H | 1.53 | 1.53 | 34.5 | A | |
| 50 | 25 | N/L | 1.60 | 1.60 | 46.9 | A | |
| | | H/H | 1.58 | 1.57 | 35.8 | A | |
| 51 | 26 | N/L | 1.60 | 1.60 | 47.5 | A | |
| | | H/H | 1.57 | 1.57 | 35.8 | A | |
| 52 | 31 | N/L | 1.60 | 1.60 | 41.6 | A | |
| | | H/H | 1.56 | 1.57 | 35.4 | A | |
| 53 | 32 | N/L | 1.60 | 1.60 | 43.7 | A | |
| | | H/H | 1.57 | 1.57 | 35.4 | A | |
| 54 | 33 | N/L | 1.57 | 1.56 | 41.8 | A | |
| | | H/H | 1.56 | 1.53 | 36.1 | A | |
| 55 | 34 | N/L | 1.60 | 1.60 | 45.1 | A | |
| | | H/H | 1.58 | 1.57 | 38.8 | A | |
| 56 | 39 | N/L | 1.60 | 1.60 | 46.1 | A | |
| | | H/H | 1.57 | 1.57 | 38.3 | A | |
| 57 | 40 | N/L | 1.56 | 1.56 | 35.2 | A | |
| | | H/H | 1.55 | 1.54 | 31.9 | A | |
| 58 | 41 | N/L | 1.60 | 1.58 | 37.9 | A | |
| | | H/H | 1.57 | 1.57 | 36.8 | A | |
| | | | after 1,500-sheets copying | | | | |
| 46 | 21 | N/L | 1.60 | 1.60 | 40.2 | A | |
| | | H/H | 1.58 | 1.58 | 37.4 | A | |
| 47 | 22 | N/L | 1.60 | 1.60 | 42.1 | A | |
| | | H/H | 1.57 | 1.56 | 37.2 | A | |
| 48 | 23 | N/L | 1.60 | 1.58 | 41.3 | A | |
| | | H/H | 1.57 | 1.54 | 34.2 | A | |
| 49 | 24 | N/L | 1.58 | 1.53 | 40.8 | A | |
| | | H/H | 1.53 | 1.51 | 33.7 | A | |
| 50 | 25 | N/L | 1.60 | 1.60 | 42.9 | A | |
| | | H/H | 1.57 | 1.56 | 38.1 | A | |
| 51 | 26 | N/L | 1.60 | 1.60 | 47.2 | A | |
| | | H/H | 1.57 | 1.57 | 36.1 | B | |
| 52 | 31 | N/L | 1.56 | 1.54 | 44.7 | A | |
| | | H/H | 1.53 | 1.51 | 34.0 | B | |
| 53 | 32 | N/L | 1.60 | 1.60 | 48.5 | A | |
| | | H/H | 1.58 | 1.58 | 35.5 | B | |
| 54 | 33 | N/L | 1.57 | 1.56 | 42.3 | A | |
| | | H/H | 1.53 | 1.51 | 31.9 | B | |
| 55 | 34 | N/L | 1.58 | 1.58 | 42.3 | A | |
| | | H/H | 1.57 | 1.56 | 36.5 | B | |
| 56 | 39 | N/L | 1.57 | 1.58 | 45.2 | A | |
| | | H/H | 1.55 | 1.56 | 38.4 | A | |
| 57 | 40 | N/L | 1.57 | 1.56 | 36.3 | A | |
| | | H/H | 1.55 | 1.53 | 33.6 | B | |
| 58 | 41 | N/L | 1.60 | 1.57 | 40.1 | A | |
| | | H/H | 1.56 | 1.54 | 37.9 | A | |
| | | | after 3,000-sheets copying | | | | |
| 46 | 21 | N/L | 1.58 | 1.56 | 43.5 | A | 0.9 |
| | | H/H | 1.53 | 1.51 | 35.4 | A | 1.2 |
| 47 | 22 | N/L | 1.57 | 1.57 | 44.5 | A | 0.9 |
| | | H/H | 1.54 | 1.51 | 34.9 | A | 1.5 |
| 48 | 23 | N/L | 1.57 | 1.55 | 38.3 | A | 1.8 |
| | | H/H | 1.51 | 1.49 | 32.9 | B | 1.2 |
| 49 | 24 | N/L | 1.54 | 1.53 | 38.1 | B | 1.6 |
| | | H/H | 1.51 | 1.49 | 31.7 | C | 1.4 |
| 50 | 25 | N/L | 1.57 | 1.56 | 46.1 | B | 1.9 |
| | | H/H | 1.53 | 1.50 | 35.3 | C | 1.6 |
| 51 | 26 | N/L | 1.58 | 1.58 | 46.2 | B | 1.1 |
| | | H/H | 1.53 | 1.47 | 35.8 | A | 1.4 |
| 52 | 31 | N/L | 1.53 | 1.51 | 38.0 | D | 2.7 |
| | | H/H | 1.45 | 1.43 | 32.0 | D | 1.4 |
| 53 | 32 | N/L | 1.58 | 1.54 | 46.2 | A | 0.8 |
| | | H/H | 1.5o | 1.45 | 33.9 | C | 1.3 |

TABLE 12-1-continued

| sample Example: | sleeve | environment | 5 mm square density | solid density | toner charge quantity | white band | film scraping |
|---|---|---|---|---|---|---|---|
| 54 | 33 | N/L | 1.56 | 1.52 | 35.8 | B | 1.1 |
| | | H/H | 1.50 | 1.46 | 28.6 | B | 1.6 |
| 55 | 34 | N/L | 1.57 | 1.54 | 42.6 | B | 2.2 |
| | | H/H | 1.51 | 1.49 | 35.1 | D | 2.6 |
| 56 | 39 | N/L | 1.58 | 1.57 | 44.9 | A | 0.7 |
| | | H/H | 1.53 | 1.51 | 37.6 | A | 1.3 |
| 57 | 40 | N/L | 1.56 | 1.54 | 34.1 | C | 2.1 |
| | | H/H | 1.51 | 1.49 | 30.3 | D | 1.8 |
| 58 | 41 | N/L | 1.57 | 1.56 | 36.7 | A | 1.3 |
| | | H/H | 1.53 | 1.52 | 34.8 | A | 1.0 |

N/L: 23° C./5% RH
H/H: 30° C./80% RH

TABLE 12-2

| sample Example: | sleeve | environment | 5 mm square density | solid density | toner charge quantity | white band | film scraping |
|---|---|---|---|---|---|---|---|
| | | | initial stage | | | | |
| 59 | 42 | N/L | 1.60 | 1.58 | 42.3 | A | |
| | | H/H | 1.57 | 1.57 | 39.4 | A | |
| 60 | 43 | N/L | 1.58 | 1.58 | 43.2 | A | |
| | | H/H | 1.56 | 1.55 | 38.1 | A | |
| 61 | 44 | N/L | 1.60 | 1.60 | 44.5 | A | |
| | | H/H | 1.57 | 1.57 | 39.1 | A | |
| 62 | 45 | N/L | 1.58 | 1.58 | 45.3 | A | |
| | | H/H | 1.57 | 1.56 | 32.4 | A | |
| 63 | 46 | N/L | 1.57 | 1.57 | 42.6 | A | |
| | | H/H | 1.56 | 1.56 | 36.4 | A | |
| 64 | 47 | N/L | 1.60 | 1.60 | 44.9 | A | |
| | | H/H | 1.58 | 1.57 | 35.6 | A | |
| 65 | 48 | N/L | 1.60 | 1.60 | 46.2 | A | |
| | | H/H | 1.58 | 1.58 | 37.2 | A | |
| 66 | 49 | N/L | 1.60 | 1.60 | 45.0 | A | |
| | | H/H | 1.58 | 1.58 | 36.7 | A | |
| 67 | 50 | N/L | 1.60 | 1.58 | 39.2 | A | |
| | | H/H | 1.58 | 1.57 | 33.1 | A | |
| 68 | 51 | N/L | 1.60 | 1.57 | 41.1 | A | |
| | | H/H | 1.57 | 1.55 | 35.2 | A | |
| 69 | 52 | N/L | 1.57 | 1.56 | 41.9 | A | |
| | | H/H | 1.55 | 1.54 | 35.7 | A | |
| 70 | 53 | N/L | 1.60 | 1.60 | 45.0 | A | |
| | | H/H | 1.58 | 1.58 | 36.7 | A | |
| | | | after 1,500-sheets copying | | | | |
| 59 | 42 | N/L | 1.60 | 1.60 | 40.7 | A | |
| | | H/H | 1.57 | 1.55 | 34.1 | B | |
| 60 | 43 | N/L | 1.54 | 1.52 | 42.1 | C | |
| | | H/H | 1.56 | 1.54 | 36.2 | B | |
| 61 | 44 | N/L | 1.60 | 1.60 | 45.1 | A | |
| | | H/H | 1.55 | 1.57 | 38.1 | A | |
| 62 | 45 | N/L | 1.60 | 1.57 | 43.5 | A | |
| | | H/H | 1.56 | 1.54 | 34.6 | A | |
| 63 | 46 | N/L | 1.57 | 1.54 | 43.3 | A | |
| | | H/H | 1.54 | 1.53 | 37.1 | B | |
| 64 | 47 | N/L | 1.58 | 1.58 | 43.2 | A | |
| | | H/H | 1.58 | 1.57 | 34.5 | B | |
| 65 | 48 | N/L | 1.60 | 1.60 | 44.2 | A | |
| | | H/H | 1.57 | 1.57 | 36.5 | A | |
| 66 | 49 | N/L | 1.60 | 1.57 | 46.2 | A | |
| | | H/H | 1.57 | 1.55 | 34.3 | B | |
| 67 | 50 | N/L | 1.60 | 1.57 | 37.5 | A | |
| | | H/H | 1.57 | 1.54 | 33.4 | A | |
| 68 | 51 | N/L | 1.58 | 1.56 | 40.3 | A | |
| | | H/H | 1.57 | 1.53 | 34.4 | B | |
| 69 | 52 | N/L | 1.54 | 1.53 | 39.8 | A | |
| | | H/H | 1.53 | 1.51 | 36.2 | A | |
| 70 | 53 | N/L | 1.60 | 1.57 | 46.2 | A | |
| | | H/H | 1.57 | 1.57 | 38.4 | B | |

TABLE 12-2-continued

| sample Example: | sleeve | environment | 5 mm square density | solid density | toner charge quantity | white band | film scraping |
|---|---|---|---|---|---|---|---|
| | | | after 3,000-sheets copying | | | | |
| 59 | 42 | N/L | 1.58 | 1.54 | 35.0 | B | 2.0 |
| | | H/H | 1.53 | 1.46 | 30.0 | B | 2.1 |
| 60 | 43 | N/L | 1.53 | 1.51 | 41.6 | D | 0.6 |
| | | H/H | 1.50 | 1.45 | 39.9 | C | 0.7 |
| 61 | 44 | N/L | 1.58 | 1.57 | 44.6 | A | 0.8 |
| | | H/H | 1.52 | 1.51 | 37.1 | A | 1.4 |
| 62 | 45 | N/L | 1.55 | 1.54 | 50.9 | C | 0.9 |
| | | H/H | 1.52 | 1.51 | 35.6 | A | 1.2 |
| 63 | 46 | N/L | 1.53 | 1.52 | 42.4 | B | 1.2 |
| | | H/H | 1.51 | 1.50 | 38.3 | B | 1.3 |
| 64 | 47 | N/L | 1.57 | 1.54 | 42.6 | A | 0.9 |
| | | H/H | 1.51 | 1.50 | 32.6 | B | 1.3 |
| 65 | 48 | N/L | 1.57 | 1.55 | 40.9 | A | 0.8 |
| | | H/H | 1.54 | 1.53 | 34.7 | B | 1.2 |
| 66 | 49 | N/L | 1.56 | 1.57 | 43.1 | B | 0.9 |
| | | H/H | 1.52 | 1.47 | 33.1 | B | 1.3 |
| 67 | 50 | N/L | 1.55 | 1.54 | 35.8 | B | 0.9 |
| | | H/H | 1.52 | 1.50 | 27.1 | B | 1.2 |
| 68 | 51 | N/L | 1.55 | 1.53 | 37.2 | B | 0.8 |
| | | H/H | 1.52 | 1.49 | 28.1 | C | 1.3 |
| 69 | 52 | N/L | 1.53 | 1.51 | 40.1 | A | 0.9 |
| | | H/H | 1.51 | 1.49 | 34.3 | B | 1.3 |
| 70 | 53 | N/L | 1.56 | 1.57 | 43.1 | B | 0.9 |
| | | H/H | 1.54 | 1.52 | 36.1 | B | 1.2 |

N/L: 23° C/5% RH
H/H: 30° C/80% RH

TABLE 12-3

| sample Comparative Example: | sleeve | environment | 5 mm square density | solid density | toner charge quantity | white band | film scraping |
|---|---|---|---|---|---|---|---|
| | | | initial stage | | | | |
| 19 | 27 | N/L | 1.60 | 1.58 | 44.2 | A | |
| | | H/H | 1.58 | 1.57 | 34.7 | A | |
| 20 | 28 | N/L | 1.60 | 1.58 | 45.2 | A | |
| | | H/H | 1.57 | 1.56 | 33.5 | A | |
| 21 | 29 | N/L | 1.45 | 1.43 | 30.5 | B | |
| | | H/H | 1.38 | 1.32 | 22.0 | C | |
| 22 | 30 | N/L | 1.60 | 1.58 | 44.6 | A | |
| | | H/H | 1.57 | 1.56 | 34.7 | A | |
| 23 | 35 | N/L | 1.60 | 1.60 | 44.6 | A | |
| | | H/H | 1.57 | 1.58 | 38.2 | A | |
| 24 | 36 | N/L | 1.57 | 1.56 | 37.9 | A | |
| | | H/H | 1.54 | 1.53 | 29.8 | B | |
| 25 | 37 | N/L | 1.42 | 1.27 | 25.1 | B | |
| | | H/H | 1.21 | 1.19 | 18.3 | C | |
| 26 | 38 | N/L | 1.41 | 1.32 | 29.2 | C | |
| | | H/H | 1.19 | 1.12 | 23.1 | C | |

TABLE 12-3-continued

| sample Comparative Example: | sleeve | environment | 5 mm square density | solid density | toner charge quantity | white band | film scraping |
|---|---|---|---|---|---|---|---|
| | | | after 1,500-sheets copying | | | | |
| 19 | 27 | N/L | 1.58 | 1.58 | 42.3 | B | |
| | | H/H | 1.51 | 1.47 | 29.7 | B | |
| 20 | 28 | N/L | 1.58 | 1.56 | 42.3 | B | |
| | | H/H | 1.52 | 1.49 | 30.9 | B | |
| 21 | 29 | N/L | 1.43 | 1.41 | 27.5 | D | |
| | | H/H | 1.23 | 1.21 | 19.9 | E | |
| 22 | 30 | N/L | 1.58 | 1.58 | 41.5 | B | |
| | | H/H | 1.52 | 1.47 | 30.9 | B | |
| 23 | 35 | N/L | 1.56 | 1.53 | 40.1 | A | |
| | | H/H | 1.54 | 1.52 | 37.6 | B | |
| 24 | 36 | N/L | 1.49 | 1.43 | 29.5 | E | |
| | | H/H | 1.43 | 1.32 | 20.3 | F | |
| 25 | 37 | N/L | 0.72 | — | 21.9 | E | |
| | | H/H | 0.55 | — | 10.3 | E | |
| 26 | 38 | N/L | 0.88 | — | 22.5 | E | |
| | | H/H | 0.57 | — | 9.1 | F | |
| | | | after 3,000-sheets copying | | | | |
| 19 | 27 | N/L | 1.57 | 1.54 | 35.2 | D | 2.2 |
| | | H/H | 1.44 | 1.41 | 29.1 | D | 1.6 |
| 20 | 28 | N/L | 1.56 | 1.55 | 32.8 | D | 2.8 |
| | | H/H | 1.43 | 1.42 | 27.4 | D | 1.8 |
| 21 | 29 | N/L | 1.21 | 1.10 | 19.0 | E | 1.3 |
| | | H/H | 1.08 | 0.86 | 10.0 | F | 1.4 |
| 22 | 30 | N/L | 1.56 | 1.54 | 33.6 | D | 3.1 |
| | | H/H | 1.43 | 1.41 | 28.4 | E | 1.3 |
| 23 | 35 | N/L | 1.52 | 1.50 | 37.0 | C | 2.7 |
| | | H/H | 1.49 | 1.46 | 28.2 | E | 3.8 |
| 24 | 36 | N/L | 0.99 | 0.85 | 25.3 | E | 3.5 |
| | | H/H | 0.77 | 0.55 | 10.3 | F | 4.5 |
| 25 | 37 | N/L | 0.46 | — | 18.6 | F | 0.7 |
| | | H/H | 0.50 | — | 4.5 | F | 1.0 |
| 26 | 38 | N/L | 0.53 | — | 15.9 | F | — |
| | | H/H | 0.50 | — | 4.1 | F | — |

N/L: 23° C/5% RH
H/H: 30° C/80% RH

TABLE 13

| sample | sleeve | copolymer | terpolymer component monomer (1) | monomer (2) | monomer (3) | monomer ratio (1):(2):(3) (molar ratio) | Mw *1 | Mn *2 | Mw/Mn |
|---|---|---|---|---|---|---|---|---|---|
| Example: | | | | | | | | | |
| 71 | 54 | 39 | MMA | DM | AA | 85:10:5 | 11,500 | 4,800 | 2.4 |
| 72 | 55 | 40 | MMA | DM | MA | 85:10:5 | 12,500 | 5,700 | 2.2 |
| 73 | 56 | 41 | MMA | DM | MB | 85:10:5 | 11,900 | 4,200 | 2.8 |
| 74 | 57 | 42 | MMA | DE | AA | 85:10:5 | 13,000 | 5,300 | 2.5 |

TABLE 13-continued

| sample | sleeve | copolymer | terpolymer component monomer (1) | monomer (2) | monomer (3) | monomer ratio (1):(2):(3) (molar ratio) | Mw *1 | Mn *2 | Mw/Mn |
|---|---|---|---|---|---|---|---|---|---|
| 75 | 58 | 43 | MMA | DE | MB | 85:10:5 | 11,300 | 4,300 | 2.6 |
| 76 | 59 | 44 | MMA | DM | — | 85:15:0 | 11,100 | 4,800 | 2.3 |
| Comparative Example: | | | | | | | | | |
| 27 | 60 | — | phenol resin intermediate | | | — | — | — | — |

*1 Mw: weight average molecular weight
*2 Mn: number average molecular weight

TABLE 14

| sample | sleeve | carbon *1 | graphite *2 | volume resistivity of resin layer (Ω · cm) | center line average roughness (Ra) (μm) |
|---|---|---|---|---|---|
| Example: | | | | | |
| 71 | 54 | 4 | 36 | 29.3 | 0.96 |
| 72 | 55 | 4 | 36 | 31.2 | 0.89 |
| 73 | 56 | 4 | 36 | 28.3 | 0.85 |
| 74 | 57 | 4 | 36 | 27.5 | 0.93 |
| 75 | 58 | 4 | 36 | 26.3 | 0.87 |
| 76 | 59 | 4 | 36 | 28.1 | 0.92 |
| Comparative Example: | | | | | |
| 27 | 60 | 4 | 36 | 27.5 | 0.79 |

*1 and *2: parts by weight

TABLE 15

| sample | sleeve | environment | 5 mm square density | solid density | toner charge quantity | unevenness | soiling |
|---|---|---|---|---|---|---|---|
| initial stage | | | | | | | |
| Example: | | | | | | | |
| 71 | 54 | N/L | 1.50 | 1.49 | −19.2 | A | |
| | | H/H | 1.46 | 1.45 | −14.3 | A | |
| 72 | 55 | N/L | 1.50 | 1.47 | −15.7 | A | |
| | | H/H | 1.46 | 1.43 | −12.9 | A | |
| 73 | 56 | N/L | 1.48 | 1.46 | −17.6 | A | |
| | | H/H | 1.45 | 1.44 | −14.6 | A | |
| 74 | 57 | N/L | 1.48 | 1.46 | −16.1 | A | |
| | | H/H | 1.45 | 1.43 | −12.3 | A | |
| 75 | 58 | N/L | 1.45 | 1.43 | −14.8 | A | |
| | | H/H | 1.43 | 1.41 | −11.9 | A | |
| 76 | 59 | N/L | 1.46 | 1.45 | −18.5 | A | |
| | | H/H | 1.44 | 1.44 | −15.0 | A | |
| Comparative Example: | | | | | | | |
| 27 | 60 | N/L | 1.33 | 1.28 | −15.3 | D | |
| | | H/H | 1.35 | 1.29 | −12.1 | C | |
| after 1,500-sheet copying | | | | | | | |
| Example: | | | | | | | |
| 71 | 54 | N/L | 1.49 | 1.48 | −19.7 | A | |
| | | H/H | 1.44 | 1.43 | −14.3 | A | |

TABLE 15-continued

| sample | sleeve | environment | 5 mm square density | solid density | toner charge quantity | unevenness | soiling |
|---|---|---|---|---|---|---|---|
| 72 | 55 | N/L | 1.48 | 1.45 | −14.6 | A | |
| | | H/H | 1.45 | 1.43 | −12.8 | A | |
| 73 | 56 | N/L | 1.49 | 1.43 | −16.3 | A | |
| | | H/H | 1.42 | 1.39 | −13.8 | A | |
| 74 | 57 | N/L | 1.46 | 1.45 | −15.7 | A | |
| | | H/H | 1.43 | 1.40 | −11.8 | A | |
| 75 | 58 | N/L | 1.45 | 1.43 | −15.1 | A | |
| | | H/H | 1.41 | 1.39 | −12.2 | A | |
| 76 | 59 | N/L | 1.41 | 1.40 | −18.3 | B | |
| | | H/H | 1.37 | 1.37 | −14.4 | A | |
| Comparative Example: | | | | | | | |
| 27 | 60 | N/L | 1.05 | 0.95 | −12.1 | E | |
| | | H/H | 1.21 | 1.03 | −9.7 | D | |
| after 3,000-sheet copying | | | | | | | |
| Example: | | | | | | | |
| 71 | 54 | N/L | 1.49 | 1.48 | −17.6 | A | B |
| | | H/H | 1.43 | 1.40 | −13.0 | A | A |
| 72 | 55 | N/L | 1.49 | 1.46 | −14.2 | A | B |
| | | H/H | 1.44 | 1.43 | −11.0 | A | A |
| 73 | 56 | N/L | 1.46 | 1.44 | −15.9 | A | B |
| | | H/H | 1.40 | 1.37 | −13.1 | A | D |
| 74 | 57 | N/L | 1.45 | 1.42 | −14.9 | A | B |
| | | H/H | 1.39 | 1.37 | −11.1 | A | A |
| 75 | 58 | N/L | 1.44 | 1.42 | −14.5 | A | C |
| | | H/H | 1.37 | 1.37 | −11.8 | A | C |
| 76 | 59 | N/L | 1.36 | 1.35 | −15.8 | B | B |
| | | H/H | 1.35 | 1.33 | −13.5 | A | D |
| Comparative Example: | | | | | | | |
| 27 | 60 | N/L | 0.89 | 0.73 | −7.3 | E | E |
| | | H/H | 1.10 | 0.89 | −5.9 | B | F |

What is claimed is:

1. A developer carrying member for carrying a developer, comprising;

a substrate and a resin coat layer which is formed on a surface of the substrate and contains a binder resin and a conductive fine powder, wherein;

said binder resin comprises a copolymer having a monomeric unit of a methyl methacrylate monomer (M) and a monomeric unit of a nitrogen-containing vinyl monomer (N);

a copolymerization molar ratio of the methyl methacrylate monomer (M) to the nitrogen-containing vinyl monomer (N) in said copolymer fulfills the following condition:

M:N=4:1 to 999:1;

and said binder resin has a weight-average molecular weight (Mw) of from 3,000 to 50,000.

2. The developer carrying member according to claim 1, wherein the copolymerization molar ratio of the methyl methacrylate monomer (M) to the nitrogen-containing vinyl monomer (N) fulfills the following condition:

M:N=4:1 to 99:1.

3. The developer carrying member according to claim 1, wherein at a time of synthesis of said copolymer the methyl methacrylate monomer (M) is used in an amount of from 70% by mole to less than 99.9% by mole based on the total monomers constituting said copolymer.

4. The developer carrying member according to claim 1, wherein at a time of synthesis of said copolymer the methyl methacrylate monomer (M) is used in an amount of from 70% by mole to less than 99.0% by mole based on the total monomers constituting said copolymer.

5. The developer carrying member according to claim 1, wherein at a time of synthesis of said copolymer the nitrogen-containing vinyl monomer (N) is used in an amount of from 0.1% by mole to less than 20% by mole based on the total monomers constituting said copolymer.

6. The developer carrying member according to claim 1, wherein at a time of synthesis of said copolymer the nitrogen-containing vinyl monomer (N) is used in an amount of from 1% by mole to less than 20% by mole based on the total monomers constituting said copolymer.

7. The developer carrying member according to claim 1, wherein said binder resin has a ratio of the weight-average molecular weight (Mw) to a number-average molecular weight (Mn), Mw/Mn, of not more than 3.5.

8. The developer carrying member according to claim 1, wherein said resin coat layer has a volume resistivity of from $1\times10^{-2}$ Ω.cm to $1\times10^{5}$ Ω.cm.

9. The developer carrying member according to claim 1, wherein said resin coat layer has a center-line surface roughness Ra of from 0.3 to 3.5.

10. The developer carrying member according to claim 1, wherein said nitrogen-containing vinyl monomer comprises a monomer selected from the group consisting of an aminoacrylic monomer, an aminomethacrylic monomer and a nitrogen-containing heterocyclic N-vinyl compound.

11. The developer carrying member according to claim 1, wherein said nitrogen-containing vinyl monomer is a monomer represented by the following Formula (1):

(1)

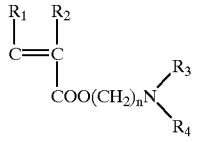

wherein $R_1$, $R_2$, $R_3$ and $R_4$ each represent a hydrogen atom or a saturated hydrocarbon group having from 1 to 4 carbon atoms; and n represents an integer of from 1 to 4.

12. The developer carrying member according to claim 1, wherein said nitrogen-containing vinyl monomer comprises a quaternary ammonium group-containing vinyl monomer.

13. The developer carrying member according to claim 12, wherein said quaternary ammonium group-containing vinyl monomer is a monomer represented by the following Formula (2):

(2)

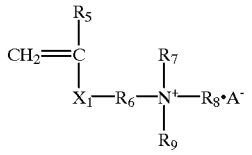

wherein $R_5$ represents a hydrogen atom or a methyl group; $R_6$ represents an alkylene group having from 1 to 4 carbon atoms; $R_7$, $R_8$ and $R_9$ each represent a methyl group, an ethyl group or a propyl group; $X_1$ represents —COO or —CONH; and A represents an anion selected from $Cl^-$ and $(1/2)SO_4^{2-}$.

14. The developer carrying member according to claim 1, wherein said binder resin comprises a terpolymer having, in addition to the monomeric unit of a methyl methacrylate monomer (M) and the monomeric unit of a nitrogen-containing vinyl monomer (N), a monomeric unit of an acid monomer or acid ester monomer (A) having a vinyl group other than methyl methacrylate.

15. The developer carrying member according to claim 14, wherein said acid monomer or acid ester monomer (A) having a vinyl group other than methyl methacrylate is a monomer selected from the group consisting of a monocarboxylic acid monomer having a double bond, a monocarboxylic acid ester monomer having a double bond, a dicarboxylic acid monomer having a double bond, and a dicarboxylic acid ester monomer having a double bond.

16. The developer carrying member according to claim 14, wherein at a time of synthesis of said terpolymer the acid monomer or acid ester monomer (A) having a vinyl group other than methyl methacrylate is used in an amount of from 0.1% by mole to less than 30% by mole based on the total monomers constituting said terpolymer.

17. The developer carrying member according to claim 14, wherein at a time of synthesis of said terpolymer the acid monomer or acid ester monomer (A) having a vinyl group other than methyl methacrylate is used in an amount of from 1% by mole to 20% by mole based on the total monomers constituting said terpolymer.

18. The developer carrying member according to claim 1, wherein said conductive fine powder has a powder selected from the group consisting of metal powder, metal alloy powder, metal oxide powder and carbon-type conductive powder.

19. The developer carrying member according to claim 1, wherein said conductive fine powder has a powder selected from the group consisting of carbon black, graphite and a mixture of carbon black and graphite.

20. The developer carrying member according to claim 1, wherein said conductive fine powder has a number-average particle diameter of from 0.01 μm to 30 μm.

21. The developer carrying member according to claim 1, wherein said resin coat layer further contains a lubricating powder.

22. The developer carrying member according to claim 21, wherein said lubricating powder has a powder selected from the group consisting of molybdenum disulfide, boron nitride, mica, graphite, graphite fluoride, silver-niobium selenide, calcium chloride-graphite, talc, fluoropolymer and a fatty acid metal salt.

23. An apparatus unit detachably mountable on a main assembly of an image forming apparatus; said unit comprising;

a developer container for holding a developer;

a developer carrying member for carrying the developer held in the developer container and transporting the developer to a developing zone; and a developer layer-thickness regulating member which comes into pressure contact with, or abuts on, a surface of the developer carrying member through the developer to regulate a layer thickness of a developer layer formed on the developer carrying member;

said developer carrying member comprising a substrate and a resin coat layer which is formed on the surface of the substrate and contains a binder resin and a conductive fine powder, wherein;

said binder resin comprises a copolymer having a monomeric unit of a methyl methacrylate monomer (M) and a monomeric unit of a nitrogen-containing vinyl monomer (N);

a copolymerization molar ratio of the methyl methacrylate monomer (M) to the nitrogen-containing vinyl monomer (N) in said copolymer fulfills the following condition:

M:N=4:1 to 999:1;

and said binder resin has a weight-average molecular weight (Mw) of from 3,000 to 50,000.

24. The apparatus unit according to claim 23, wherein the copolymerization molar ratio of the methyl methacrylate monomer (M) to the nitrogen-containing vinyl monomer (N) fulfills the following condition:

M:N=4:1 to 99:1.

25. The apparatus unit according to claim 23, wherein at a time of synthesis of said copolymer the methyl methacrylate monomer (M) is used in an amount of from 70% by mole to less than 99.9% by mole based on the total monomers constituting said copolymer.

26. The apparatus unit according to claim 23, wherein at a time of synthesis of said copolymer the methyl methacrylate monomer (M) is used in an amount of from 70% by mole to less than 99.0% by mole based on the total monomers constituting said copolymer.

27. The apparatus unit according to claim 23, wherein at a time of synthesis of said copolymer the nitrogen-containing vinyl monomer (N) is used in an amount of from 0.1% by mole to less than 20% by mole based on the total monomers constituting said copolymer.

28. The apparatus unit according to claim 23, wherein at a time of synthesis of said copolymer the nitrogen-containing vinyl monomer (N) is used in an amount of from 1% by mole to less than 20% by mole based on the total monomers constituting said copolymer.

29. The apparatus unit according to claim 23, wherein said binder resin has a ratio of weight-average molecular weight (Mw) to number-average molecular weight (Mn), Mw/Mn, of not more than 3.5.

30. The apparatus unit according to claim 23, wherein said resin coat layer has a volume resistivity of from $1\times10^{-2}$ Ω.cm to $1\times10^{5}$ Ω.cm.

31. The apparatus unit according to claim 23, wherein said resin coat layer has a center-line surface roughness Ra of from 0.3 to 3.5.

32. The apparatus unit according to claim 23, wherein said nitrogen-containing vinyl monomer comprises a monomer selected from the group consisting of an aminoacrylic monomer, an aminomethacrylic monomer and a nitrogen-containing heterocyclic N-vinyl compound.

33. The apparatus unit according to claim 23, wherein said nitrogen-containing vinyl monomer is a monomer represented by the following Formula (1):

(1)

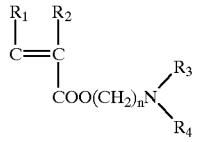

wherein $R_1$, $R_2$, $R_3$ and $R_4$ each represent a hydrogen atom or a saturated hydrocarbon group having from 1 to 4 carbon atoms; and n represents an integer of from 1 to 4.

34. The apparatus unit according to claim 23, wherein said nitrogen-containing vinyl monomer comprises a quaternary ammonium group-containing vinyl monomer.

35. The apparatus unit according to claim 34, wherein said quaternary ammonium group-containing vinyl monomer is a monomer represented by the following Formula (2):

(2)

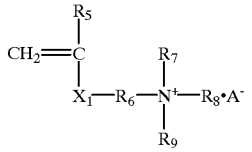

wherein $R_5$ represents a hydrogen atom or a methyl group; $R_6$ represents an alkylene group having from 1 to 4 carbon atoms; $R_7$, $R_8$ and $R_9$ each represent a methyl group, an ethyl group or a propyl group; $X_1$ represents —COO or —CONH; and A represents an anion selected from $Cl^-$ and $(1/2)SO_4^{2-}$.

36. The apparatus unit according to claim 23, wherein said binder resin comprises a terpolymer having, in addition to the monomeric unit of a methyl methacrylate monomer (M) and the monomeric unit of a nitrogen-containing vinyl monomer (N), a monomeric unit of an acid monomer or acid ester monomer (A) having a vinyl group other than methyl methacrylate.

37. The apparatus unit according to claim 36, wherein said acid monomer or acid ester monomer (A) having a vinyl group other than methyl methacrylate is a monomer selected from the group consisting of a monocarboxylic acid monomer having a double bond, a monocarboxylic acid ester monomer having a double bond, a dicarboxylic acid monomer having a double bond, and a dicarboxylic acid ester monomer having a double bond.

38. The apparatus unit according to claim 36, wherein at a time of synthesis of said terpolymer the acid monomer or acid ester monomer (A) having a vinyl group other than methyl methacrylate is used in an amount of from 0.1% by mole to less than 30% by mole based on the total monomers constituting said terpolymer.

39. The apparatus unit according to claim 36, wherein at a time of synthesis of said terpolymer the acid monomer or acid ester monomer (A) having a vinyl group other than methyl methacrylate is used in an amount of from 1% by mole to 20% by mole based on the total monomers constituting said terpolymer.

40. The apparatus unit according to claim 23, wherein said conductive fine powder has a powder selected from the group consisting of metal powder, metal alloy powder, metal oxide powder and carbon-type conductive powder.

41. The apparatus unit according to claim 23, wherein said conductive fine powder has a powder selected from the group consisting of carbon black, graphite and a mixture of carbon black and graphite.

42. The apparatus unit according to claim 23, wherein said conductive fine powder has a number-average particle diameter of from 0.01 μm to 30 μm.

43. The apparatus unit according to claim 23, wherein said resin coat layer further contains a lubricating powder.

44. The apparatus unit according to claim 43, wherein said lubricating powder has a powder selected from the group consisting of molybdenum disulfide, boron nitride, mica, graphite, graphite fluoride, silver-niobium selenide, calcium chloride-graphite, talc, fluoropolymer and a fatty acid metal salt.

45. The apparatus unit according to claim 23, wherein said developer layer-thickness regulating member has an elastic regulating blade.

46. The apparatus unit according to claim 45, wherein said elastic regulating blade is formed of a material having rubber elasticity or metal elasticity.

47. The apparatus unit according to claim 23, wherein said developer layer-thickness regulating member is brought into touch with the surface of said developer carrying member at a pressure of from 5 g/cm to 50 g/cm.

48. The apparatus unit according to claim 23, which is further provided with a feeding and stripping member for feeding to said developer carrying member the developer held in said developer container and for stripping the developer carried on said developer carrying member after development; said feeding and stripping member being brought into contact with the surface of said developer carrying member.

49. The apparatus unit according to claim 48, wherein said feeding and stripping member comprises an elastic roller member, a belt member or a brush member.

50. The apparatus unit according to claim 48, wherein said developer carrying member comprises a rotatable sleeve-like member and said feeding and stripping member comprises an elastic roller member; said elastic roller member, at the time of development, being rotated in the direction counter to the moving direction of a surface of the sleeve-like member and at a peripheral speed of from 20% to 120% with respect to 100% of a peripheral speed of the sleeve-like member.

51. The apparatus unit according to claim 48, wherein said feeding and stripping member is brought into pressure contact with the surface of said developer carrying member at a penetration of from 0.5 mm to 2.5 mm.

52. The apparatus unit according to claim 23, which is further provided with at least one member selected from the group consisting of an electrostatic latent image bearing member for bearing an electrostatic latent image, a cleaning means for cleaning a surface of the electrostatic latent image bearing member and a charging means for charging the electrostatic latent image bearing member.

53. The apparatus unit according to claim 52, wherein said electrostatic latent image bearing member is an electrophotographic photosensitive member.

54. The apparatus unit according to claim 23, wherein said developer is a one-component developer having a toner.

55. The apparatus unit according to claim 54, wherein said toner is a non-magnetic toner.

56. The apparatus unit according to claim 54, wherein said toner is a magnetic toner.

57. The apparatus unit according to claim 54, wherein said toner contains a release agent in an amount of from 0.1% by weight to 50% by weight based on a weight of the toner.

58. The apparatus unit according to claim 54, wherein said toner is produced by a pulverization process comprising melt-kneading a toner material having at least a binder resin for toner and a colorant, and pulverizing a resultant kneaded product.

59. The apparatus unit according to claim 54, wherein said toner is produced by polymerizing in an aqueous medium a polymerizable monomer composition having at least a polymerizable monomer and a colorant.

60. The apparatus unit according to claim 59, wherein said toner is produced by polymerizing in an aqueous medium a polymerizable monomer composition having a release agent in addition to the polymerizable monomer and the colorant; said toner containing a binder resin for toner, the colorant and the release agent.

61. The apparatus unit according to claim 59, wherein said toner is produced by polymerizing in an aqueous medium a polymerizable monomer composition containing a release agent and a polymer having a polar functional group, in addition to the polymerizable monomer and the colorant; said toner containing a binder resin for toner, the colorant, the release agent and the polymer having a polar functional group.

62. The apparatus unit according to claim 61, wherein said toner contains the release agent in an amount of from 0.1% by weight to 50% by weight and the polymer having a polar functional group in an amount of from 1% by weight to 20% by weight, based on a weight of the toner.

63. The apparatus unit according to claim 61, wherein said polymer having a polar functional group has at least one polymer selected from the group consisting of a copolymer of a hydrophilic functional group-containing polymerizable monomer with a vinyl compound, a polyester, a polyamide, a polyether and a polyamine.

64. The apparatus unit according to claim 60, wherein said polymer having a polar functional group has a polyester.

65. The apparatus unit according to claim 54, wherein said one-component developer has a weight-average particle diameter (D4) of from 3 μm to 12 μm and has such a particle size distribution that toner particles with diameters of 4 μm or smaller are in a content of 30% by number or less and toner particles with diameters smaller than 10.1 μm are in a content of 15% by volume or less.

66. The apparatus unit according to claim 54, wherein said one-component developer has a weight-average particle diameter (D4) of from 3 μm to 8 μm and has such a particle size distribution that toner particles with diameters of 4 μm or smaller are in a content of from 5% by number to 20% by number and toner particles with diameters smaller than 10.1 μm are in a content of from 0.1% by volume to 10% by volume.

67. An image-forming apparatus comprising;

an electrostatic latent image bearing member for bearing thereon an electrostatic latent image; and a developing assembly for developing the electrostatic latent image to form a developed image;

said developing assembly comprising;

a developer container for holding a developer;

a developer carrying member for carrying the developer held in the developer container and transporting the developer to a developing zone; and a developer layer-thickness regulating member which comes into pressure contact with, or abuts on, a surface of the developer carrying member through the developer to regulate the layer thickness of a developer layer formed on the developer carrying member;

said developer carrying member comprising a substrate and a resin coat layer which is formed on a surface of the substrate and contains a binder resin and a conductive fine powder, wherein;

said binder resin comprises a copolymer having a monomeric unit of a methyl methacrylate monomer (M) and a monomeric unit of a nitrogen-containing vinyl monomer (N);

a copolymerization molar ratio of the methyl methacrylate monomer (M) to the nitrogen-containing vinyl monomer (N) in said copolymer fulfills the following condition:

M:N=4:1 to 999:1;

and said binder resin has a weight-average molecular weight (Mw) of from 3,000 to 50,000.

68. The image forming apparatus according to claim 67, wherein the copolymerization molar ratio of the methyl methacrylate monomer (M) to the nitrogen-containing vinyl monomer (N) fulfills the following condition:

M:N=4:1 to 99:1.

69. The image forming apparatus according to claim 67, wherein at a time of synthesis of said copolymer the methyl methacrylate monomer (M) is used in an amount of from 70% by mole to less than 99.9% by mole based on the total monomers constituting said copolymer.

70. The image forming apparatus according to claim 67, wherein at a time of synthesis of said copolymer the methyl methacrylate monomer (M) is used in an amount of from 70% by mole to less than 99.0% by mole based on the total monomers constituting said copolymer.

71. The image forming apparatus according to claim 67, wherein at a time of synthesis of said copolymer the nitrogen-containing vinyl monomer (N) is used in an amount of from 0.1% by mole to less than 20% by mole based on the total monomers constituting said copolymer.

72. The image forming apparatus according to claim 67, wherein at a time of synthesis of said copolymer the nitrogen-containing vinyl monomer (N) is used in an amount of from 1% by mole to less than 20% by mole based on the total monomers constituting said copolymer.

73. The image forming apparatus according to claim 67, wherein said binder resin has a ratio of weight-average molecular weight (Mw) to number-average molecular weight (Mn), Mw/Mn, of not more than 3.5.

74. The image forming apparatus according to claim 67, wherein said resin coat layer has a volume resistivity of from $1\times10^{-2}$ Ω.cm to $1\times10^{5}$ Ω.cm.

75. The image forming apparatus according to claim 67, wherein said resin coat layer has a center-line surface roughness Ra of from 0.3 to 3.5.

76. The image forming apparatus according to claim 67, wherein said nitrogen-containing vinyl monomer comprises a monomer selected from the group consisting of an aminoacrylic monomer, an aminomethacrylic monomer and a nitrogen-containing heterocyclic N-vinyl compound.

77. The image forming apparatus according to claim 67, wherein said nitrogen-containing vinyl monomer is a monomer represented by the following Formula (1):

(1)

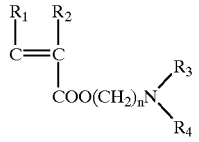

wherein $R_1$, $R_2$, $R_3$ and $R_4$ each represent a hydrogen atom or a saturated hydrocarbon group having from 1 to 4 carbon atoms; and n represents an integer of from 1 to 4.

78. The image forming apparatus according to claim 67, wherein said nitrogen-containing vinyl monomer comprises a quaternary ammonium group-containing vinyl monomer.

79. The image forming apparatus according to claim 78, wherein said quaternary ammonium group-containing vinyl monomer is a monomer represented by the following Formula (2):

(2)

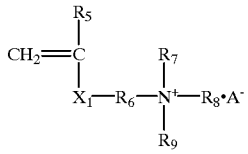

wherein $R_5$ represents a hydrogen atom or a methyl group; $R_6$ represents an alkylene group having from 1 to 4 carbon atoms; $R_7$, $R_8$ and $R_9$ each represent a methyl group, an ethyl group or a propyl group; $X_1$ represents —COO or —CONH; and A represents an anion selected from $Cl^-$ and $(1/2)SO_4^{2-}$.

80. The image forming apparatus according to claim 67, wherein said binder resin comprises a terpolymer having, in addition to the monomeric unit of a methyl methacrylate monomer (M) and the monomeric unit of a nitrogen-containing vinyl monomer (N), a monomeric unit of an acid monomer or acid ester monomer (A) having a vinyl group other than methyl methacrylate.

81. The image forming apparatus according to claim 80, wherein said acid monomer or acid ester monomer (A) having a vinyl group other than methyl methacrylate is a monomer selected from the group consisting of a monocarboxylic acid monomer having a double bond, a monocarboxylic acid ester monomer having a double bond, a dicarboxylic acid monomer having a double bond, and a dicarboxylic acid ester monomer having a double bond.

82. The image forming apparatus according to claim 80, wherein at a time of synthesis of said terpolymer the acid monomer or acid ester monomer (A) having a vinyl group other than methyl methacrylate is used in an amount of from 0.1% by mole to less than 30% by mole based on the total monomers constituting said terpolymer.

83. The image forming apparatus according to claim 80, wherein at a time of synthesis of said terpolymer the acid monomer or acid ester monomer (A) having a vinyl group other than methyl methacrylate is used in an amount of from 1% by mole to 20% by mole based on the total monomers constituting said terpolymer.

84. The image forming apparatus according to claim 67, wherein said conductive fine powder has a powder selected from the group consisting of metal powder, metal alloy powder, metal oxide powder and carbon-type conductive powder.

85. The image forming apparatus according to claim 67, wherein said conductive fine powder has a powder selected from the group consisting of carbon black, graphite and a mixture of carbon black and graphite.

86. The image forming apparatus according to claim 67, wherein said conductive fine powder has a number-average particle diameter of from 0.01 μm to 30 μm.

87. The image forming apparatus according to claim 67, wherein said resin coat layer further contains a lubricating powder.

88. The image forming apparatus according to claim 87, wherein said lubricating powder has a powder selected from the group consisting of molybdenum disulfide, boron nitride, mica, graphite, graphite fluoride, silver-niobium selenide, calcium chloride-graphite, talc, fluoropolymer and a fatty acid metal salt.

89. The image forming apparatus according to claim 67, wherein said developer layer-thickness regulating member has an elastic regulating blade.

90. The image forming apparatus according to claim 89, wherein said elastic regulating blade is formed of a material having rubber elasticity or metal elasticity.

91. The image forming apparatus according to claim 67, wherein said developer layer-thickness regulating member is brought into touch with the surface of said developer carrying member at a pressure of from 5 g/cm to 50 g/cm.

92. The image forming apparatus according to claim 67, which is further provided with a feeding and stripping member for feeding to said developer carrying member the developer held in said developer container and for stripping the developer carried on said developer carrying member after development; said feeding and stripping member being brought into contact with the surface of said developer carrying member.

93. The image forming apparatus according to claim 92, wherein said feeding and stripping member comprises an elastic roller member, a belt member or a brush member.

94. The image forming apparatus according to claim 92, wherein said developer carrying member comprises a rotatable sleeve-like member and said feeding and stripping member comprises an elastic roller member; said elastic roller member, at the time of development, being rotated in the direction counter to the moving direction of a surface of the sleeve-like member and at a peripheral speed of from 20% to 120% with respect to 100% of a peripheral speed of the sleeve-like member.

95. The image forming apparatus according to claim 92, wherein said feeding and stripping member is brought into pressure contact with the surface of said developer carrying member at a penetration of from 0.5 mm to 2.5 mm.

96. The image forming apparatus according to claim 67, which is further provided with at least one member selected from the group consisting of a cleaning means for cleaning a surface of the electrostatic latent image bearing member and a charging means for charging the electrostatic latent image bearing member.

97. The image forming apparatus according to claim 67, wherein said electrostatic latent image bearing member is an electrophotographic photosensitive member.

98. The image forming apparatus according to claim 67, wherein said developer is a one-component developer having a toner.

99. The image forming apparatus according to claim 98, wherein said toner is a non-magnetic toner.

100. The image-forming apparatus according to claim 98, wherein said toner is a magnetic toner.

101. The image forming apparatus according to claim 98, wherein said toner contains a release agent in an amount of from 0.1% by weight to 50% by weight based on a weight of the toner.

102. The image forming apparatus according to claim 98, wherein said toner is produced by a pulverization process comprising melt-kneading a toner material having at least a binder resin for toner and a colorant, and pulverizing a resultant kneaded product.

103. The image forming apparatus according to claim 98, wherein said toner is produced by polymerizing in an aqueous medium a polymerizable monomer composition having at least a polymerizable monomer and a colorant.

104. The image forming apparatus according to claim 103, wherein said toner is produced by polymerizing in an aqueous medium a polymerizable monomer composition having a release agent in addition to the polymerizable monomer and the colorant; said toner containing a binder resin for toner, the colorant and the release agent.

105. The image forming apparatus according to claim 103, wherein said toner is produced by polymerizing in an aqueous medium a polymerizable monomer composition containing a release agent and a polymer having a polar functional group, in addition to the polymerizable monomer and the colorant; said toner containing a binder resin for toner, the colorant, the release agent and the polymer having a polar functional group.

106. The image forming apparatus according to claim 105, wherein said toner contains the release agent in an amount of from 0.1% by weight to 50% by weight and the polymer having a polar functional group in an amount of from 1% by weight to 20% by weight, based on the weight of the toner.

107. The image forming apparatus according to claim 105, wherein said polymer having a polar functional group has at least one polymer selected from the group consisting of a copolymer of a hydrophilic functional group-containing polymerizable monomer with a vinyl compound, a polyester, a polyamide, a polyether and a polyamine.

108. The image forming apparatus according to claim 105, wherein said polymer having a polar functional group has a polyester.

109. The image forming apparatus according to claim 98, wherein said one-component developer has a weight-average particle diameter (D4) of from 3 μm to 12 μm and has such a particle size distribution that toner particles with diameters of 4 μm or smaller are in a content of 30% by number or less and toner particles with diameters smaller than 10.1 μm or larger are in a content of 15% by volume or less.

110. The image forming apparatus according to claim 98, wherein said one-component developer has a weight-average particle diameter (D4) of from 3 μm to 8 μm and has such a particle size distribution that toner particles with diameters of 4 μm or smaller are in a content of from 5% by number to 20% by number and toner particles with diameters smaller than 10.1 μm or larger are in a content of from 0.1% by volume to 10% by volume.

* * * * *

UNITED STATES PATENT AND TRADEMARK OFFICE

CERTIFICATE OF CORRECTION

PATENT NO. : 6,122,473
DATED : September 19, 2000
INVENTOR(S) : Yasuhide Goseki et al.

It is certified that error appears in the above-identified patent and that said Letters Patent is hereby corrected as shown below:

Title page,
Item [56] REFERENCES CITED,
"1-277265 11/1986 Japan" should read
-- 1-277265 11/1989 Japan --.
"0810492 3/1997 European Pat. Off." should read
-- 08-10492 3/1997 European Pat. Off. --.

Item [57] ABSTRACT,
Line 1, "is" should be deleted.

Column 2,
Line 13, "a" should read -- a higher --

Column 4,
Line 8, "a" should read -- an --.

Column 5,
Line 5, "comprising;" should read -- comprising: --.
Line 8, "wherein;" should read -- wherein --.
Line 25, "comprising;" should read -- comprising: --.
Line 38, "wherein;" should read -- wherein --.
Line 54, "comprising;" should read -- comprising: --.
Line 60, "comprising;" should read -- comprising: --.

Column 6,
Line 7, "wherein;" should read -- wherein --.

Column 8,
Line 4, "rials" should read -- rial --.

Column 13,
Line 31, "in decrease" should read -- decrease in --.
Line 35, "of" should be deleted.

Column 17,
Line 14, "of" should be deleted.

UNITED STATES PATENT AND TRADEMARK OFFICE

CERTIFICATE OF CORRECTION

PATENT NO. : 6,122,473
DATED : September 19, 2000
INVENTOR(S) : Yasuhide Goseki et al.

It is certified that error appears in the above-identified patent and that said Letters Patent is hereby corrected as shown below:

Column 25,
Line 63, "mg/M$^2$." should read -- mg/m$^2$. --.

Column 41,
Line 7, "the both" should read -- both the --.

Column 42,
Line 2, "C./5%" should read -- C/5% --.

Line 4, "C./80%" should read -- C/80% --.

Column 61,
Line 66, In "Table 12-1", "1.5o" should read -- 1.50 --.

Column 66,
Line 58, "comprising;" should read -- comprising: --.

Column 68,
Line 67, "comprising;" should read -- comprising: --.

Column 72,
Line 49, "comprising;" should read -- comprising: --.

Signed and Sealed this

Eighteenth Day of December, 2001

*Attest:*

*Attesting Officer*

JAMES E. ROGAN
*Director of the United States Patent and Trademark Office*